US010111516B1

(12) United States Patent
Kim et al.

(10) Patent No.: US 10,111,516 B1
(45) Date of Patent: Oct. 30, 2018

(54) ASSEMBLY TECHNOLOGY FOR ANY SHAPE DISK BRUSH WITH METAL WIRES AND CONICAL

(71) Applicant: AA R&D LLC, Leonia, NJ (US)

(72) Inventors: Yoon H. Kim, Leonia, NJ (US); Elizabeth H. Kim, Leonia, NJ (US); Asher T. Kim, Leonia, NJ (US); Aiden T. Kim, Leonia, NJ (US)

(73) Assignee: AA R&D LLC, Leonia, NJ (US)

( * ) Notice: Subject to any disclaimer, the term of this patent is extended or adjusted under 35 U.S.C. 154(b) by 0 days.

(21) Appl. No.: 15/862,300

(22) Filed: Jan. 4, 2018

Related U.S. Application Data

(60) Provisional application No. 62/592,948, filed on Nov. 30, 2017.

(51) Int. Cl.

| | |
|---|---|
| ***A45D 40/26*** | (2006.01) |
| ***A46B 3/18*** | (2006.01) |
| ***A46B 3/20*** | (2006.01) |
| ***A46B 9/02*** | (2006.01) |

(52) U.S. Cl.
CPC ..... *A46B 3/18* (2013.01); *A46B 3/20* (2013.01); *A46B 9/021* (2013.01); *A46B 2200/1053* (2013.01)

(58) Field of Classification Search
CPC .. A46B 3/18; A46B 3/20; A46B 9/021; A46B 2200/1053; A45D 40/26; A45D 40/261; A45D 40/262; A45D 40/265
See application file for complete search history.

(56) References Cited

U.S. PATENT DOCUMENTS

| | | | | |
|---|---|---|---|---|
| 6,260,558 | B1 * | 7/2001 | Neuner | A46B 9/021 132/218 |
| 8,899,241 | B2 | 12/2014 | Vandromme | |
| 8,919,351 | B1 * | 12/2014 | Wang | A46B 9/021 132/218 |
| 9,591,916 | B2 | 3/2017 | Kim | |
| 2009/0194128 | A1 * | 8/2009 | Vandromme | A46B 3/18 132/218 |
| 2017/0258213 | A1 * | 9/2017 | Lee | A46B 3/00 |

* cited by examiner

*Primary Examiner* — Rachel Steitz
(74) *Attorney, Agent, or Firm* — Westerman, Hattori, Daniels & Adrian, LLP

(57) ABSTRACT

The present invention is directed to a cosmetic applicator brush comprising a plurality of discs assembled relative to one another with each disc having a body with a plurality of bristles or combs extending radially therefrom, a conical, and a plurality of wires, where the plurality of wires pass through a wire passage of each of the plurality of discs, and the plurality of discs are stacked or linked without any angular offset or with a uniform angular offset so that alignment of bristles for the stacked discs is uniform. The conical is injection molded with the plurality of wires, and a top portion of the cosmetic applicator brush has the conical. After the plurality of discs are stacked or linked, the plurality of wires are twisted at a bottom portion of the cosmetic applicator brush so that the discs are securely linked or stacked.

7 Claims, 73 Drawing Sheets

FIG. 7

| # | TOP | SIDE | OUTLINE |
|---|---|---|---|
| WB-001A | C.L.L.L

WB-028A
C.L.L.L.L.L.L.L.L.L.L.L.L.L.L.L.L.L.L.L.M.M.S.S
WB-028B
C.L.L.L.L.L.L.L.L.L.L.L.L.L.L.L.L.L.L.L.M.M.S.S
WB-029A
C.L.L.M.M.S.S.S

ASSEMBLY TECHNOLOGY FOR ANY SHAPE DISK BRUSH WITH METAL WIRES AND CONICAL

RELATED APPLICATION

This application claims priority to U.S. Provisional Application No. 62/592,948, "ASSEMBLY TECHNOLOGY FOR ANY SHAPE DISK BRUSH WITH METAL WIRES AND CONICAL," filed Nov. 30, 2017, which application is incorporated by reference herein in its entirety.

FIELD OF THE INVENTION

The present invention relates to a cosmetic applicator. More particularly, the present invention relates to a cosmetic applicator brush including stacked discs, in which each disc is stacked by wires, and the wires pass through a wire passage of each disc. Furthermore, the present invention relates to a cosmetic applicator brush, in which its top portion includes a conical, and the wires are twisted in its bottom portion.

BACKGROUND OF THE INVENTION

Various cosmetics are applied using an applicator brush, for example, mascara which is a kind of cosmetic that is mainly used by women. The applicator brush is a cosmetic tool for painting various colors of mascara on eyelashes in order to show aesthetic sense around eyes or for applying other cosmetics to the eyes or other areas.

With the exemplary mascara, the applicator brush is configured to be inserted into a vessel in which mascara liquid is stored, a knob for opening and closing the vessel, a rod protruded to a leading end of the knob, and a brush formed on the rod. The mascara is used by smearing the mascara liquid on the brush through the coupling or separate process of the knob and the vessel.

Meanwhile, the mascara brush formed as above is manufactured to be suitable for various functions, such as a volume for the eyelashes (volume: effect that eyebrows are seen to be affluent according to the length and form of the brush hair), lengthening (lengthening: an effect that a length of eyebrows is long), clean (clean: an effect that eyebrows are not lumped), etc. The mascara brush uniformly applies the mascara liquid having viscosity on the eyelashes and a combing function by the brush should be excellent so that the eyelashes are not coagulated.

One type of manufacture for mascara brushes is a disc brush which is manufactured with an axial rod that penetrating multiple discs in the center. In order to create a desired bristle arrangement, each successive disc is placed in angular offset compared to the disc before and after. To achieve the angular offset, a geometrical cross section or key is typically built into the rod and discs alike. Such a keyed system requires the key to be offset relative to the bristles a different amount for each disc.

Another type of manufacture for mascara brushes is described in U.S. Pat. No. 9,591,916. Here, the mascara brushes are manufactured by passing wires through wire passages of each disc and twisting the wires independently at both ends of the mascara brushes. However, since the mascara brushes are manufactured by twisting the wires independently at both ends of the brushes, the alignment of bristles of each disc is not uniform. In other words, the alignment of bristles varies depending on the manufacturing conditions, and therefore, makeup performance is not excellent. Furthermore, since the wires have to be twisted at both ends of the brushes, manufacturing process can be cumbersome and expensive.

Another type of manufacture for mascara brushes is described in U.S. Pat. No. 8,899,241. Here, the mascara brushes are manufactured by passing a U-shaped wire/pin through wire passages of each disc and twisting the U-shaped wire/pin. Similarly, since the wire has to be twisted, the alignment of bristles of each disc is not uniform.

Therefore, the objective of the present invention is to provide an improved manufacturing method of a cosmetic applicator without twisting wires to stack discs, thereby solving the above-mentioned problems described in the related arts while improving makeup performance of the cosmetic applicator.

SUMMARY OF THE INVENTION

In at least one embodiment, the present invention provides a cosmetic applicator brush including a plurality of discs assembled relative to one another with each disc having a body with a plurality of bristles and/or combs extending radially therefrom. The adjacent discs are stacked or linked by wires (two or more). The adjacent discs are stacked or linked without any angular offset or with a uniform angular offset so that alignment of bristles for the stacked discs is uniform. The wires pass through a wire passage of each disc. Before the discs are stacked or linked, a conical is (bi-) injection molded with the wires so that a top portion of the cosmetic applicator brush has the conical. After the discs are stacked or linked, the wires are twisted at a bottom portion of the cosmetic applicator brush so that the discs are securely linked or stacked.

In at least another embodiment, the present invention provides a cosmetic applicator brush, where a single wire (instead of multiple wires) is used to link or stack the adjacent discs.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIGS. 7-73 show various designs of a cosmetic applicator brush with various designs of a conical and a plurality of discs stacked or linked by wires.

DETAILED DESCRIPTION OF THE INVENTION

Figure 1:
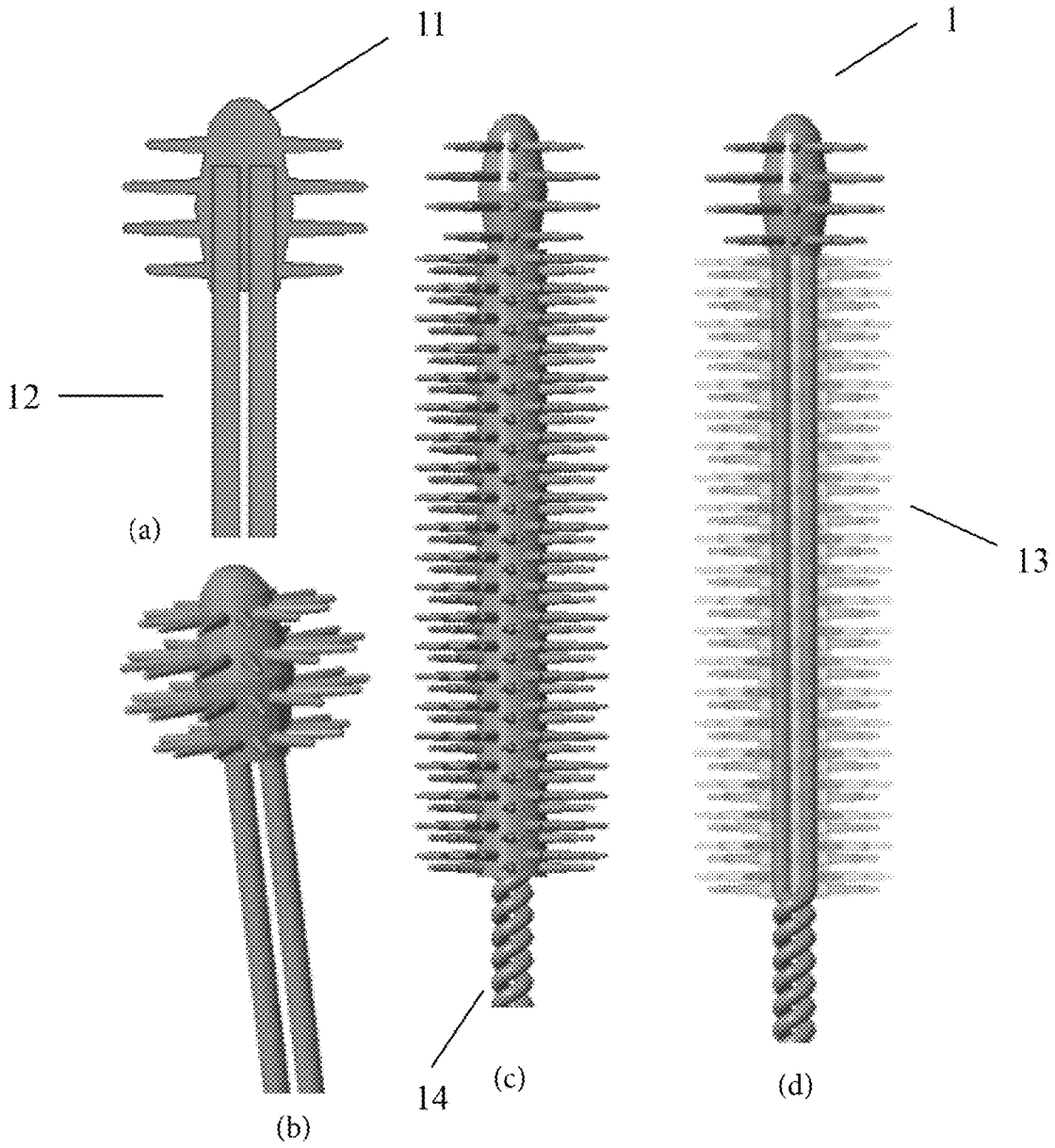
FIGS. 1 (*a*)-(*d*) are exploded perspective views of a cosmetic applicator brush in accordance with the first embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
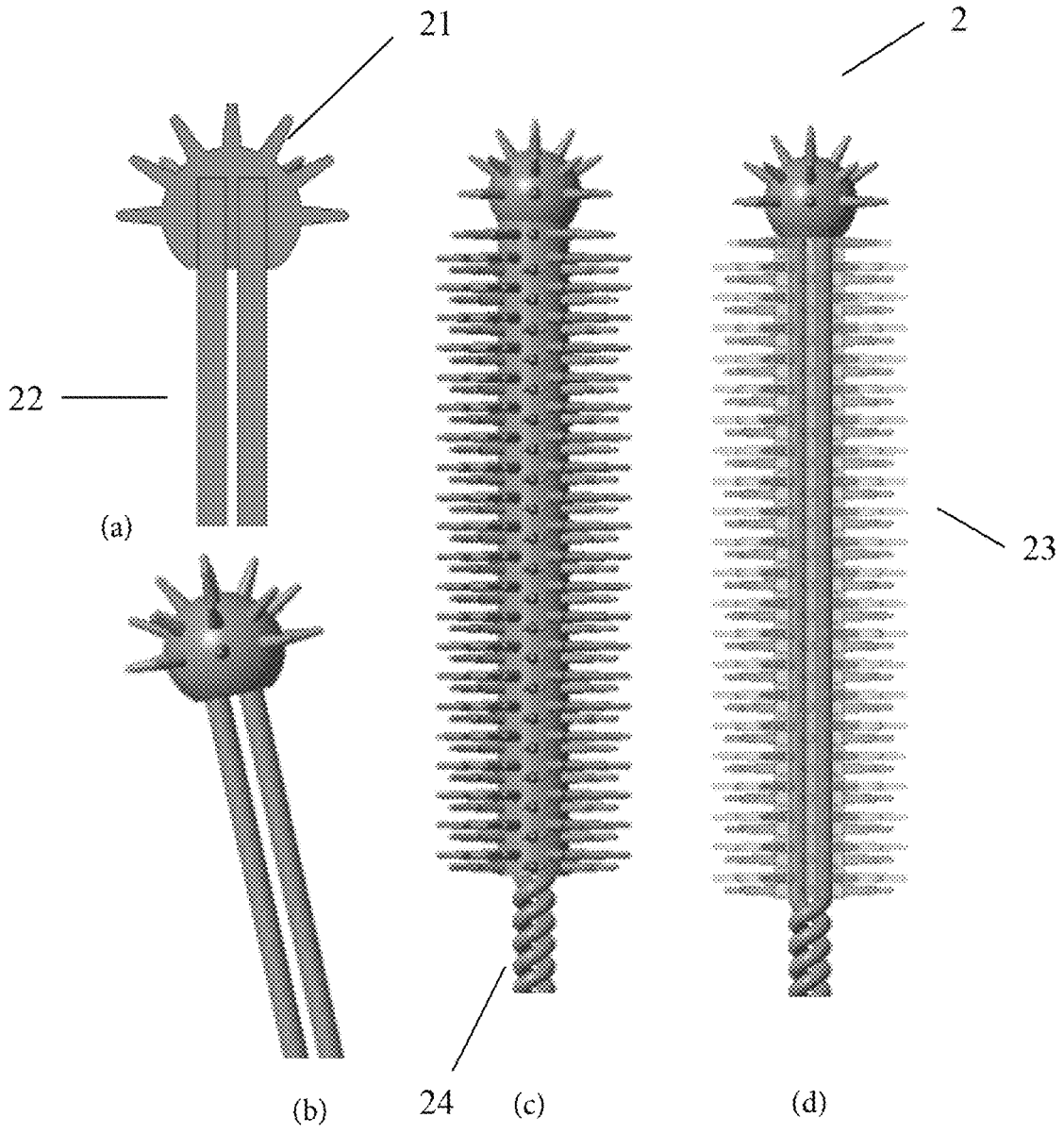
FIGS. 2 (*a*)-(*d*) are exploded perspective views of a cosmetic applicator brush in accordance with the first embodiment of the invention with another design of a conical.
Figure 3:
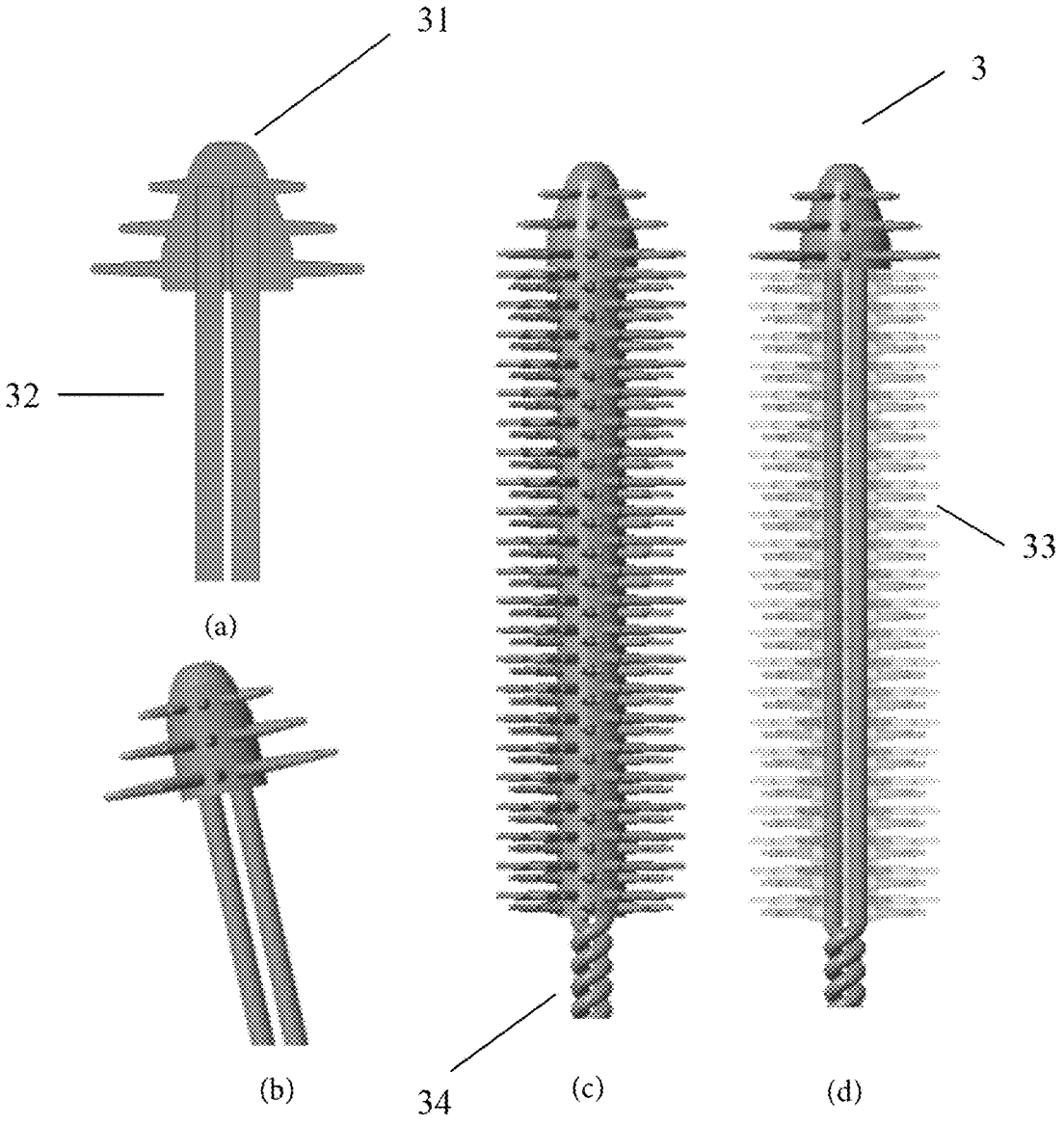
FIGS. 3 (*a*)-(*d*) are exploded perspective views of a cosmetic applicator brush in accordance with the first embodiment of the invention with another design of a conical.
Figure 4:
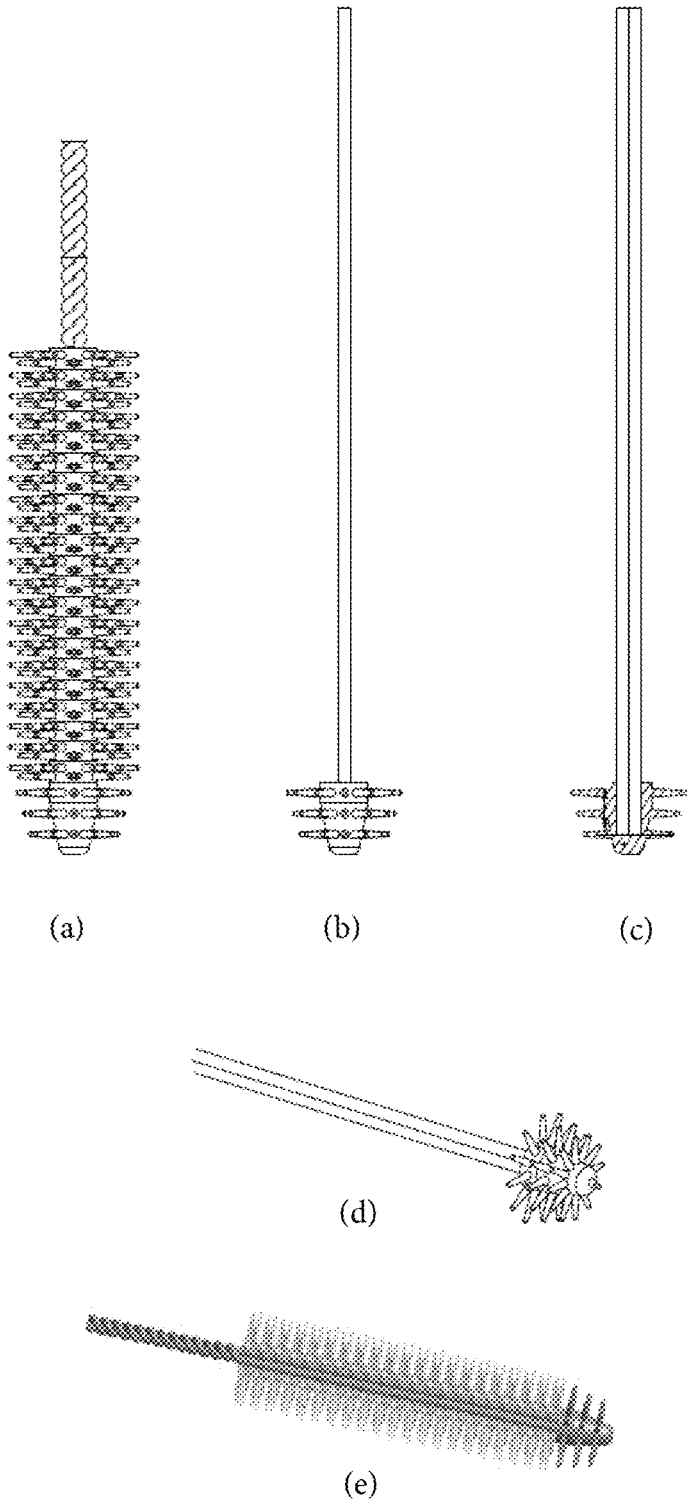
FIGS. 4 (*a*)-(*e*) are another views of a cosmetic applicator brush in FIGS. 3 (*a*)-(*d*).
Figure 5:
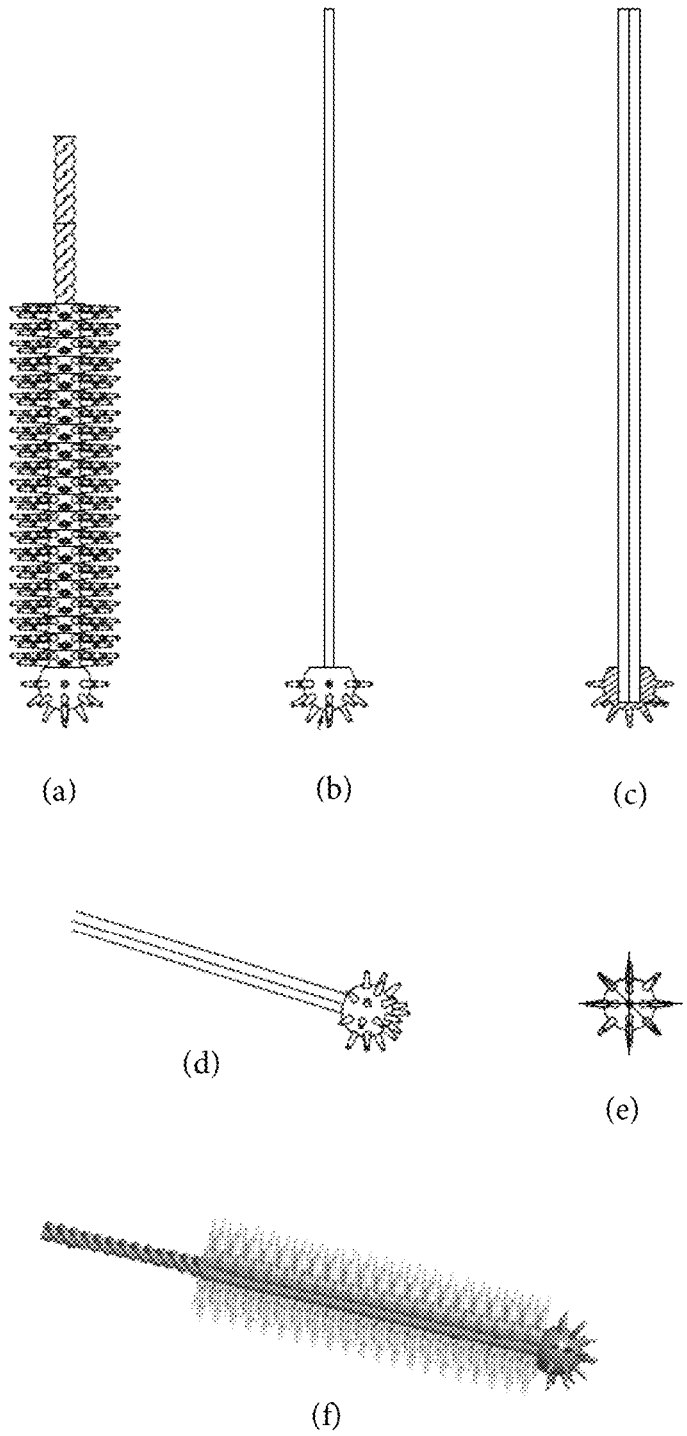
FIGS. 5 (*a*)-(*f*) are another views of a cosmetic applicator brush in FIGS. 2 (*a*)-(*d*).

Referring to FIGS. 1-3, a cosmetic applicator brush (1/2/3) in accordance with an embodiment of the invention will be described. The applicator brush (1/2/3) includes a plurality of discs (13/23/33) assembled on wires (12/22/32). In the illustrated embodiment, the wires (12/22/32) are (bi-) injection molded with a conical (11/21/31) before stacking or linking the plurality of discs (13/23/33). The wires (12/22/32), which are separate and parallel to each other, are used to link or stack the discs (13/23/33). After stacking or linking the plurality discs (13/23/33), the wires (12/22/32) are twisted so that the discs are securely linked or stacked.

Here, the conical (11/21/31) can be of any shape and made up of any material. It is preferred that it is made up of a plastic material. In addition, the wires (12/22/32) can be made up of any material. It is preferred that they are made up of a metal.

Furthermore, the plurality of discs (13/23/33) can be of any shape and made up of any material. Each disc has a wire passage, where the wires can pass through to link or stack the plurality of discs. The wire passage can be of any shape and is not limited to the design shown in the figures.

When the plurality of discs (13/23/33) are stacked or linked with the wires, they are stacked or linked so that there is no angular offset so that alignment of bristles for the stacked discs is uniform. Also, they can be stacked or linked with a uniform angular offset so that alignment of bristles for the stacked discs is uniform.

The method of molding the wires (12/22/32) and the conical (11/21/31) includes any molding method.

The number of wires (12/22/32) can be one or more. It is preferred that the number of wires (12/22/32) is two. However, the number of wires (12/22/32) is not limited to two.

Figure 6:
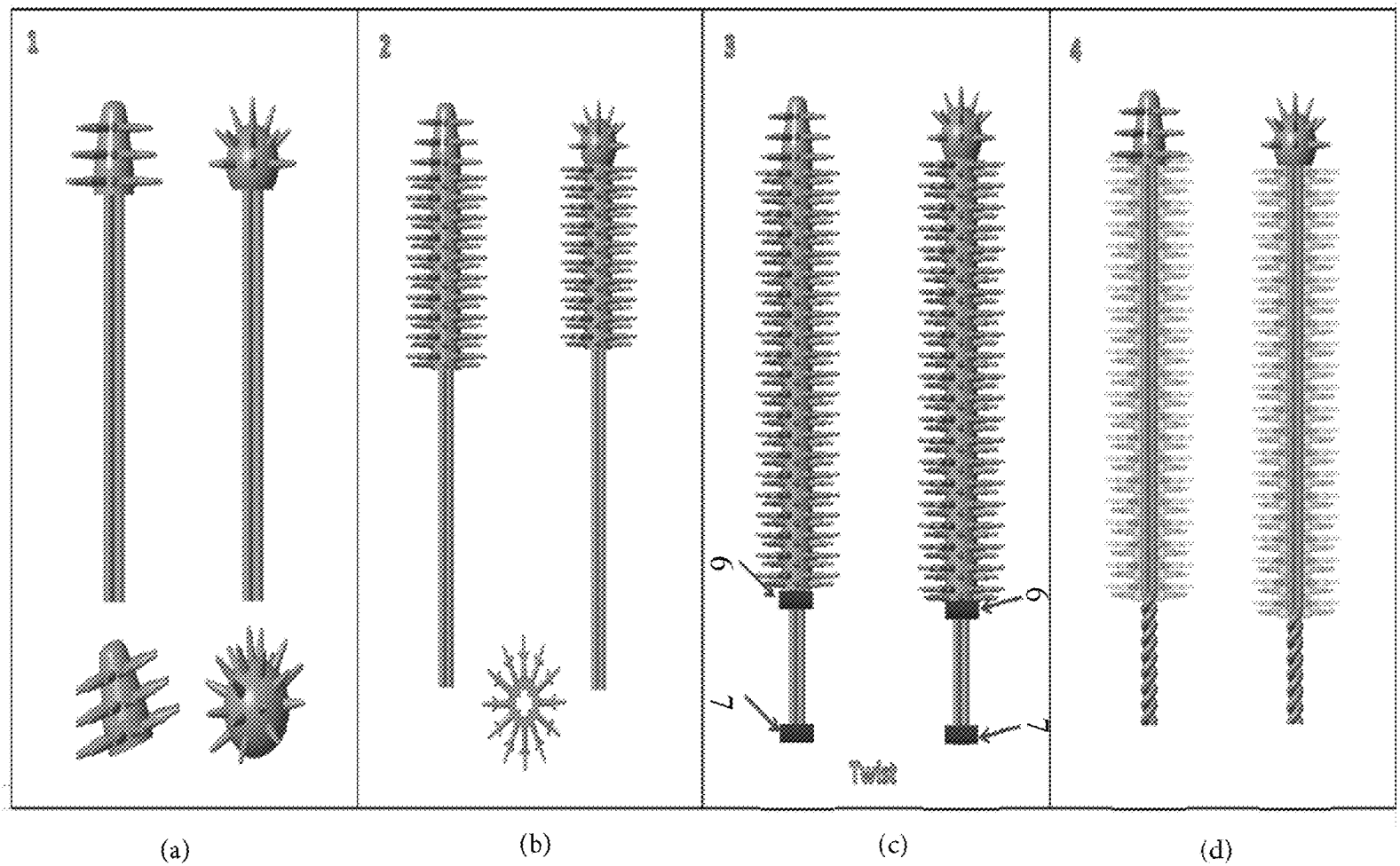
FIGS. 6 (*a*)-(*d*) show various steps for manufacturing a cosmetic applicator brush of the present invention.
Figure 8:
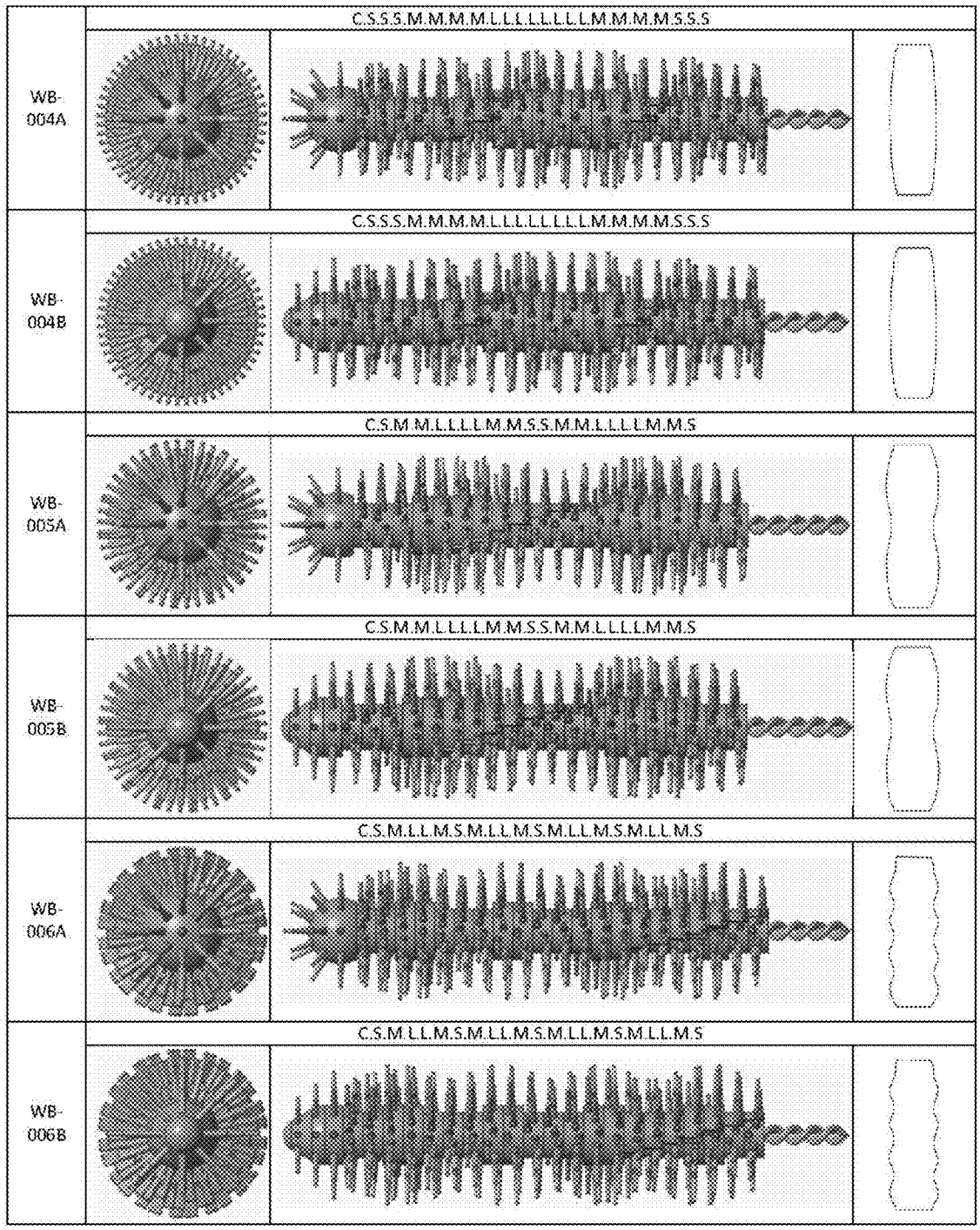
Figure 9:
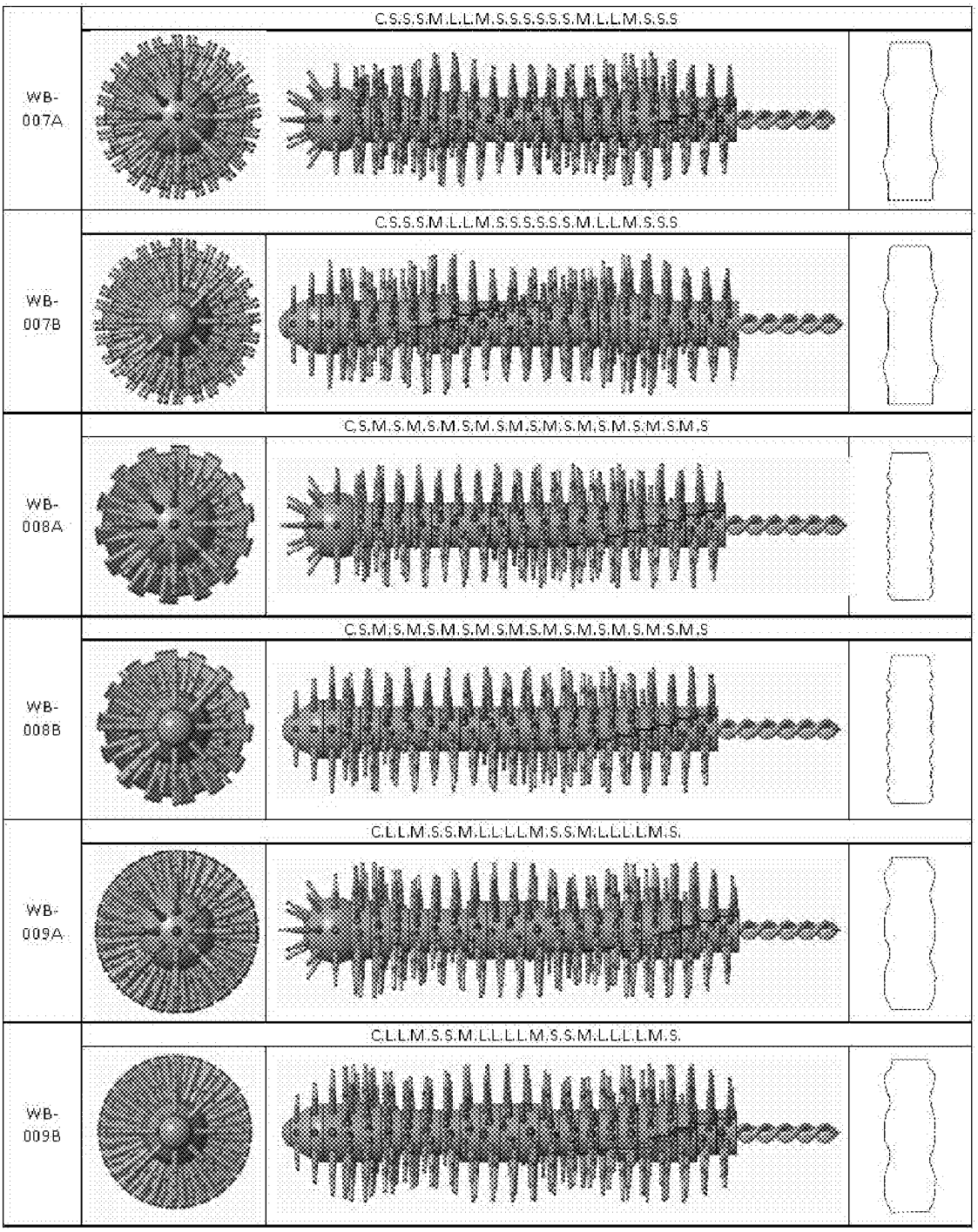
Figure 10:
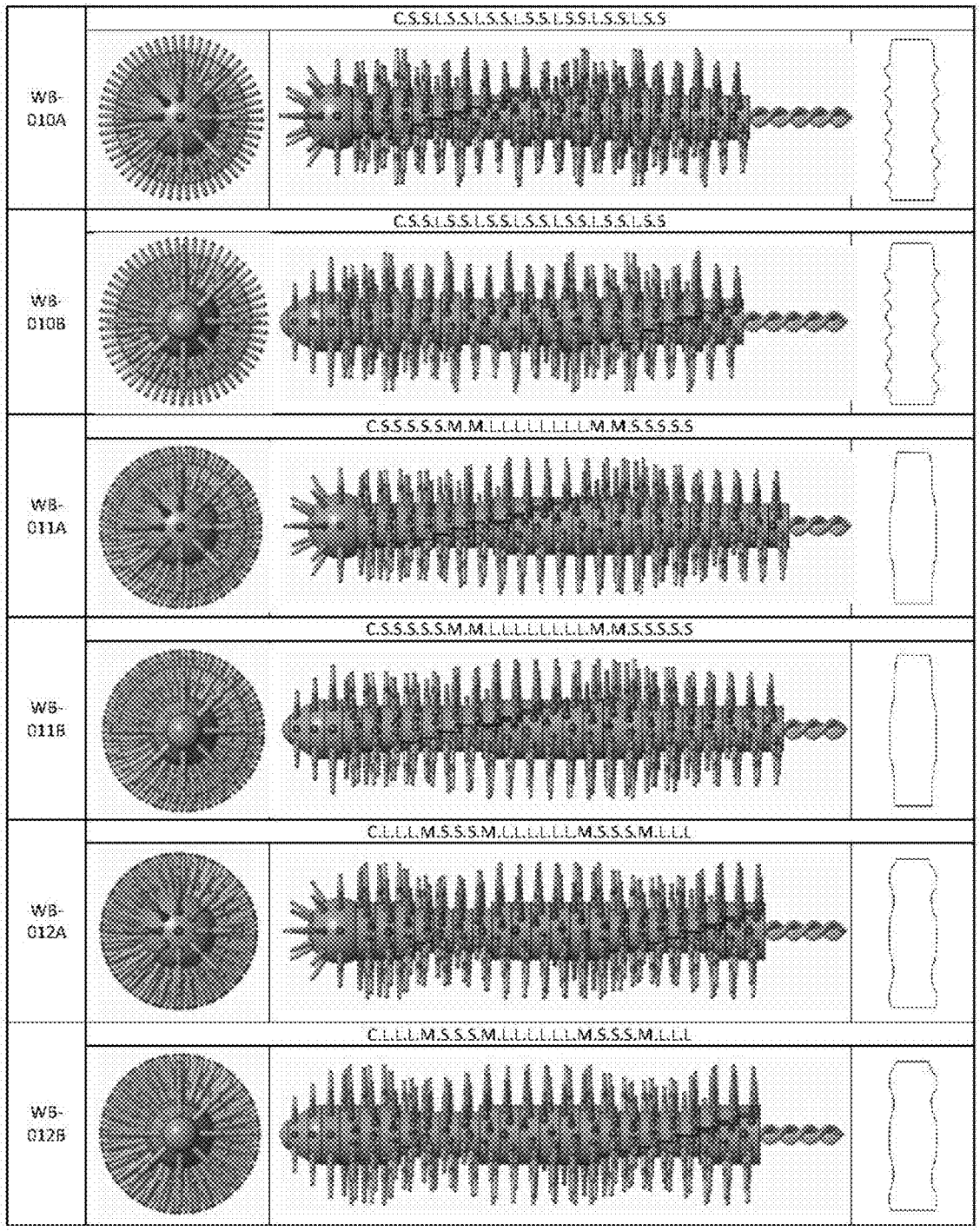
Figure 11:
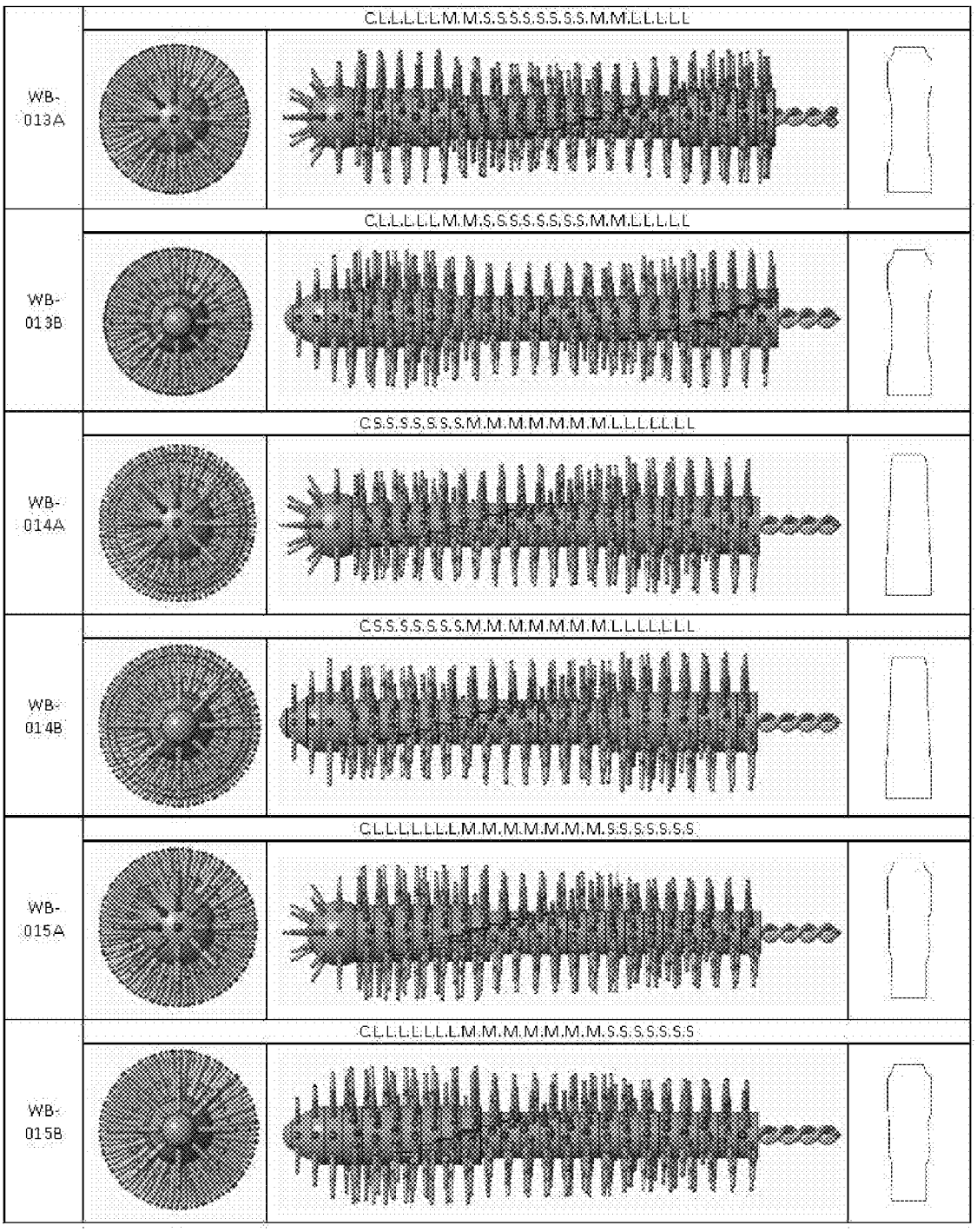
Figure 12:
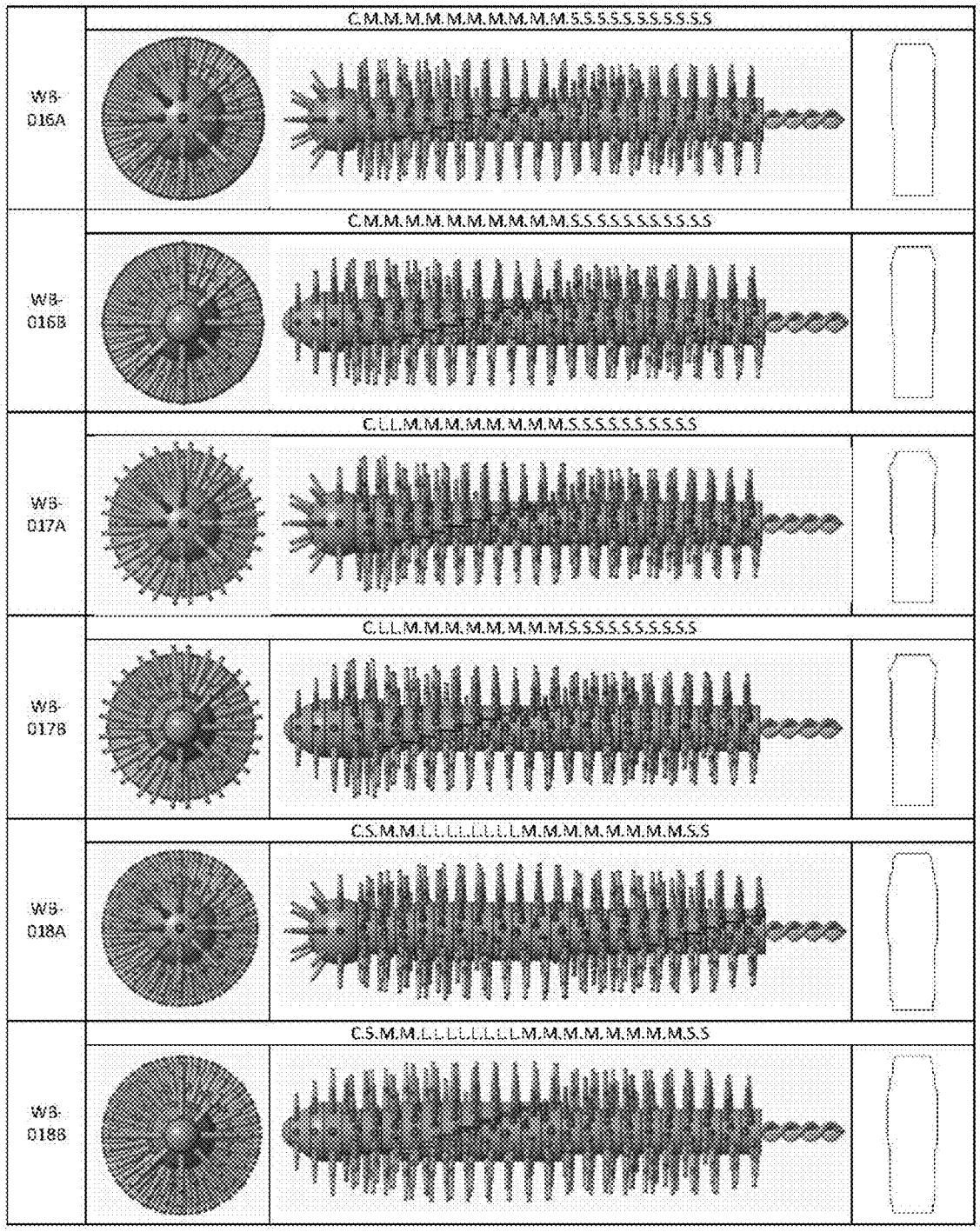
Figure 13:
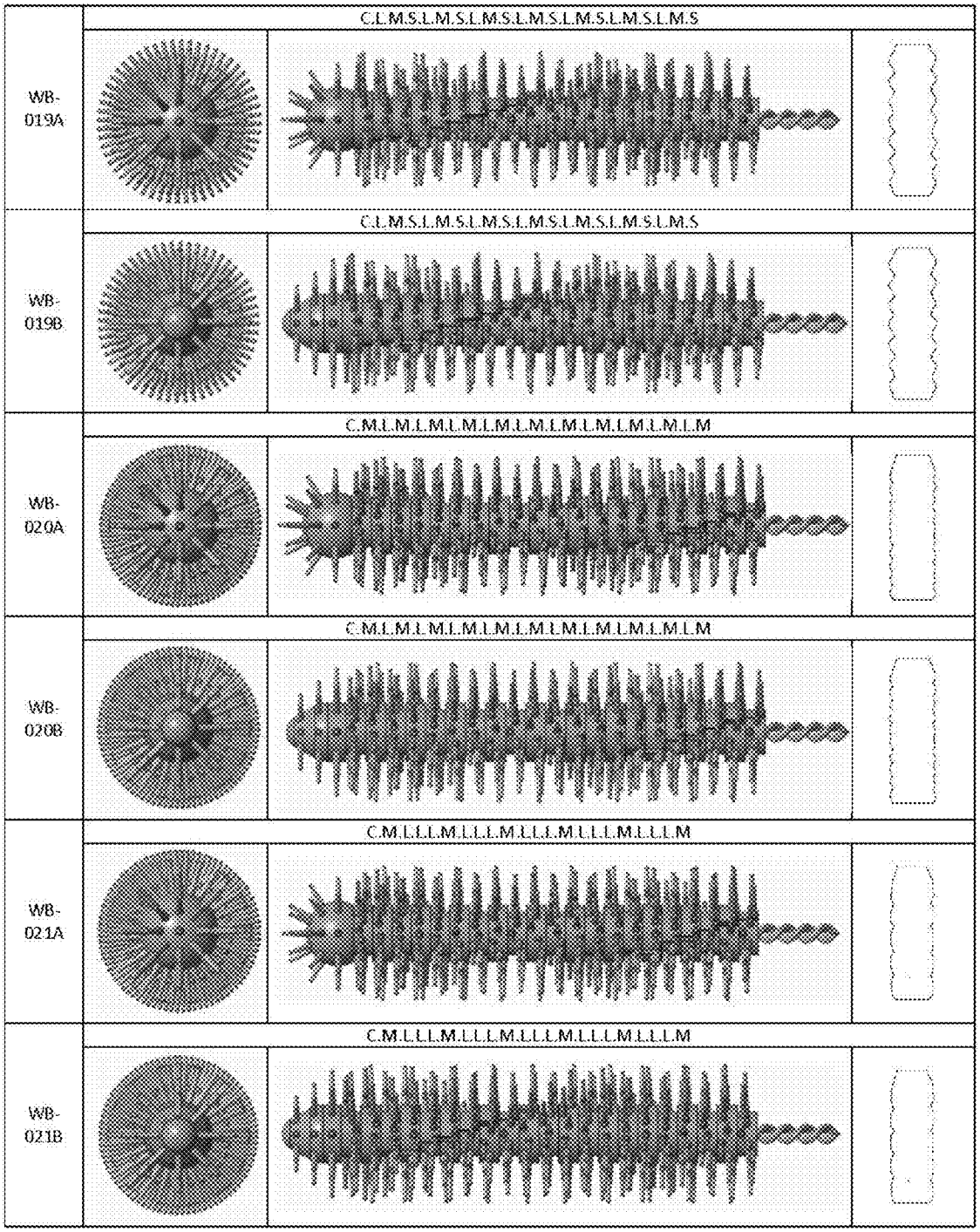
Figure 14:
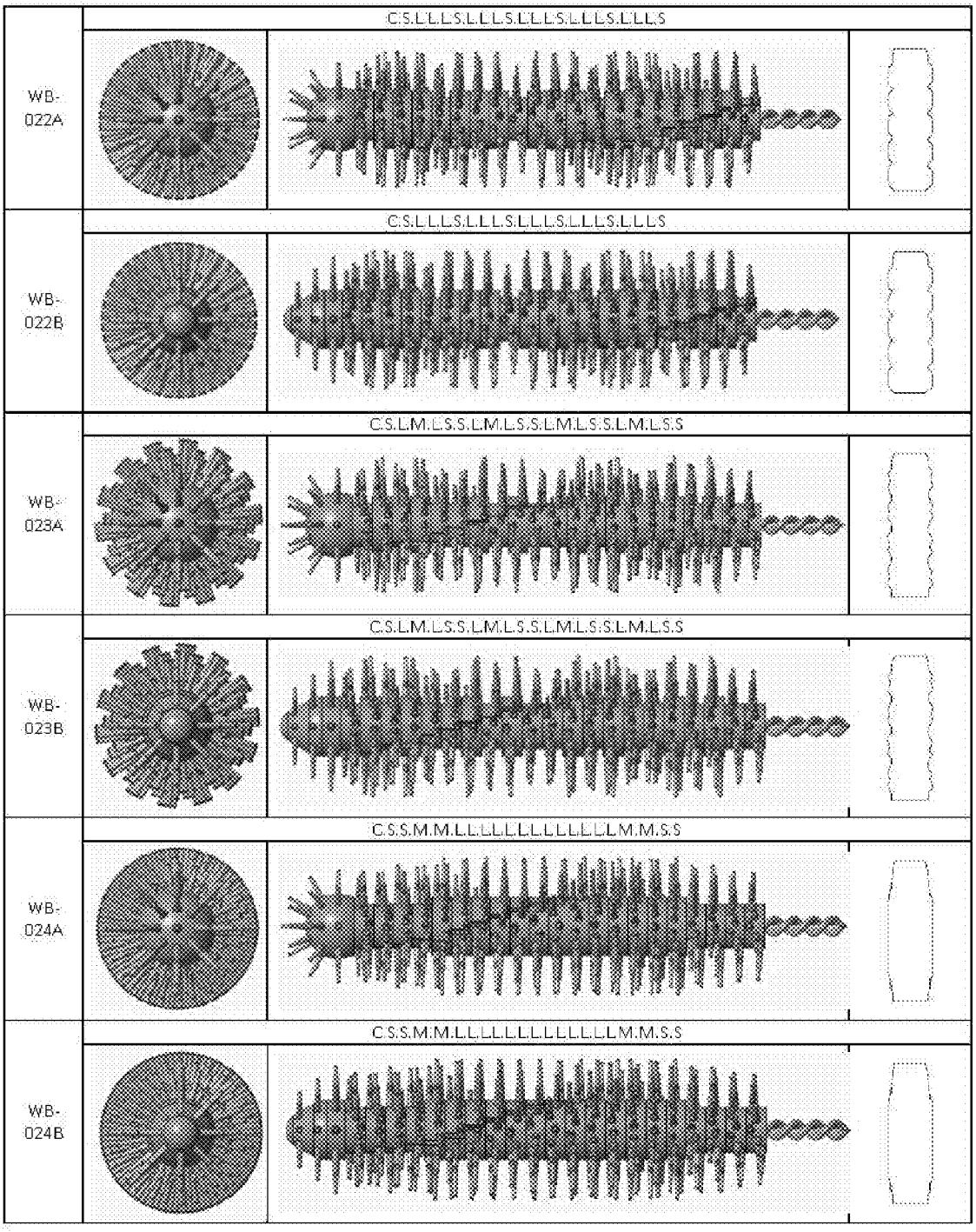
Figure 15:
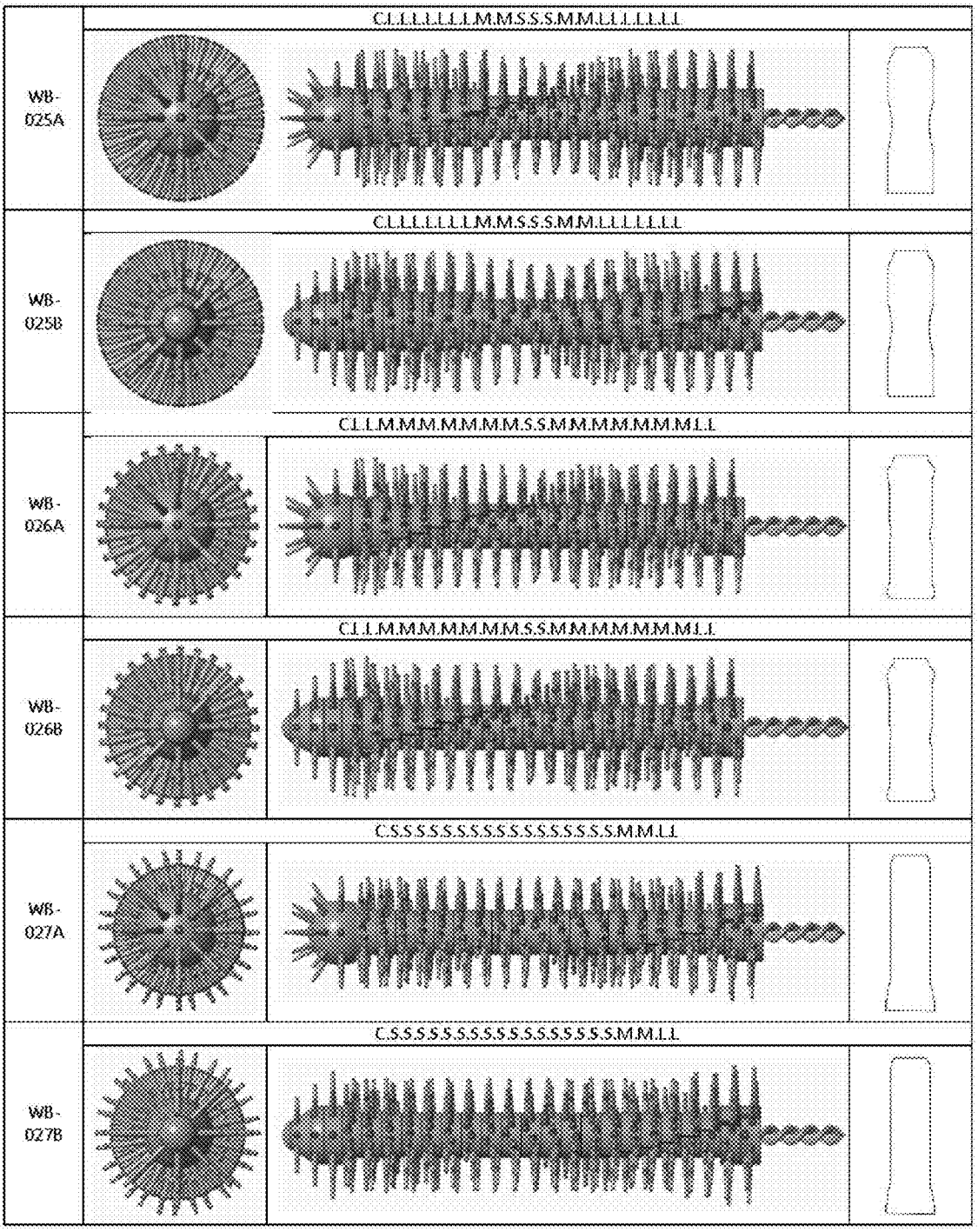
Figure 16:
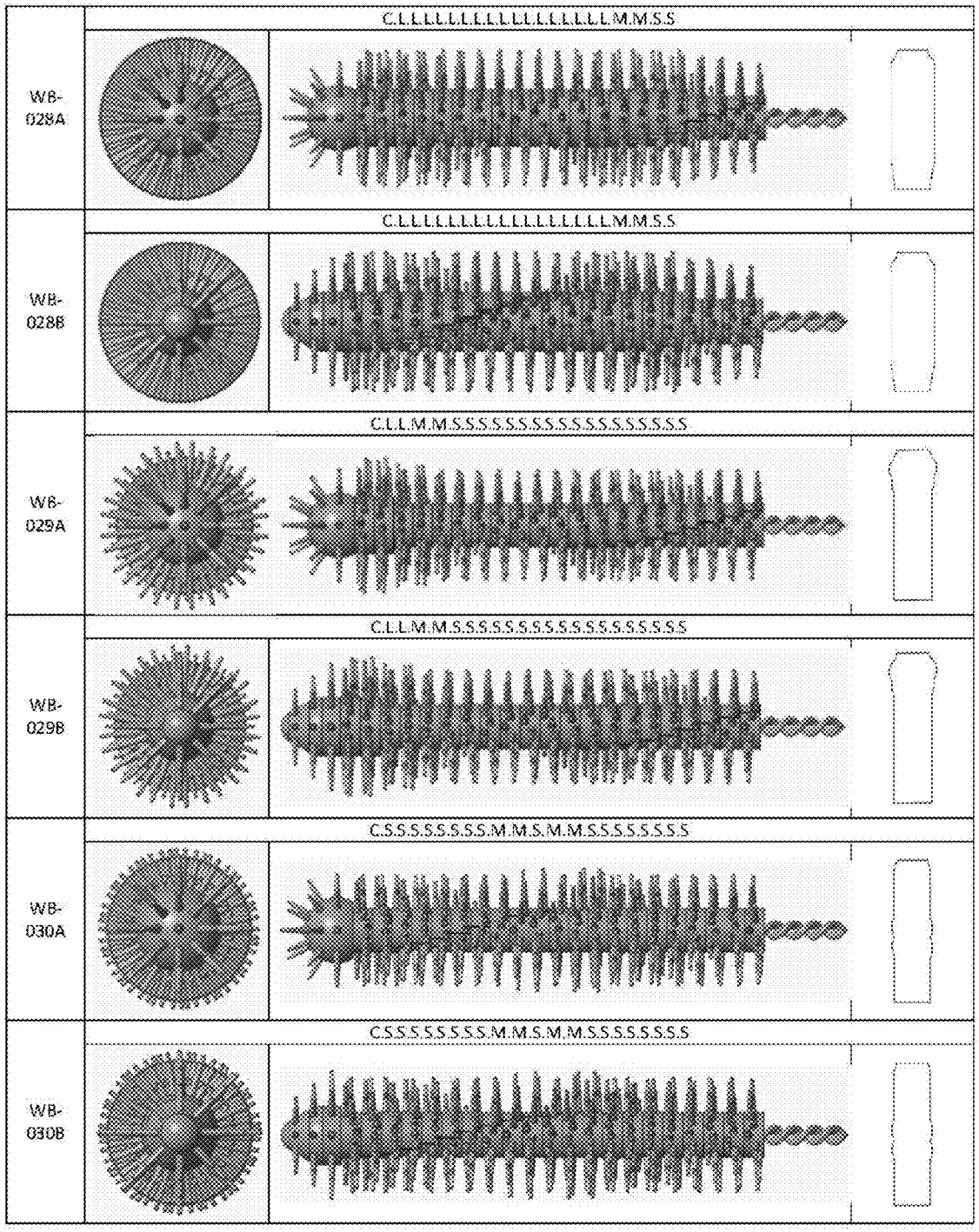
Figure 17:
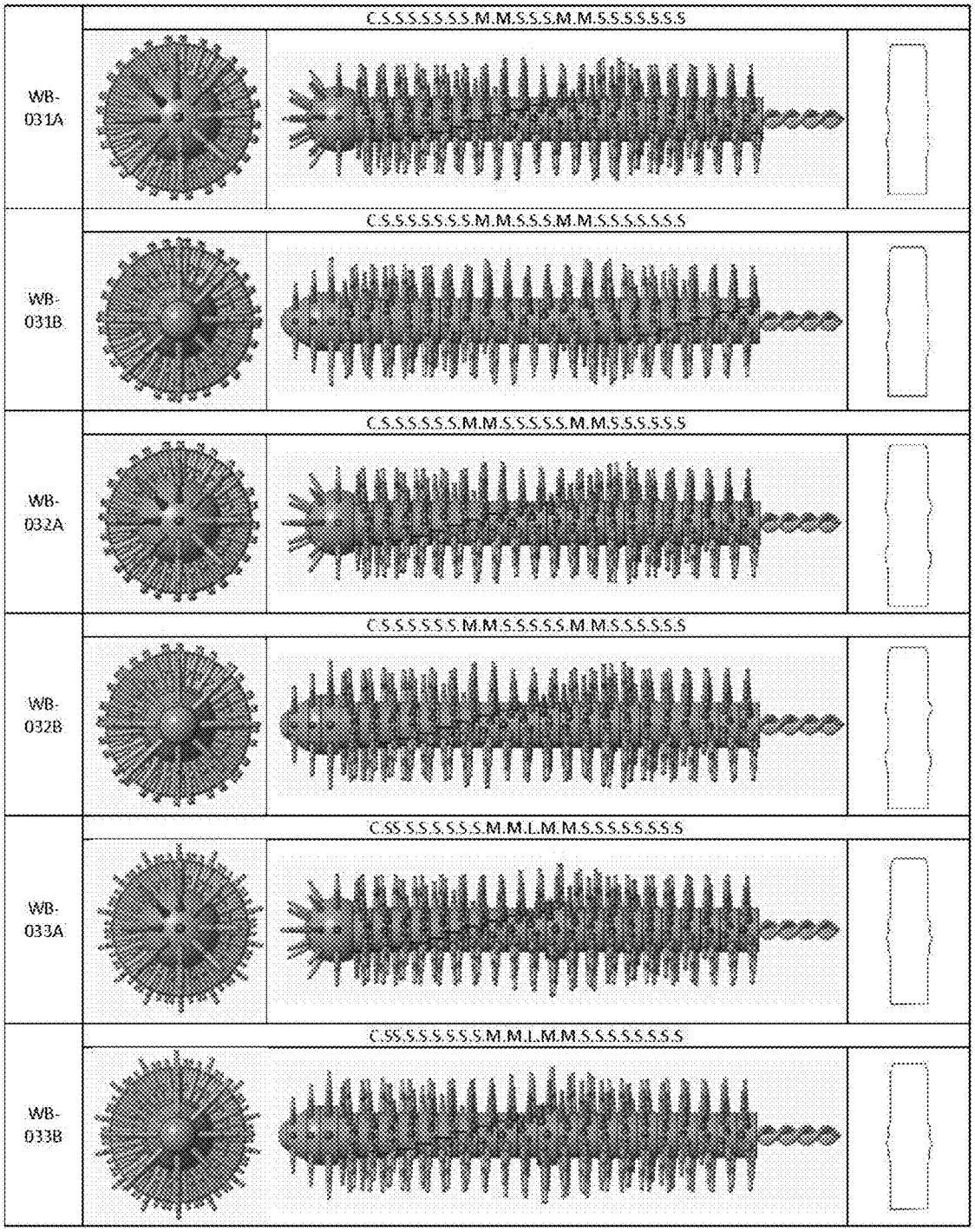
Figure 18:
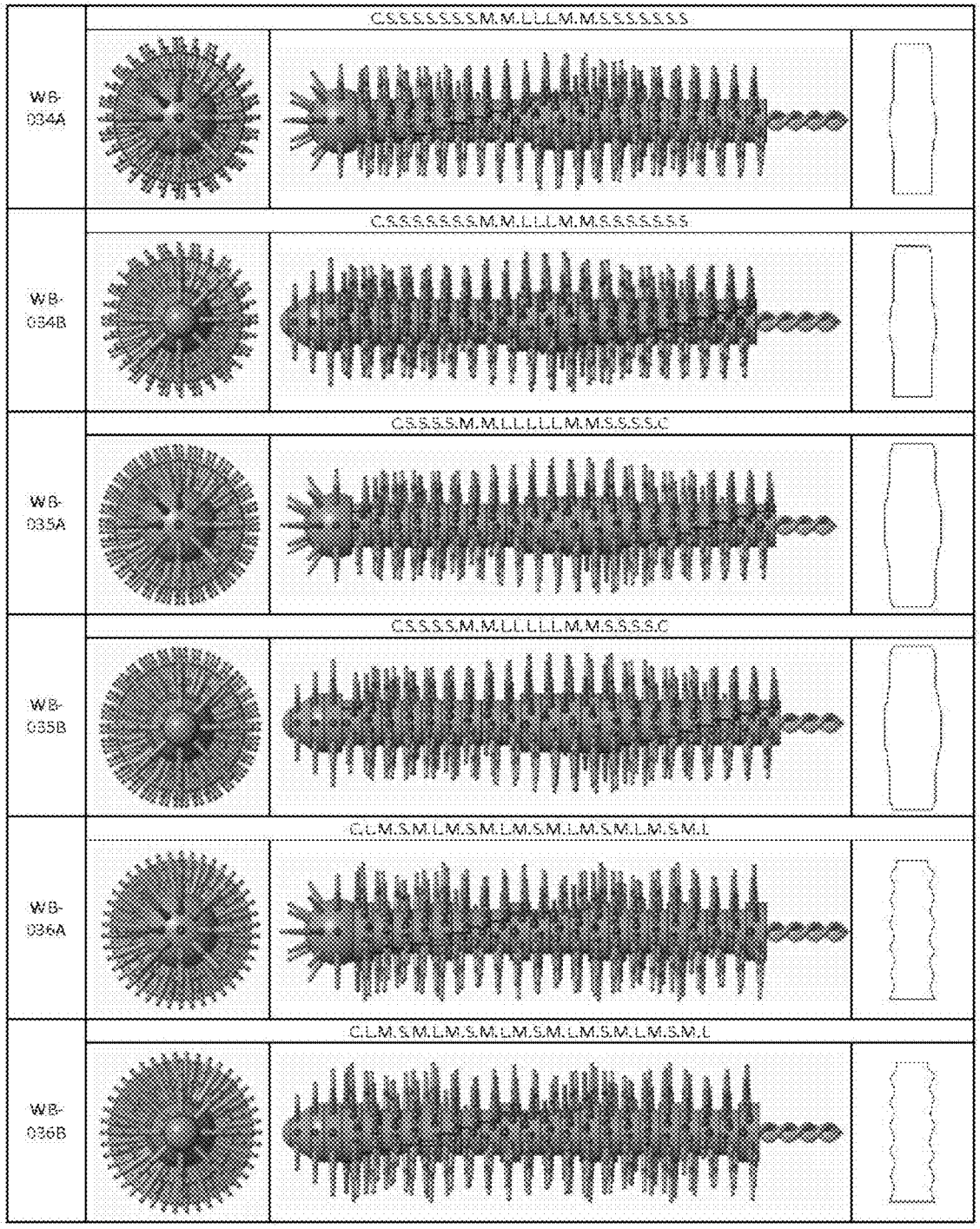
Figure 19:
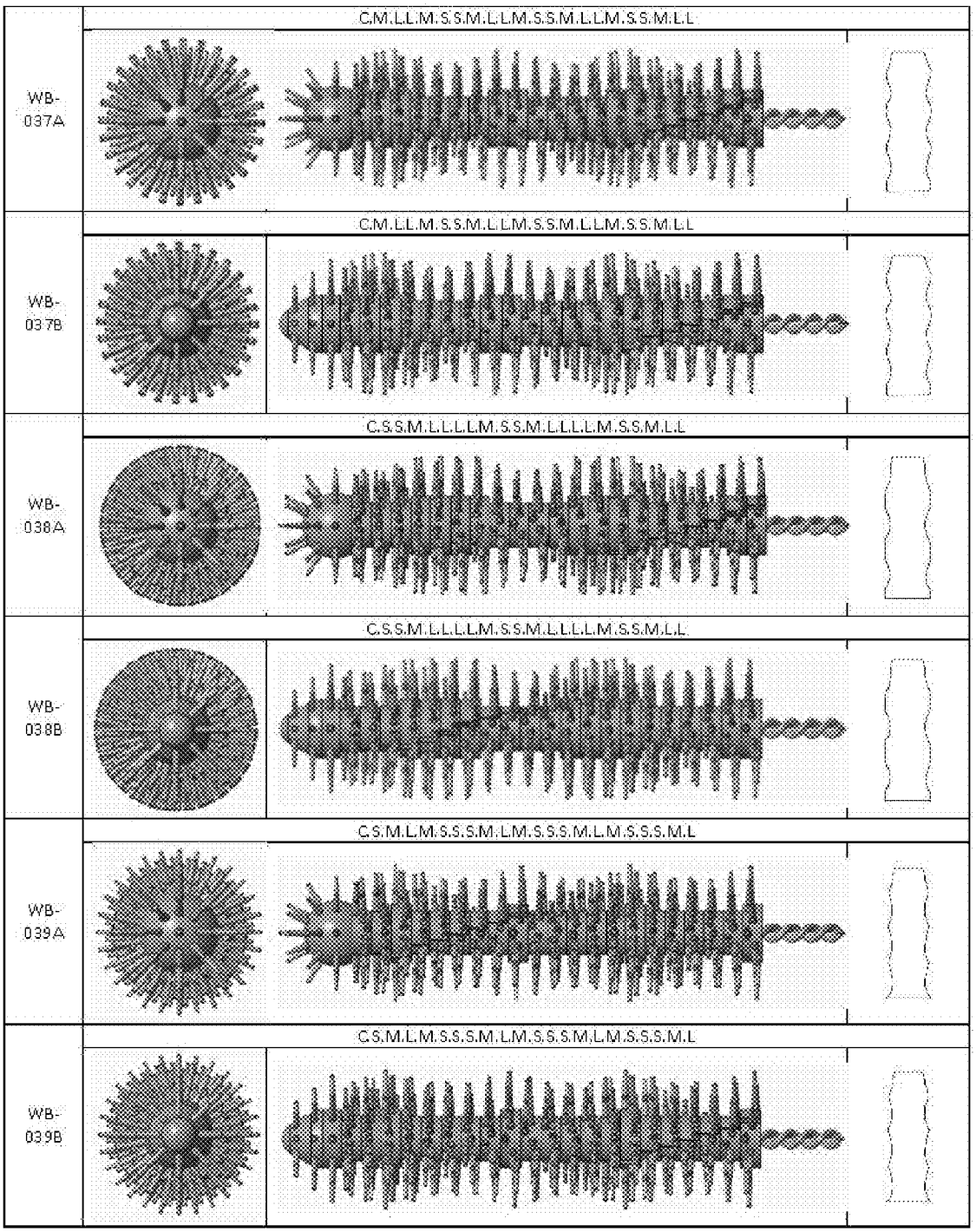
Figure 20:
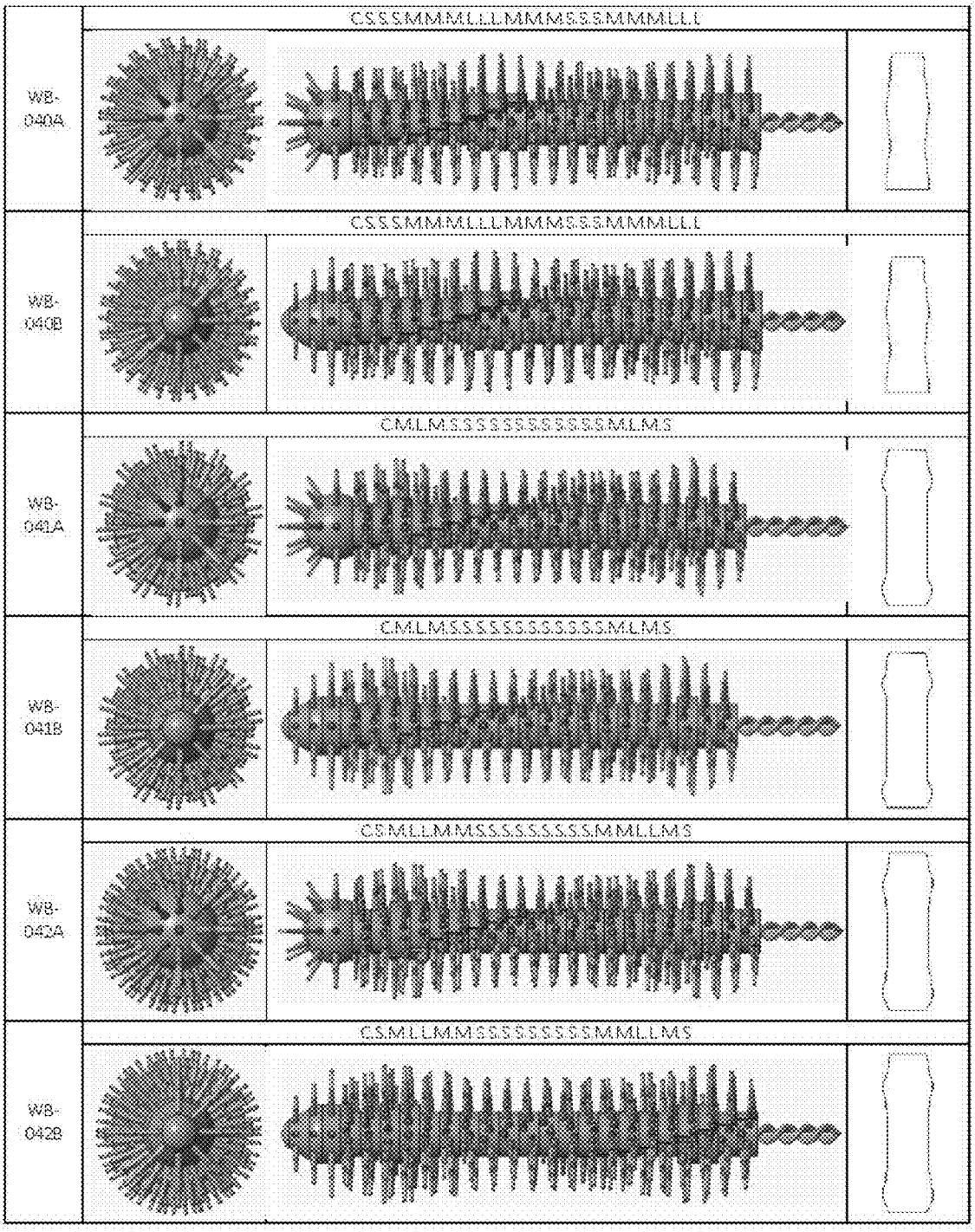
Figure 21:
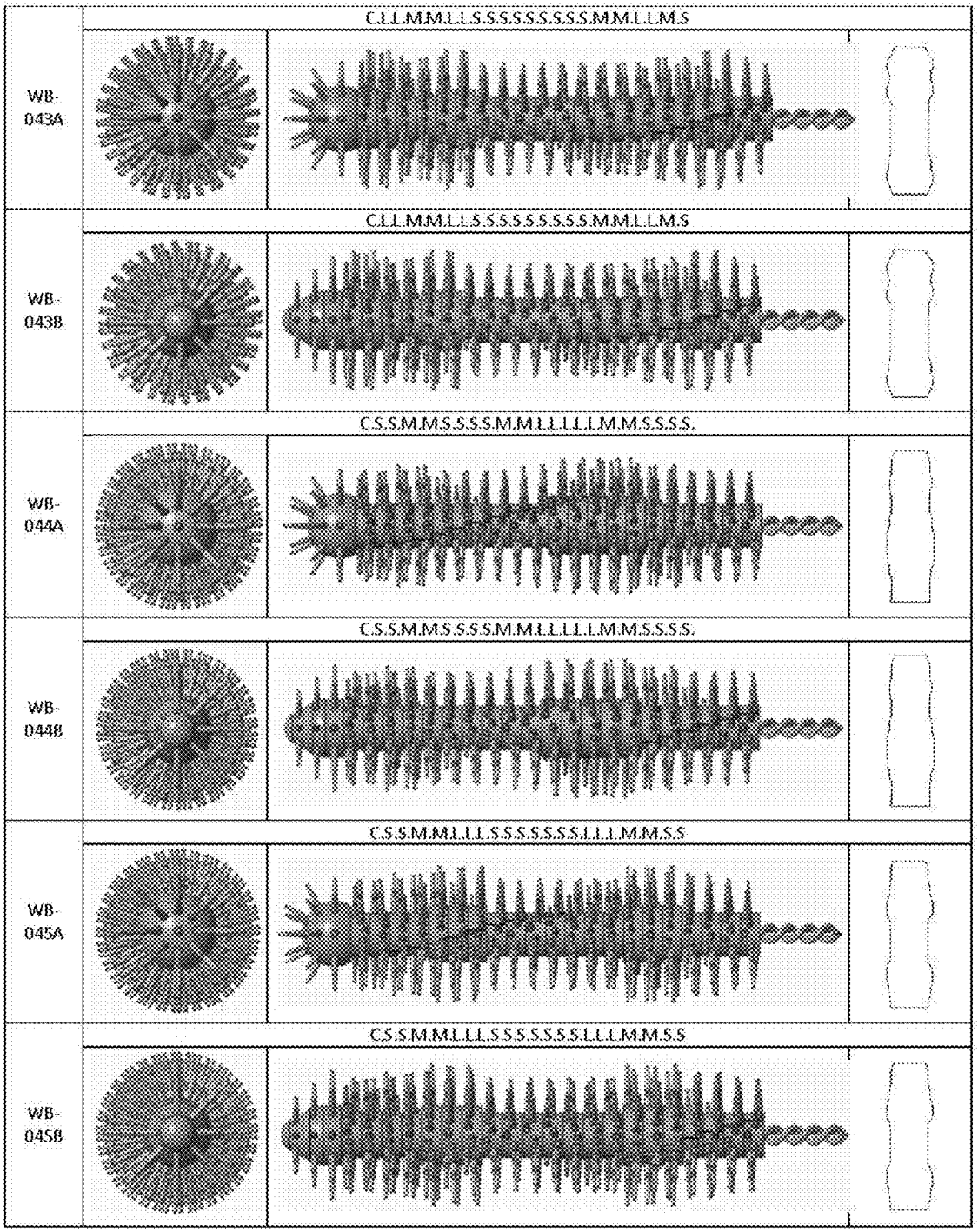
Figure 22:
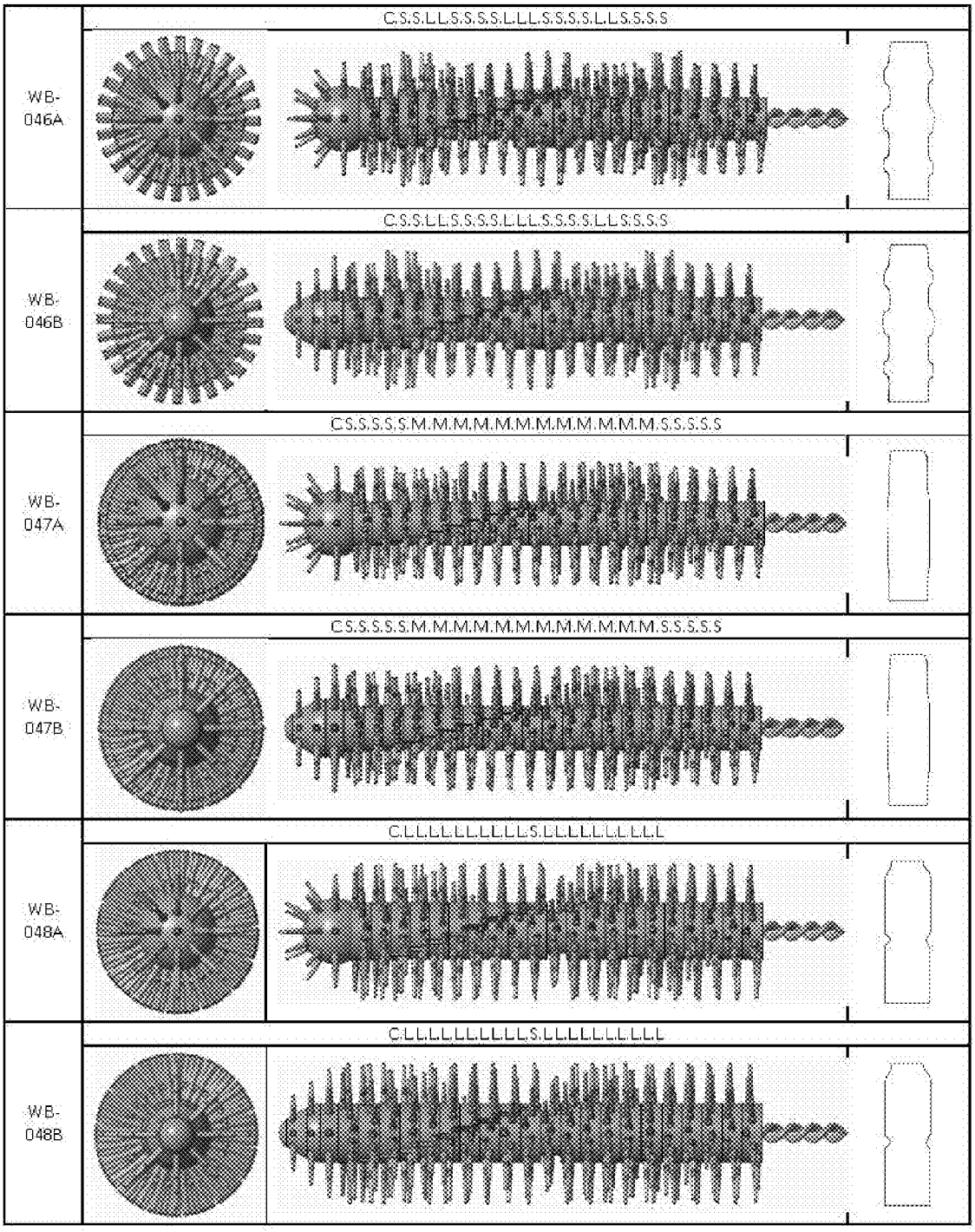
Figure 23:
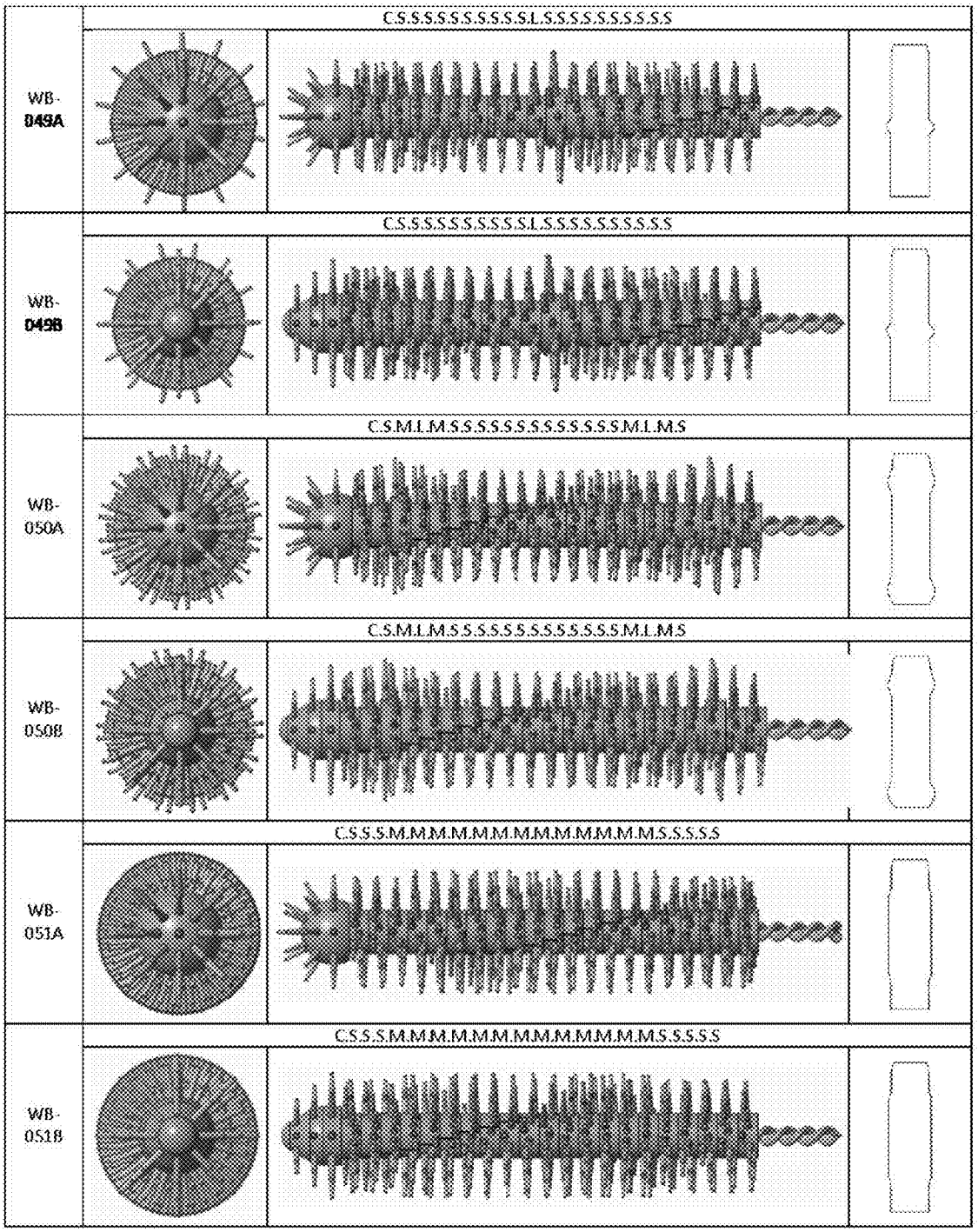
Figure 24:
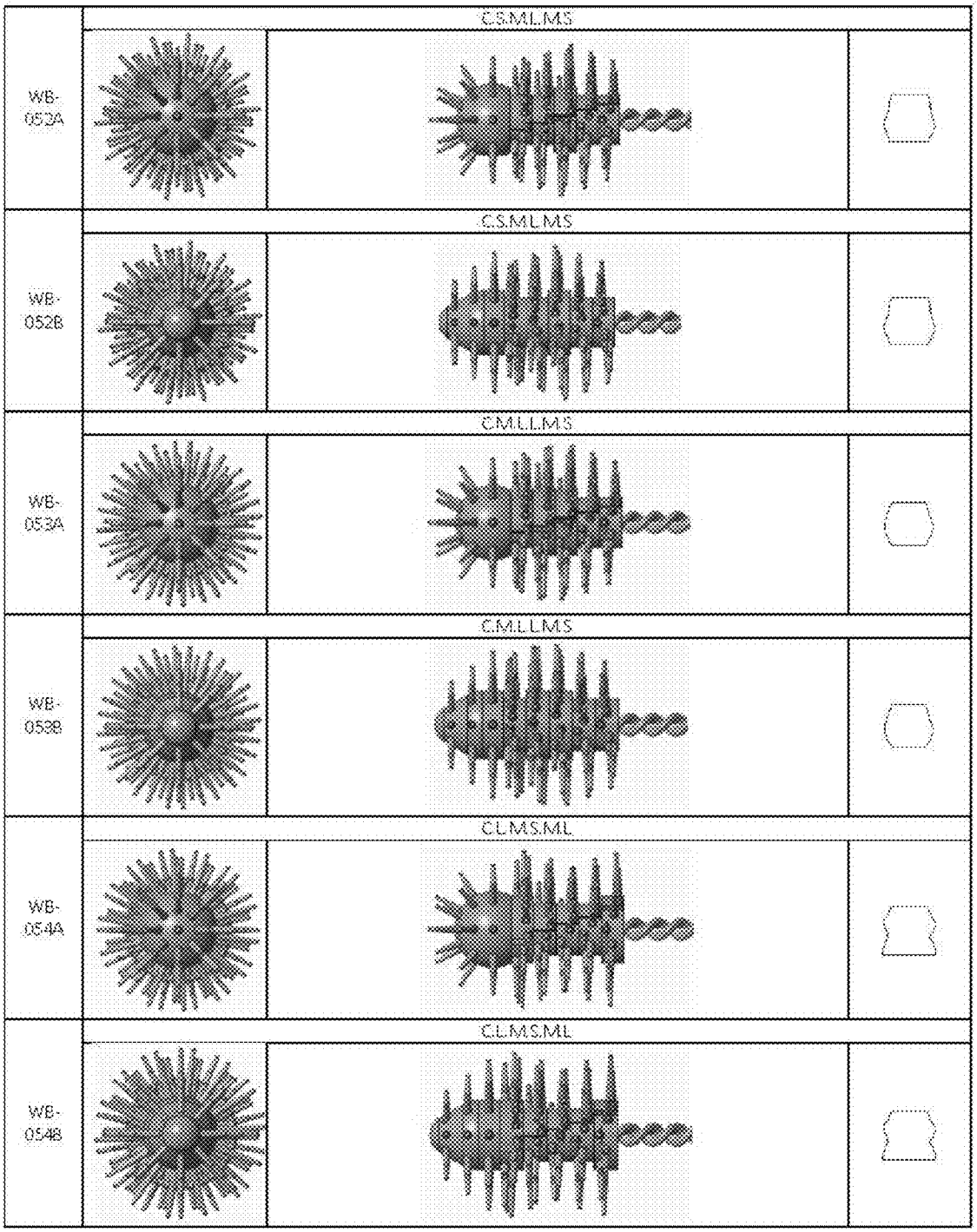
Figure 25:
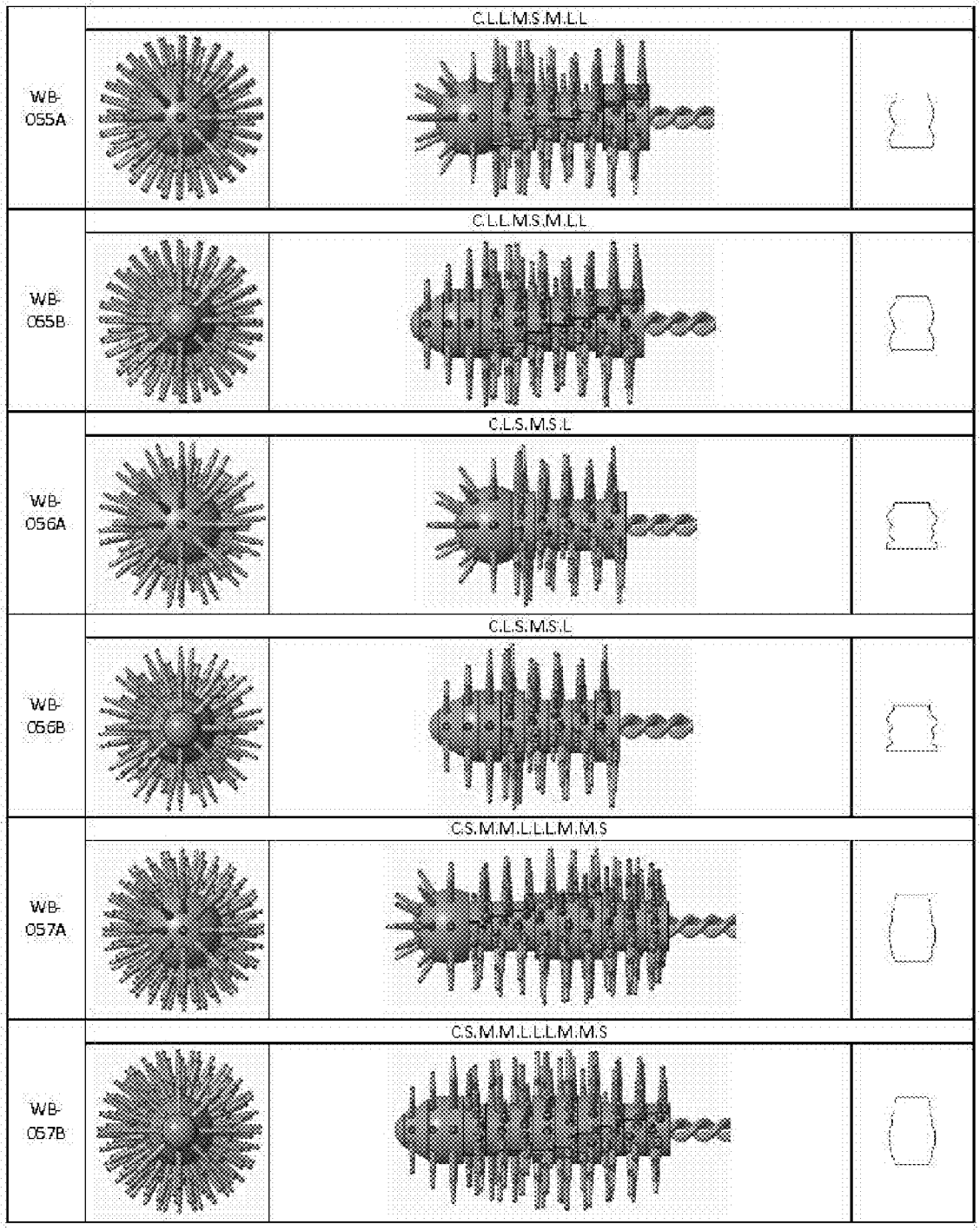
Figure 26:
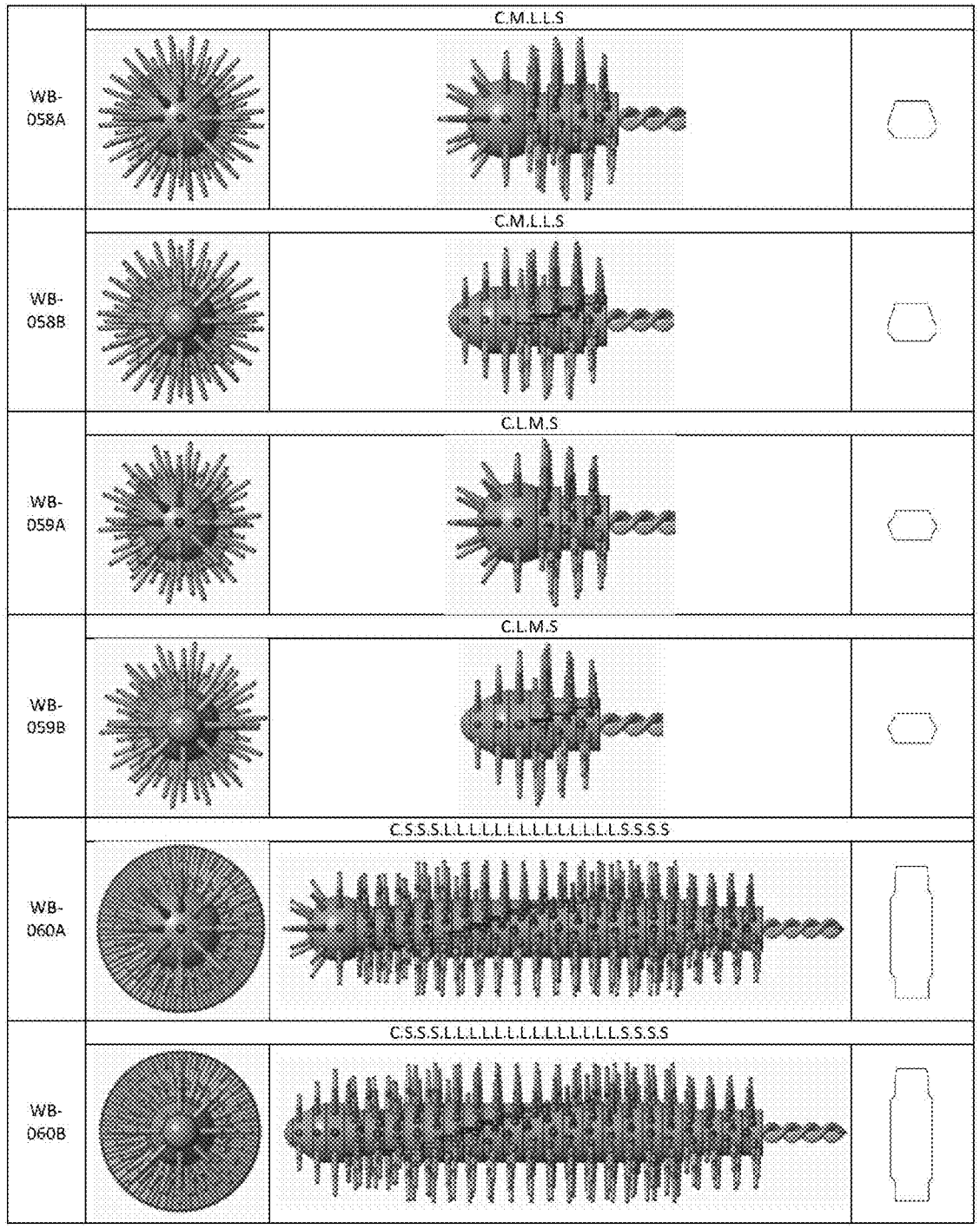
Figure 27:
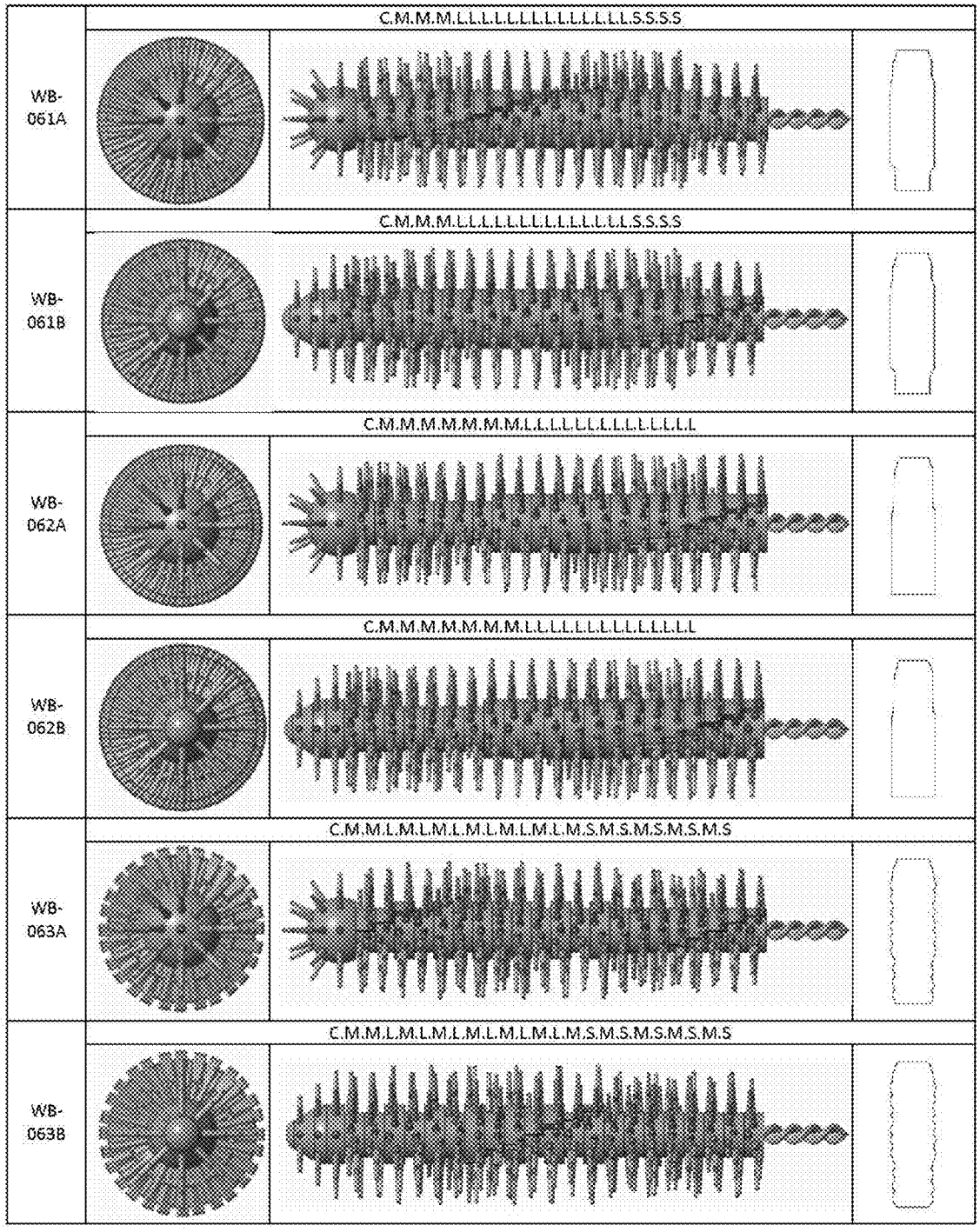
Figure 28:
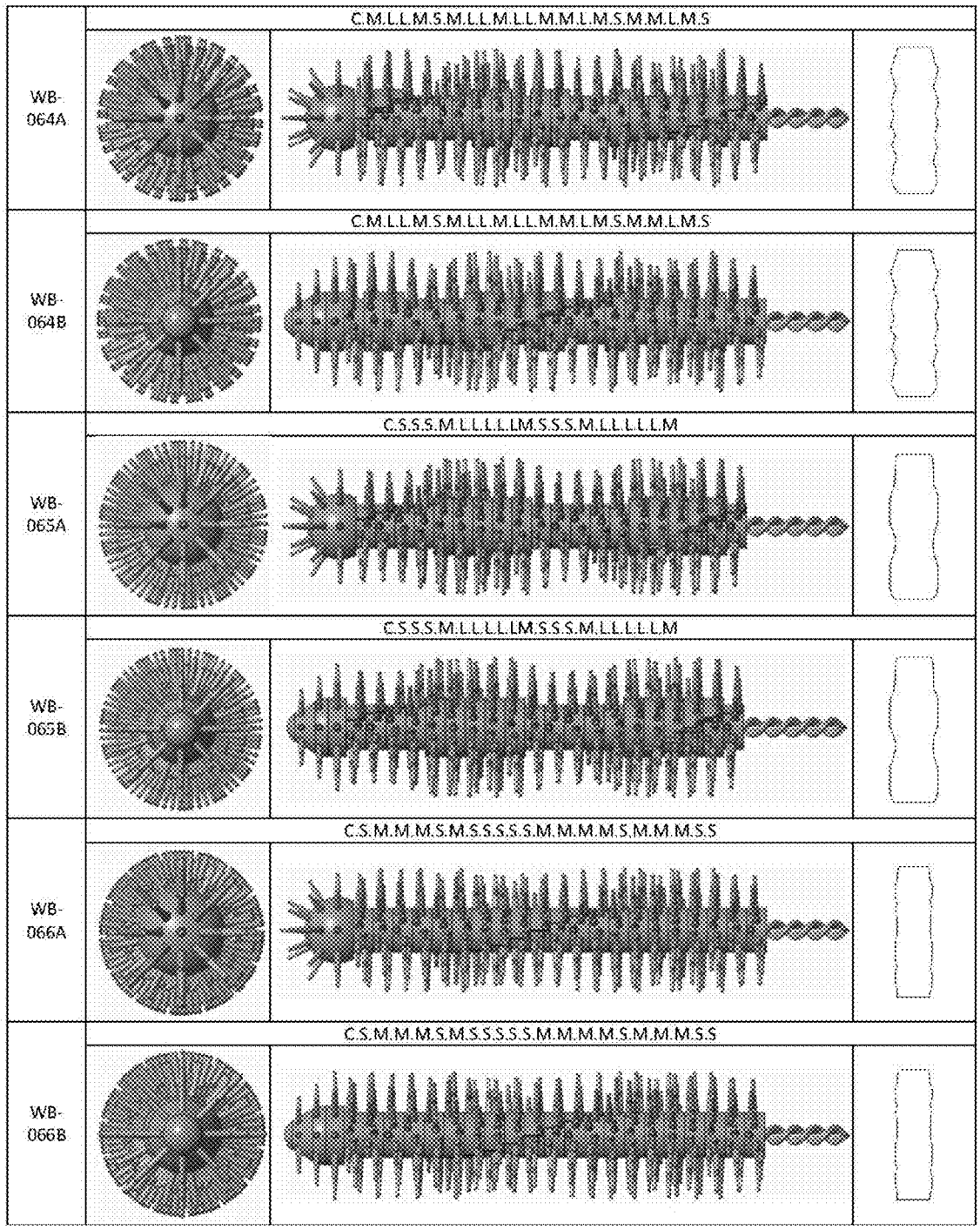
Figure 29:
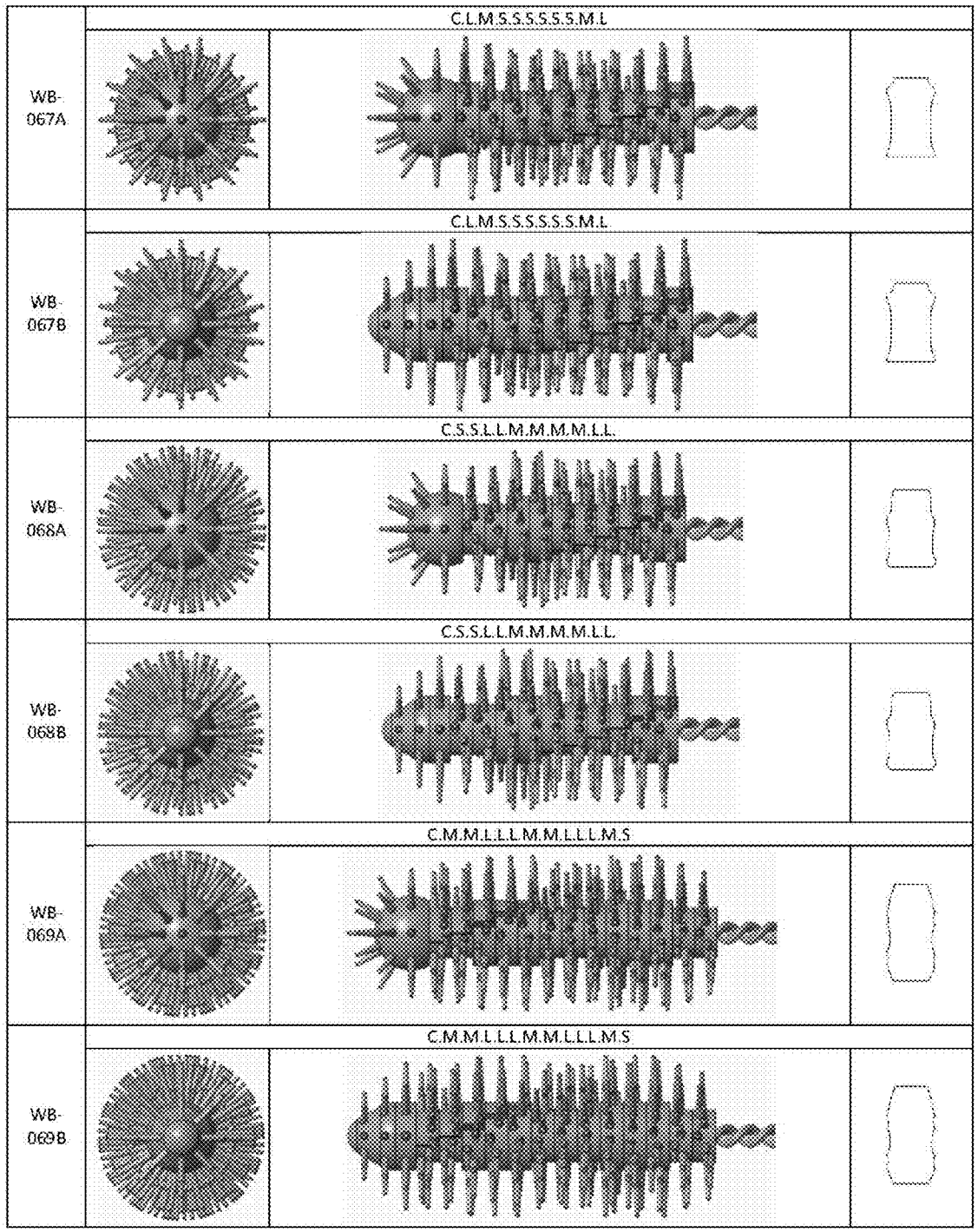
Figure 30:
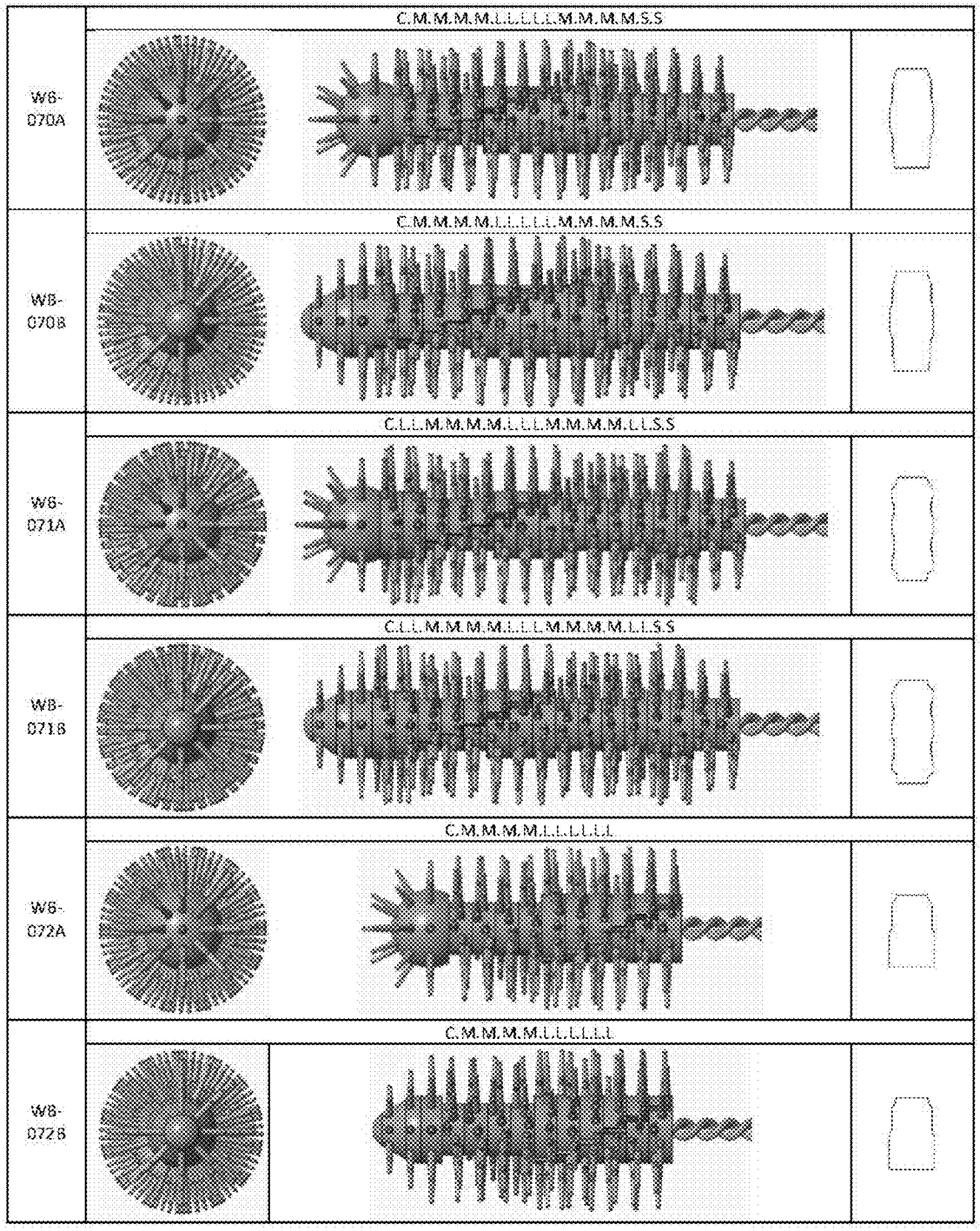
Figure 31:
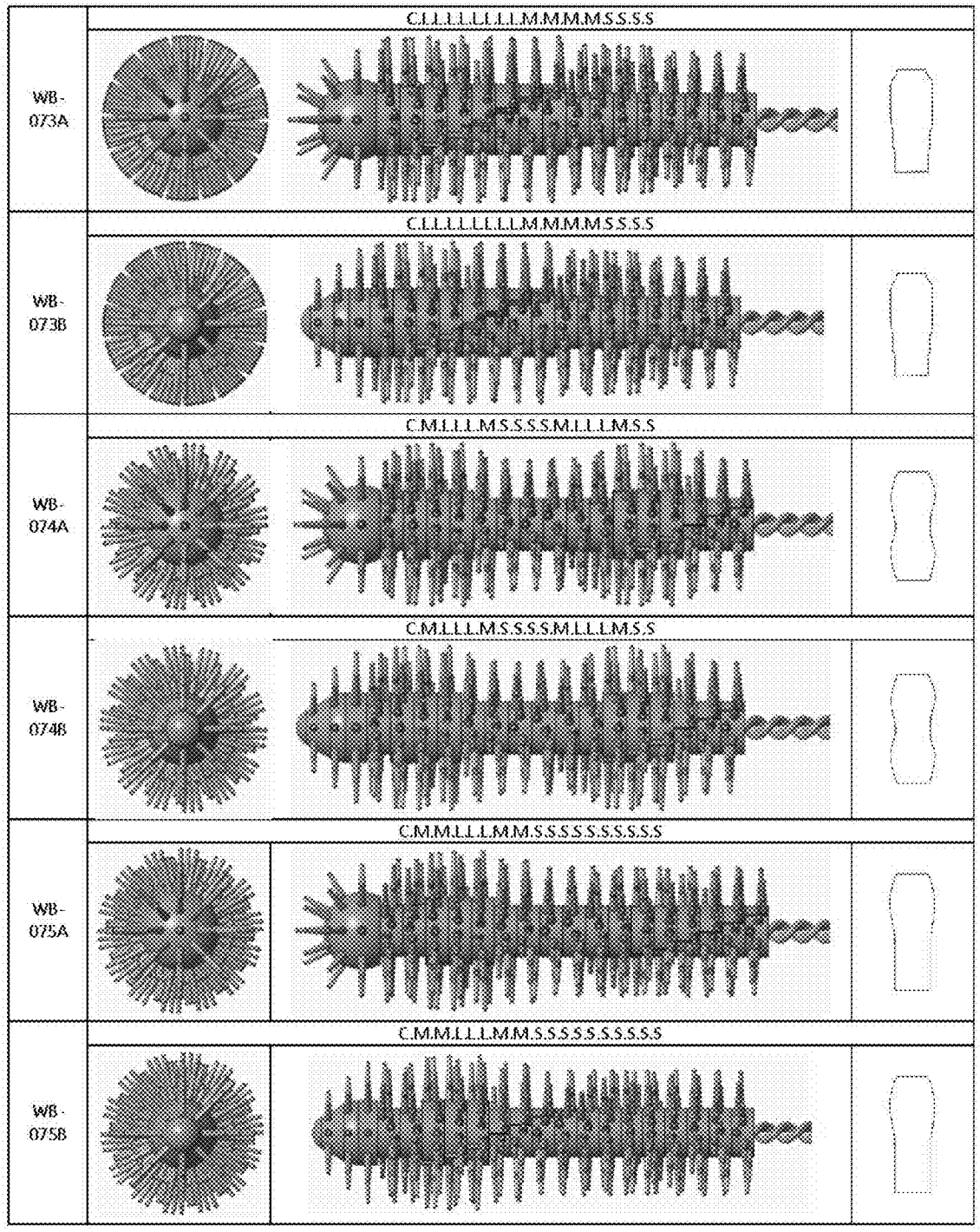
Figure 32:
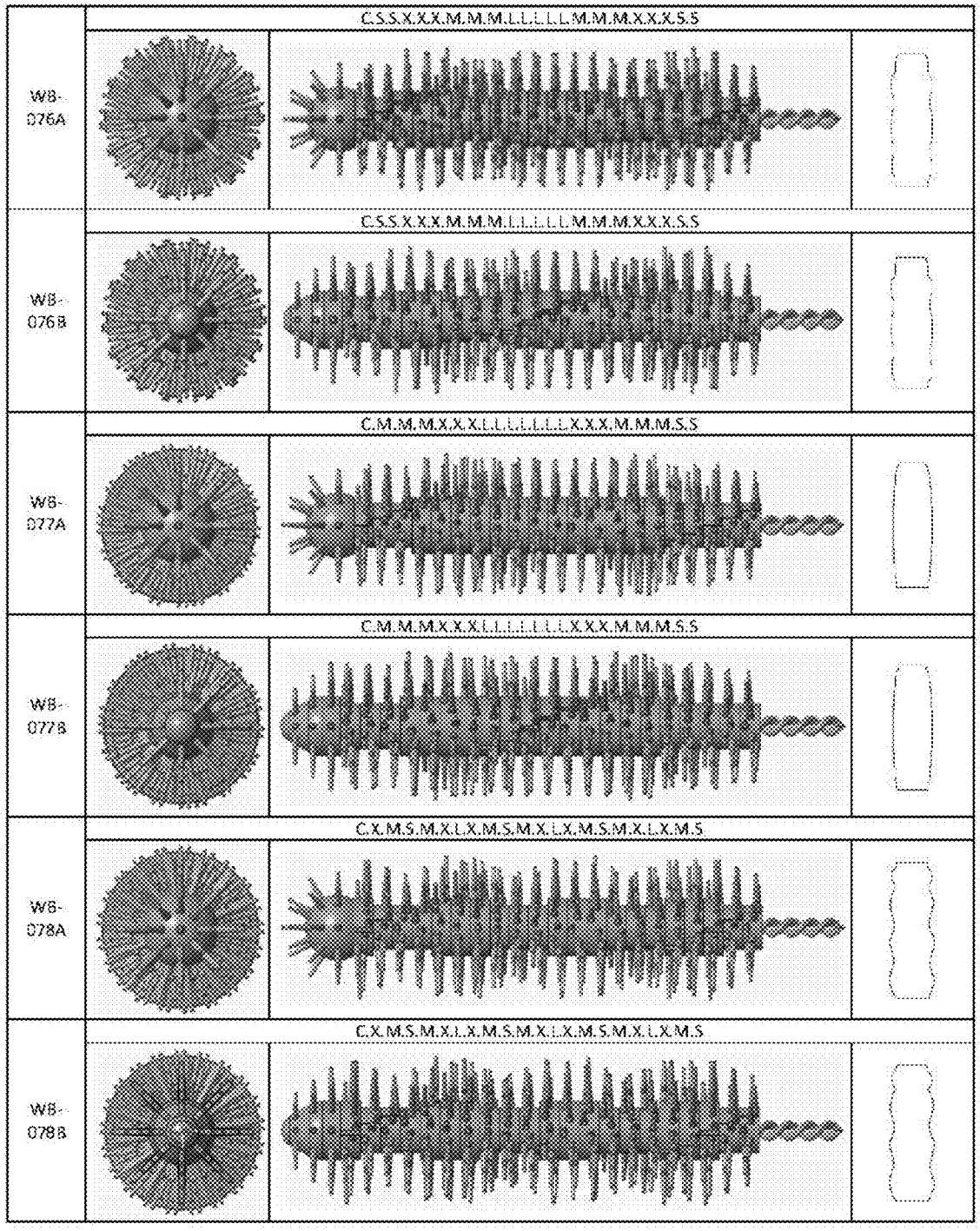
Figure 33:
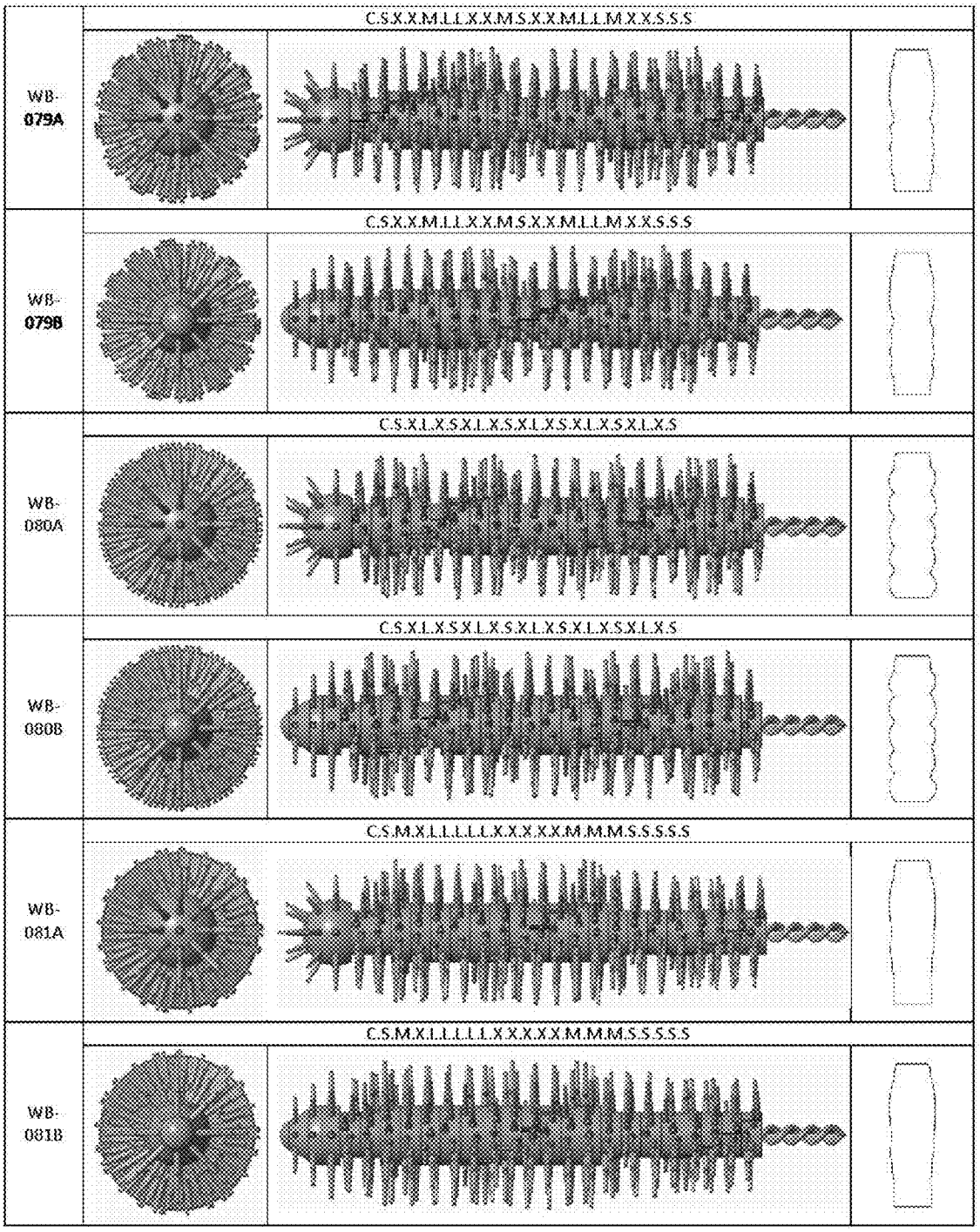
Figure 34:
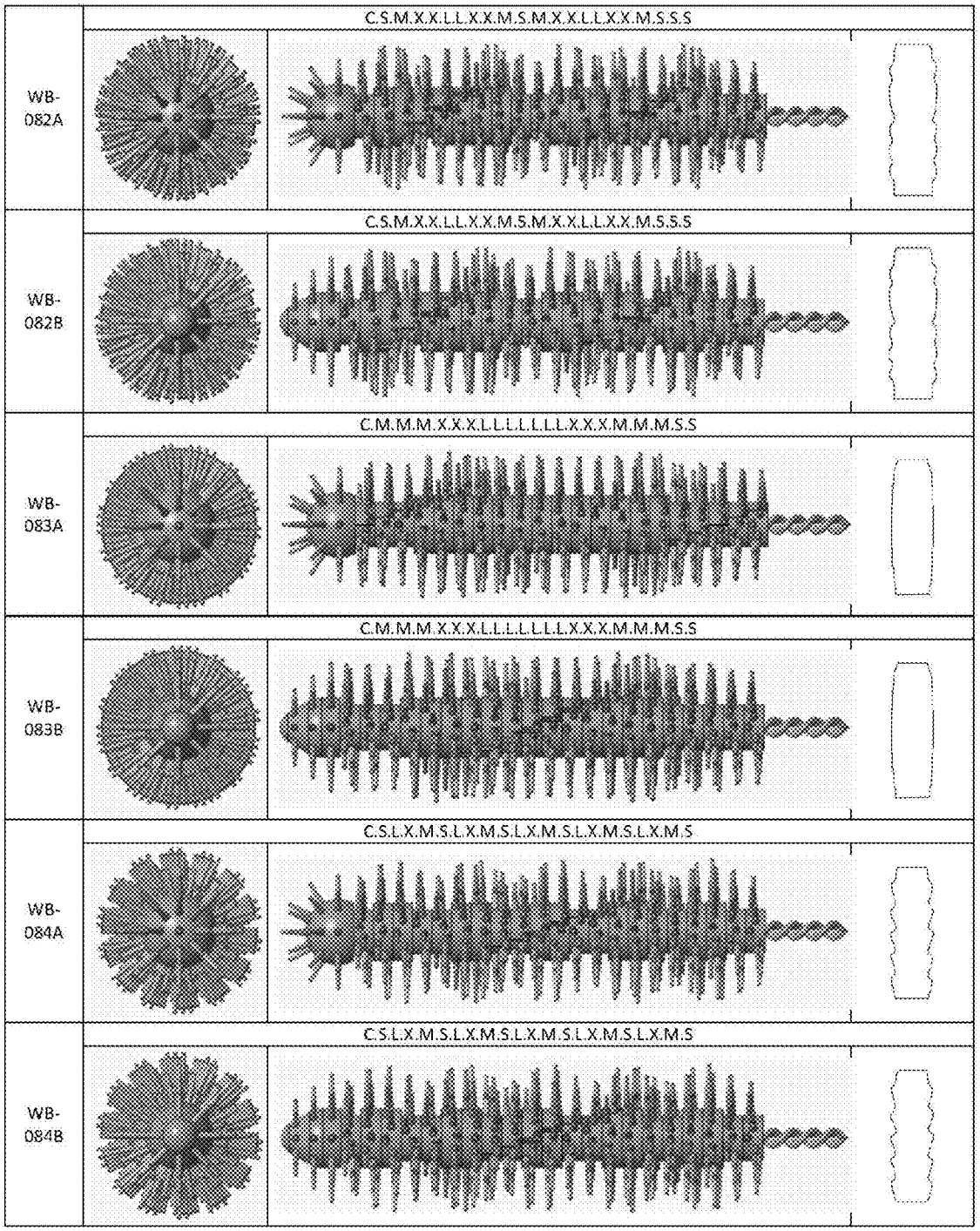
Figure 35:
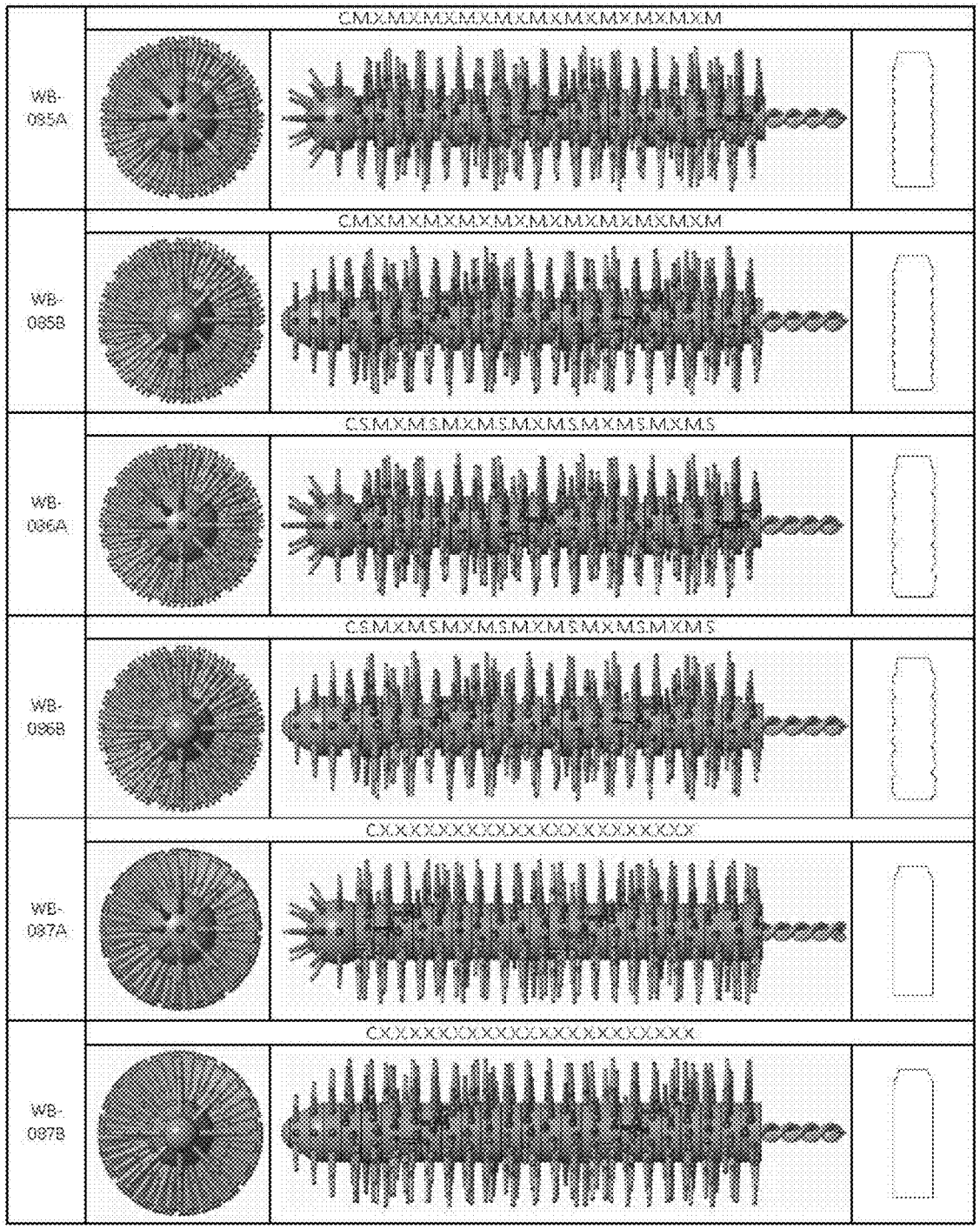
Figure 36:
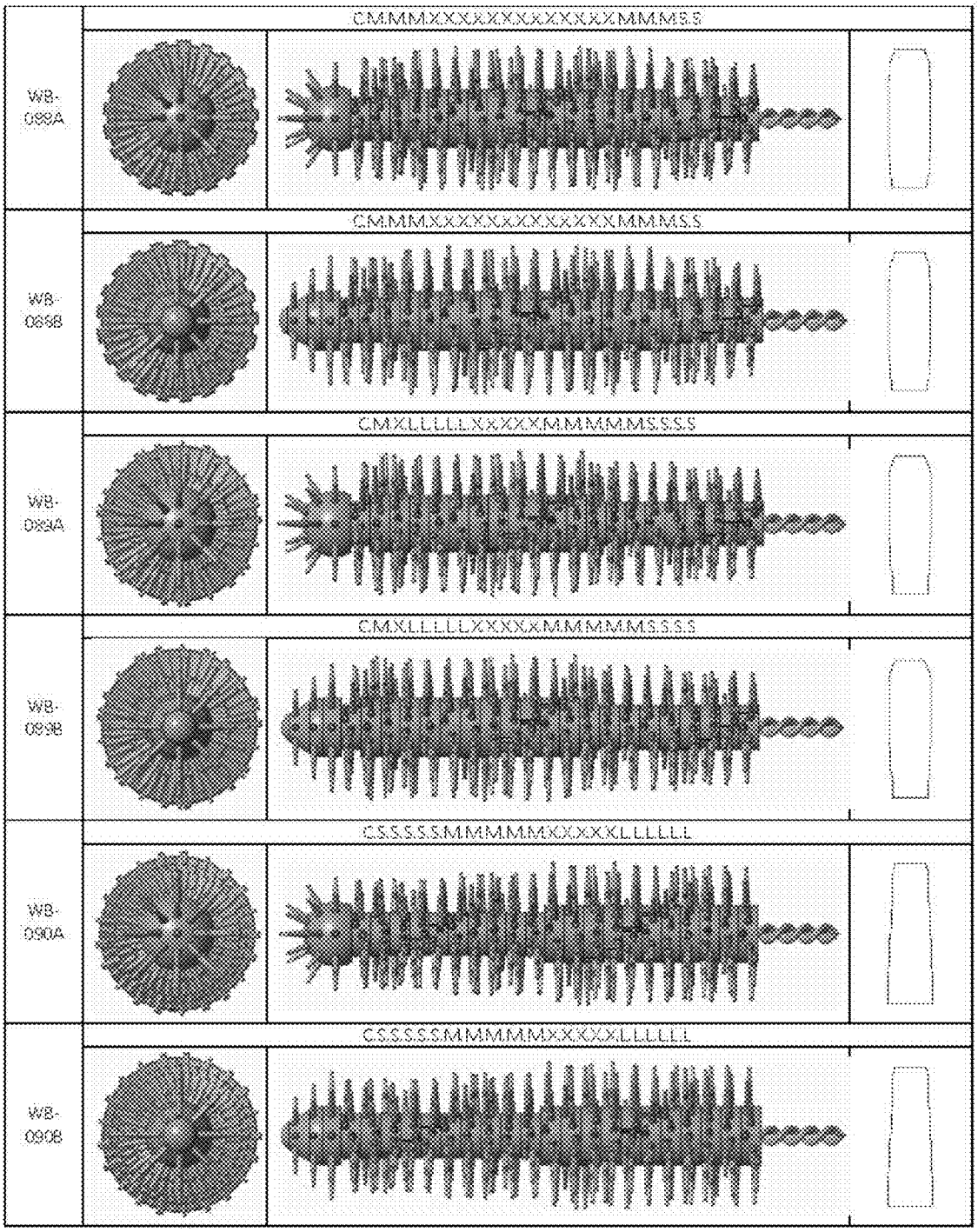
Figure 37:
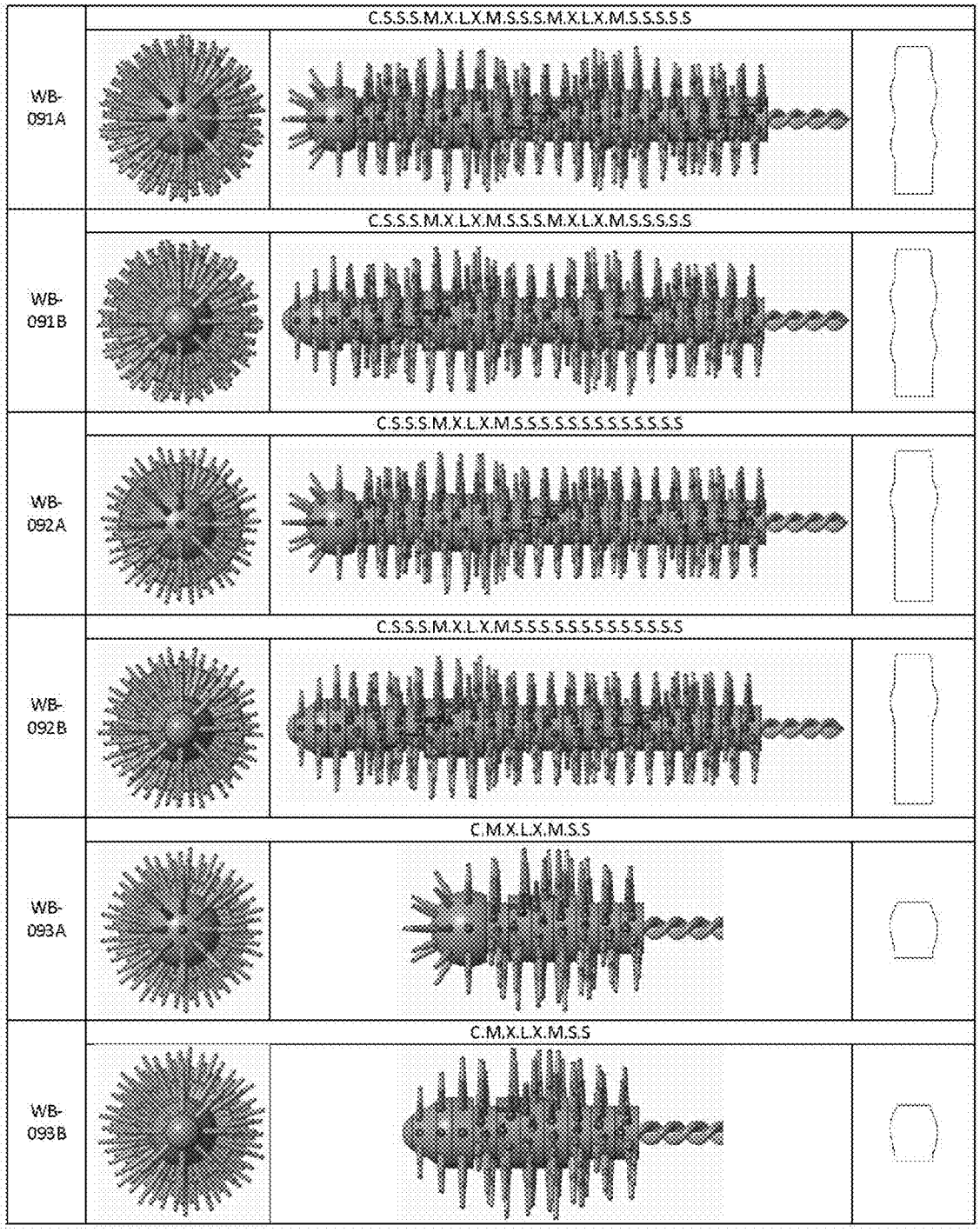
Figure 38:
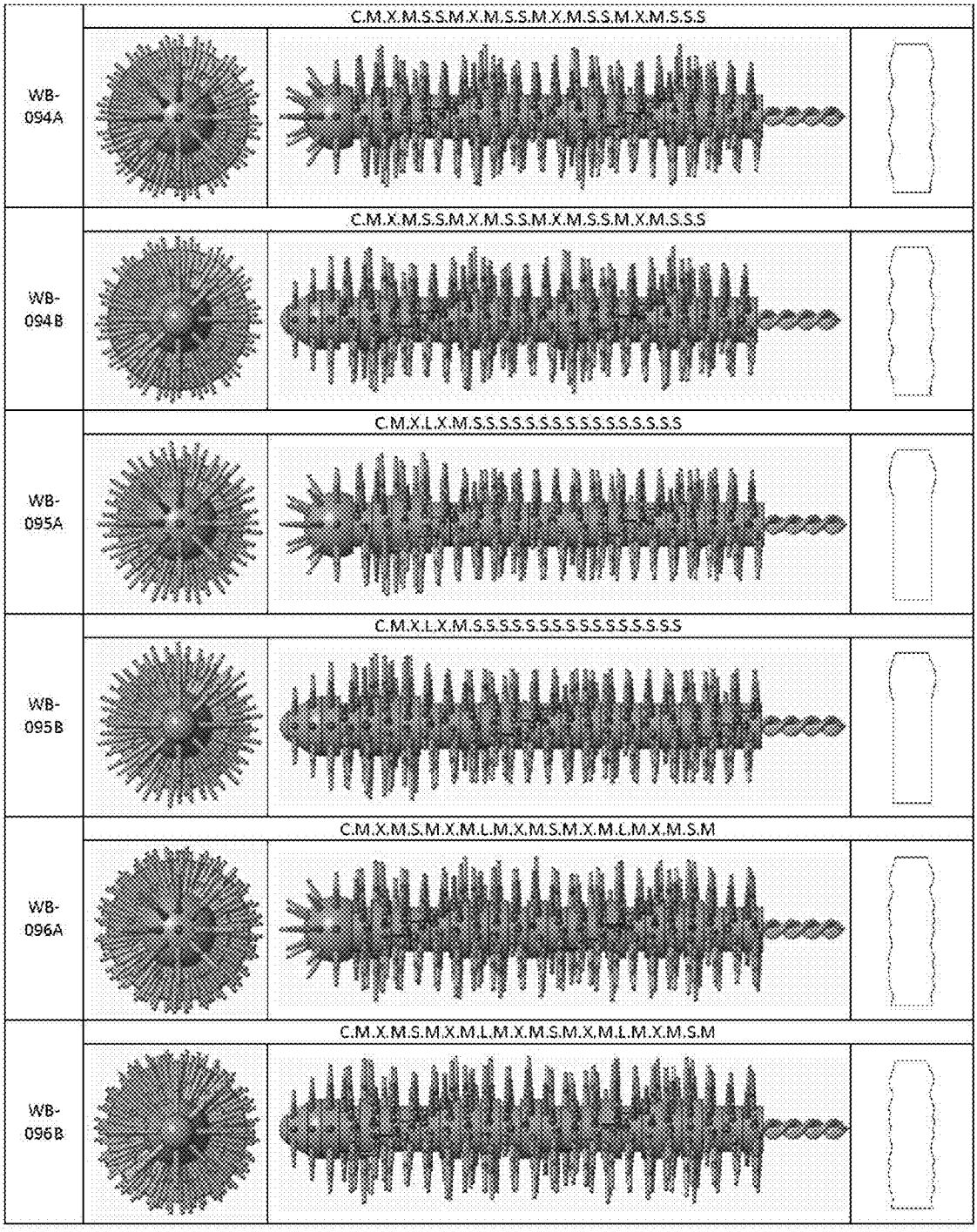
Figure 39:
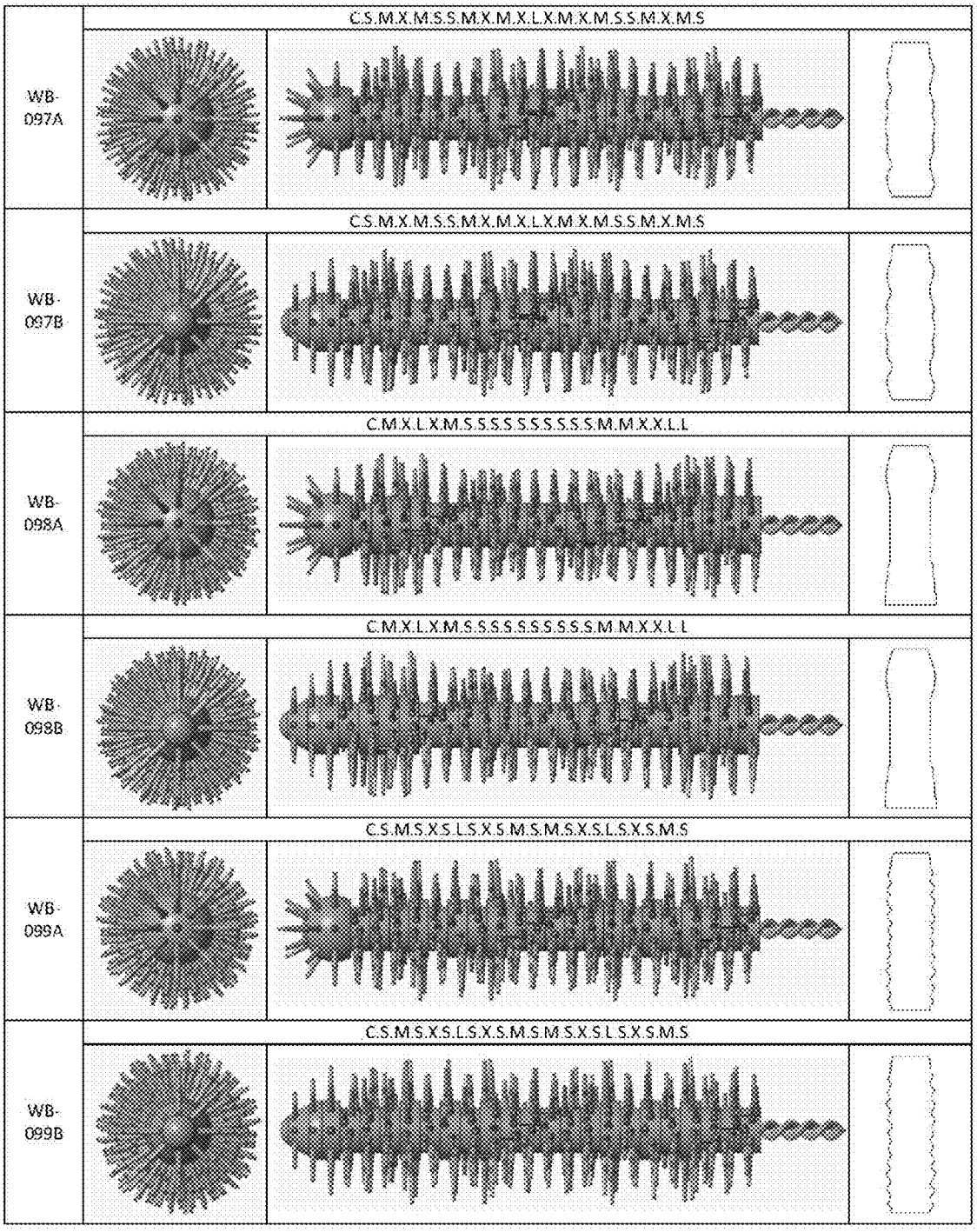
Figure 40:
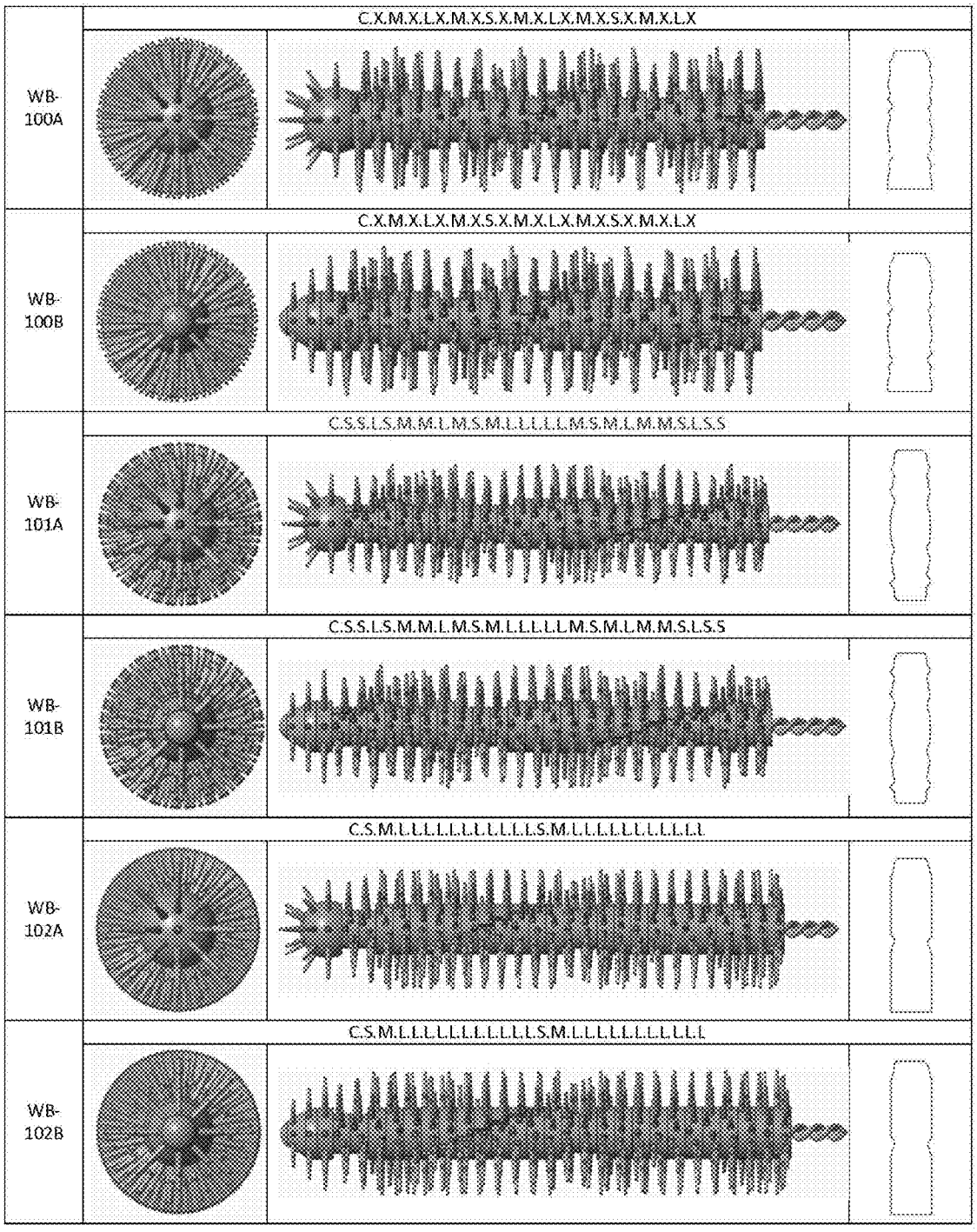
Figure 41:
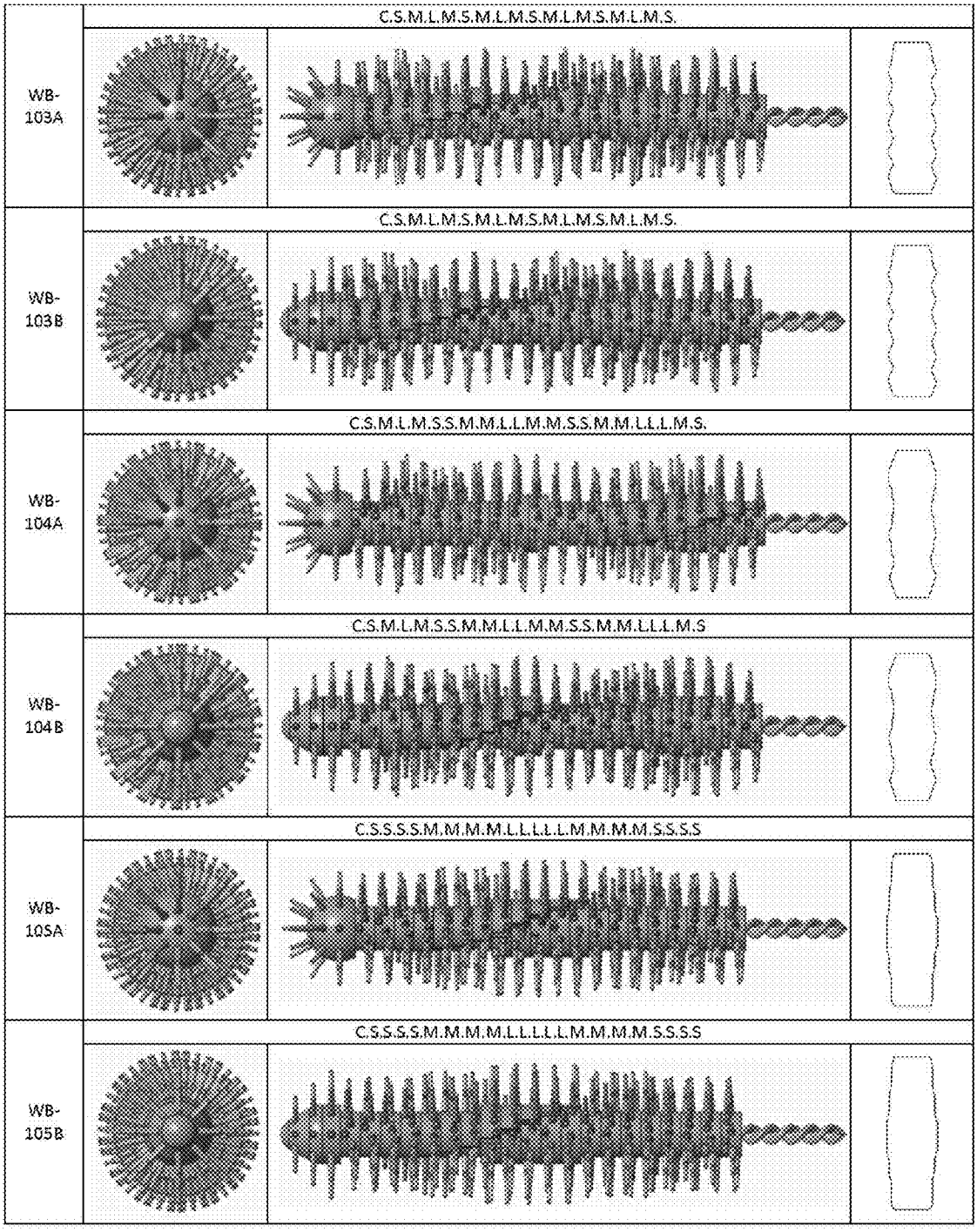
Figure 42:
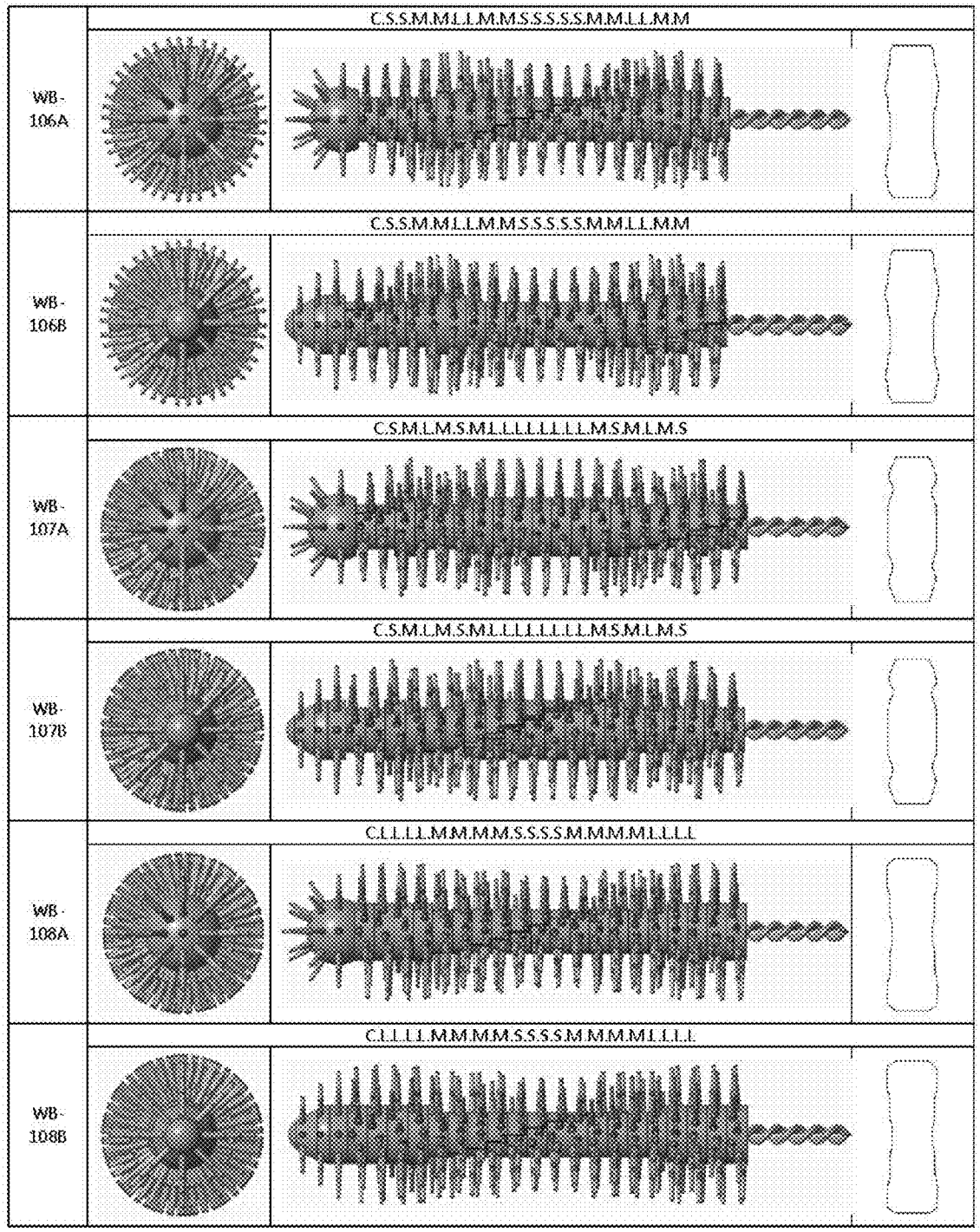
Figure 43:
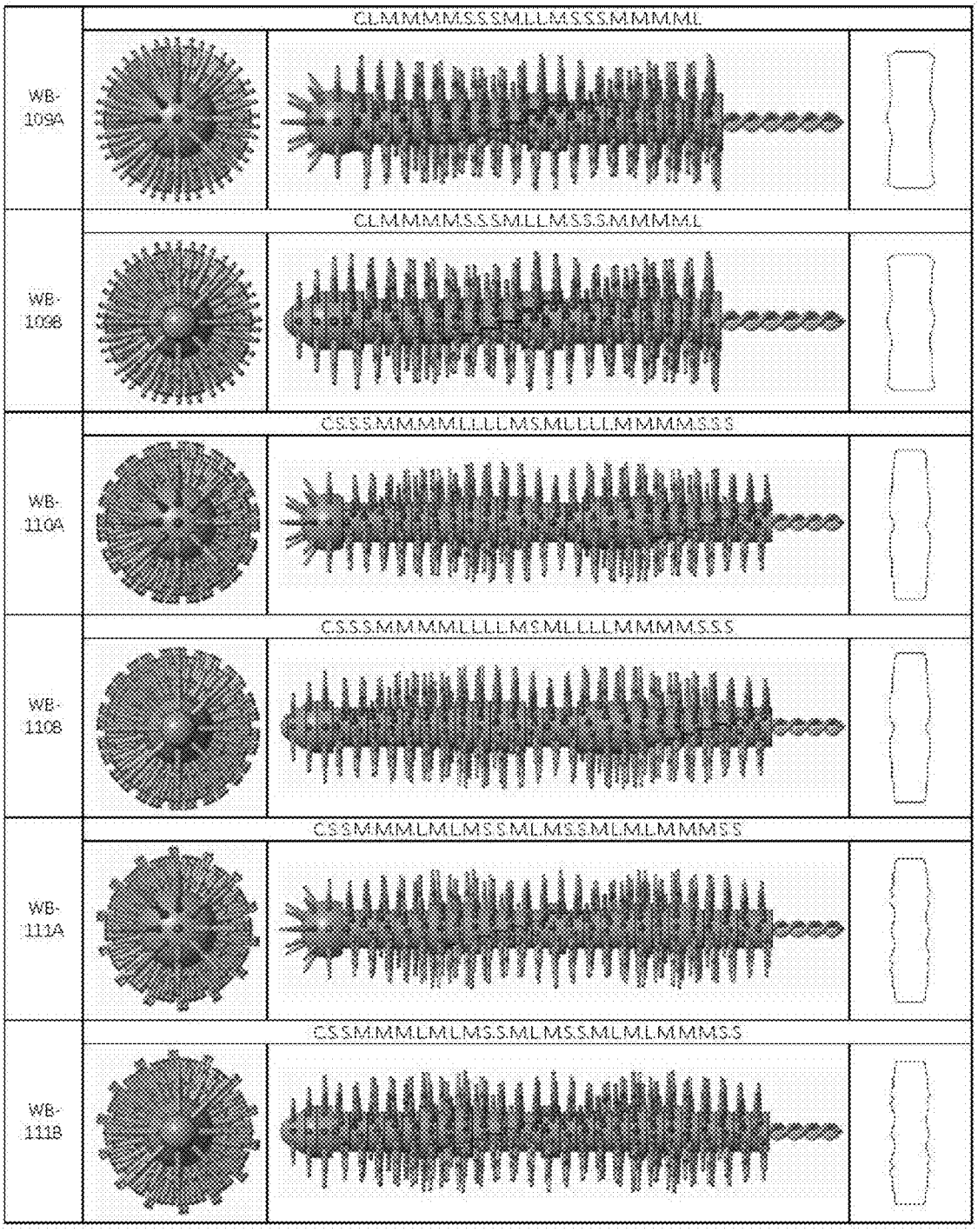
Figure 44:
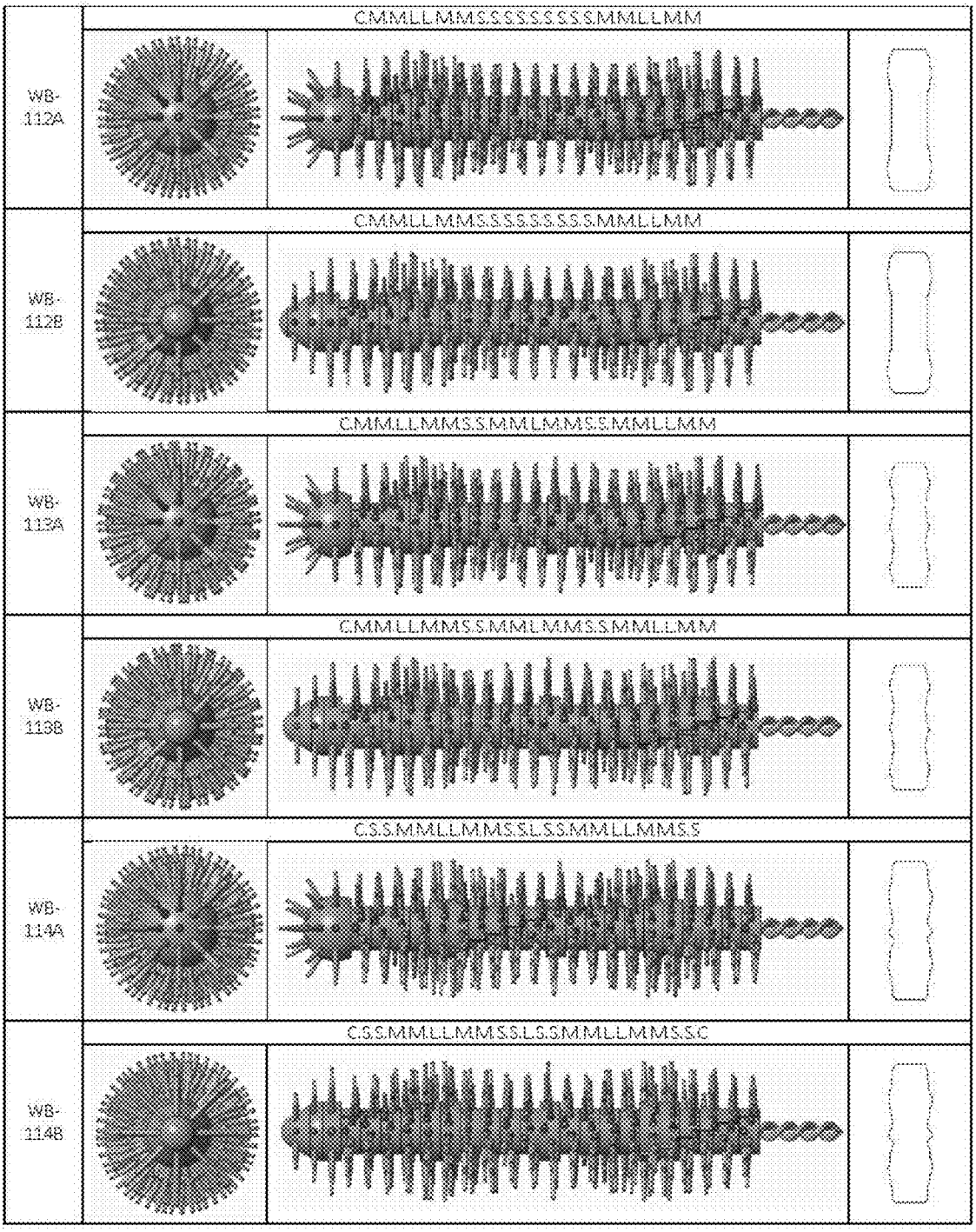
Figure 45:
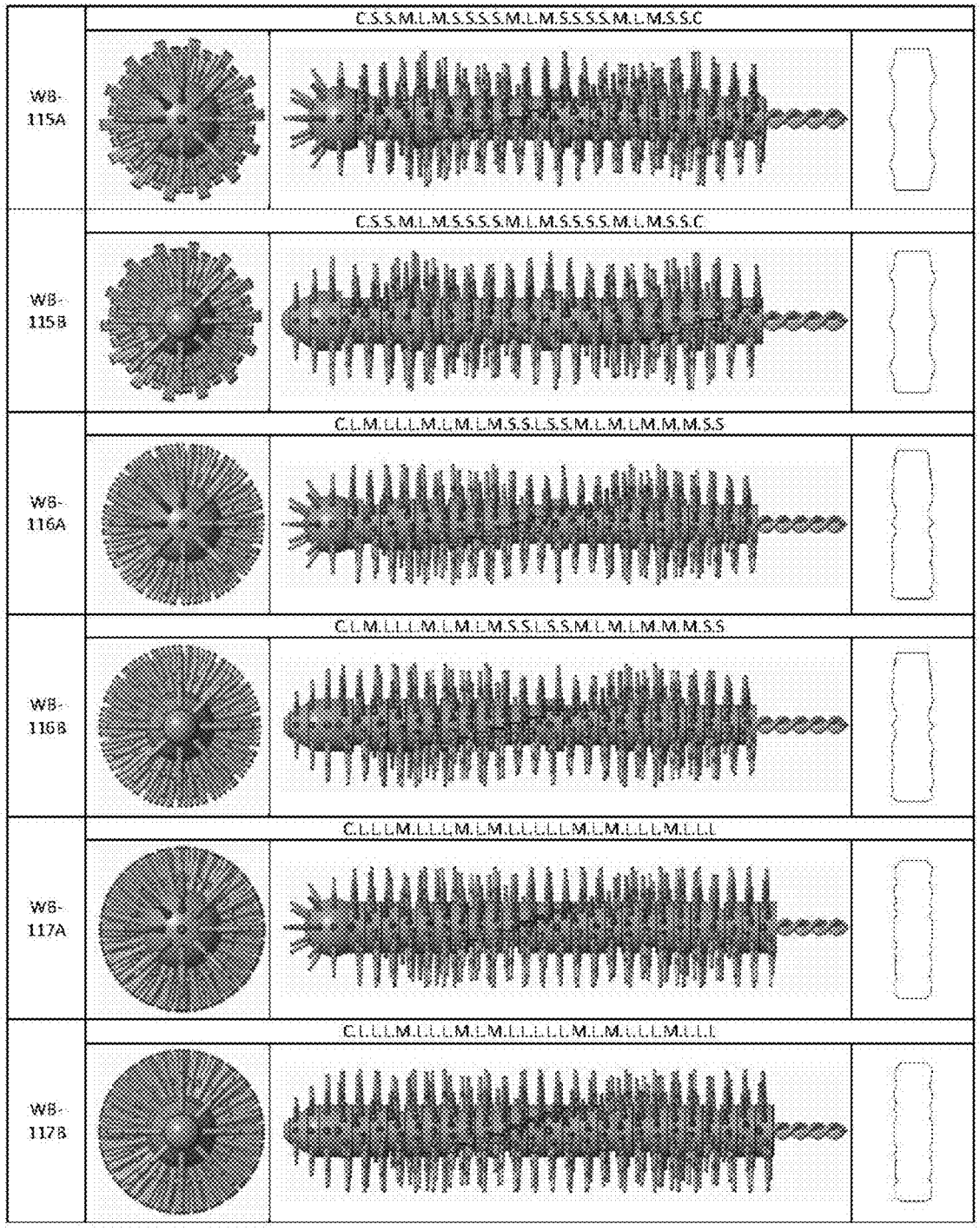
Figure 46:
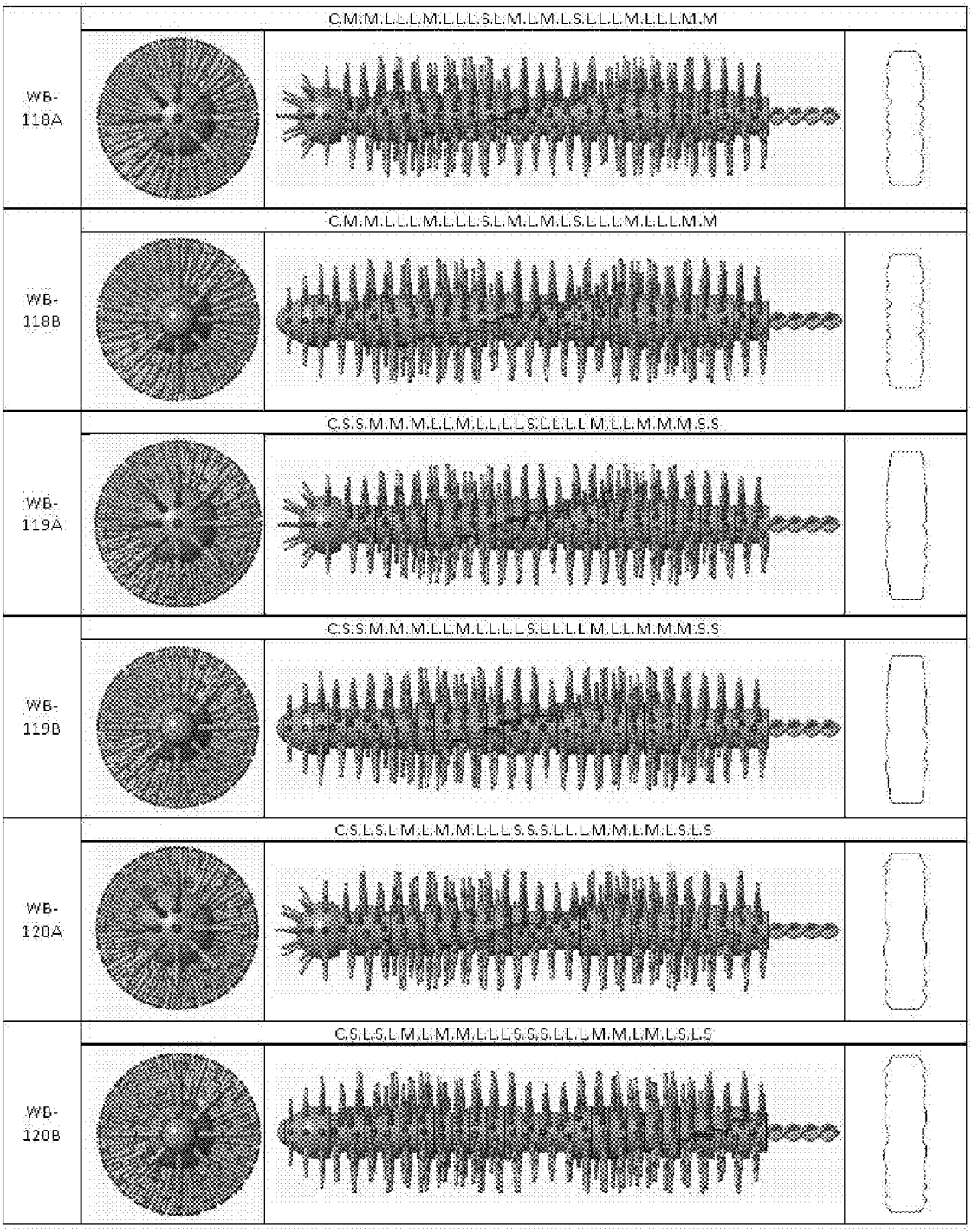
Figure 47:
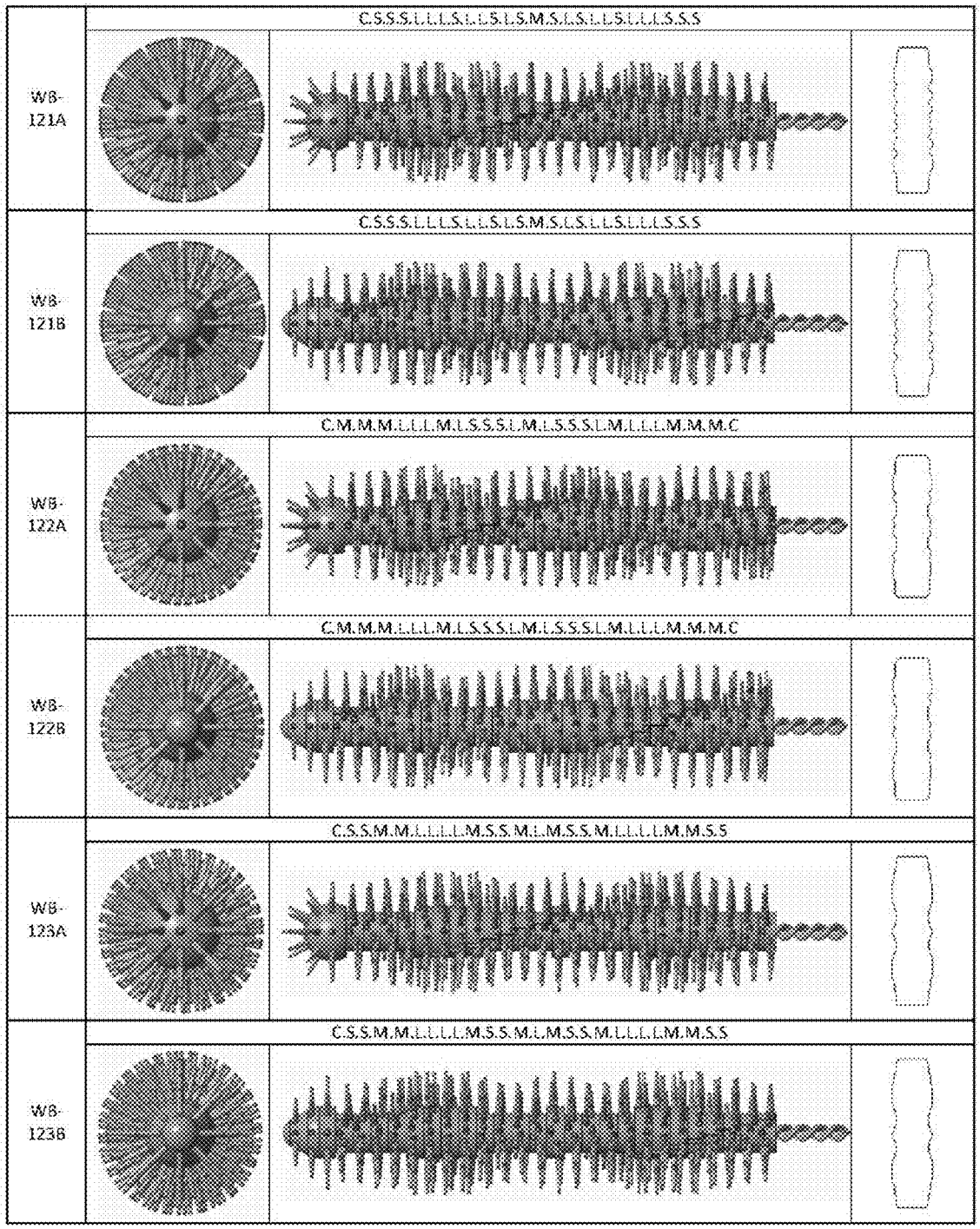
Figure 48:
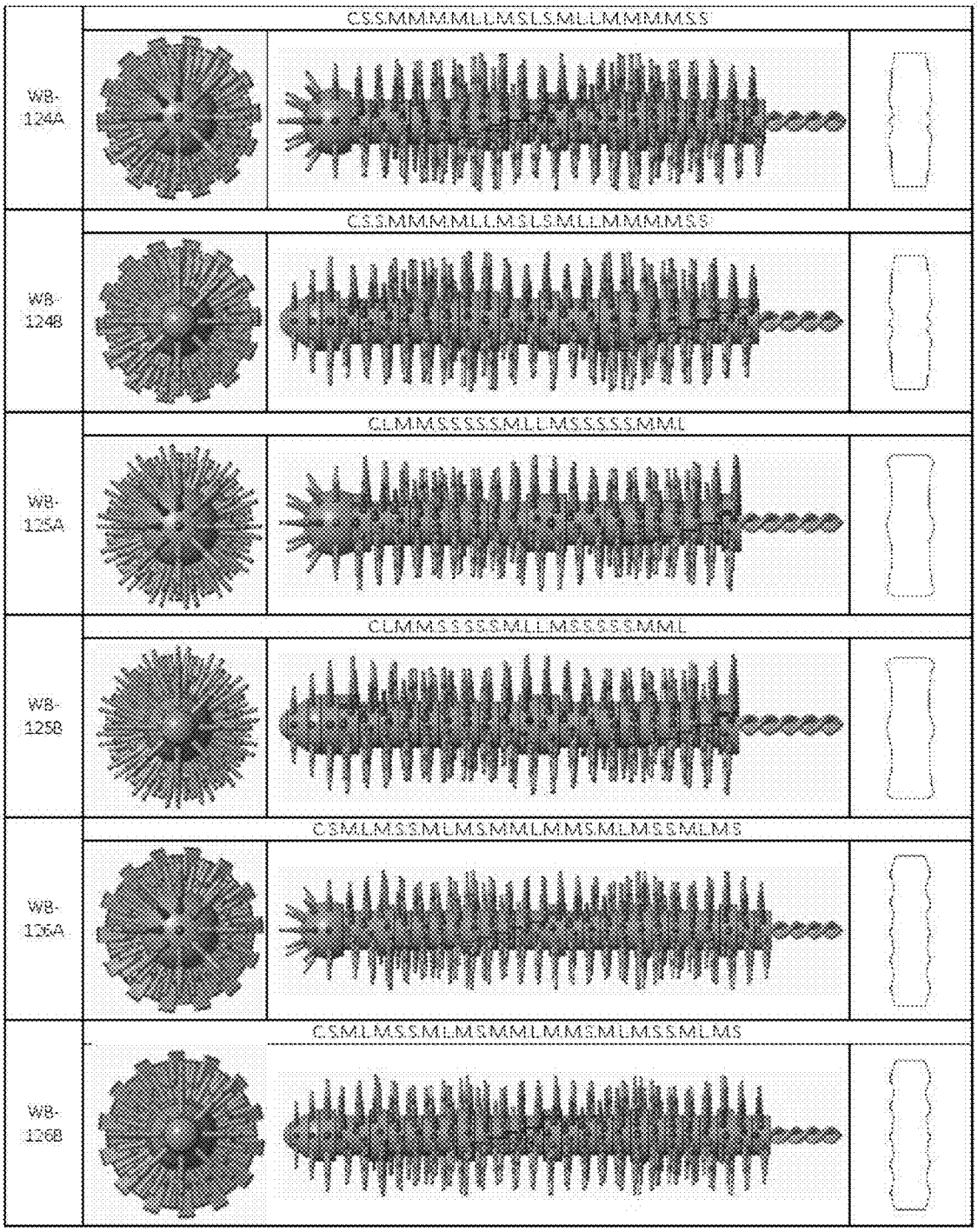
Figure 49:
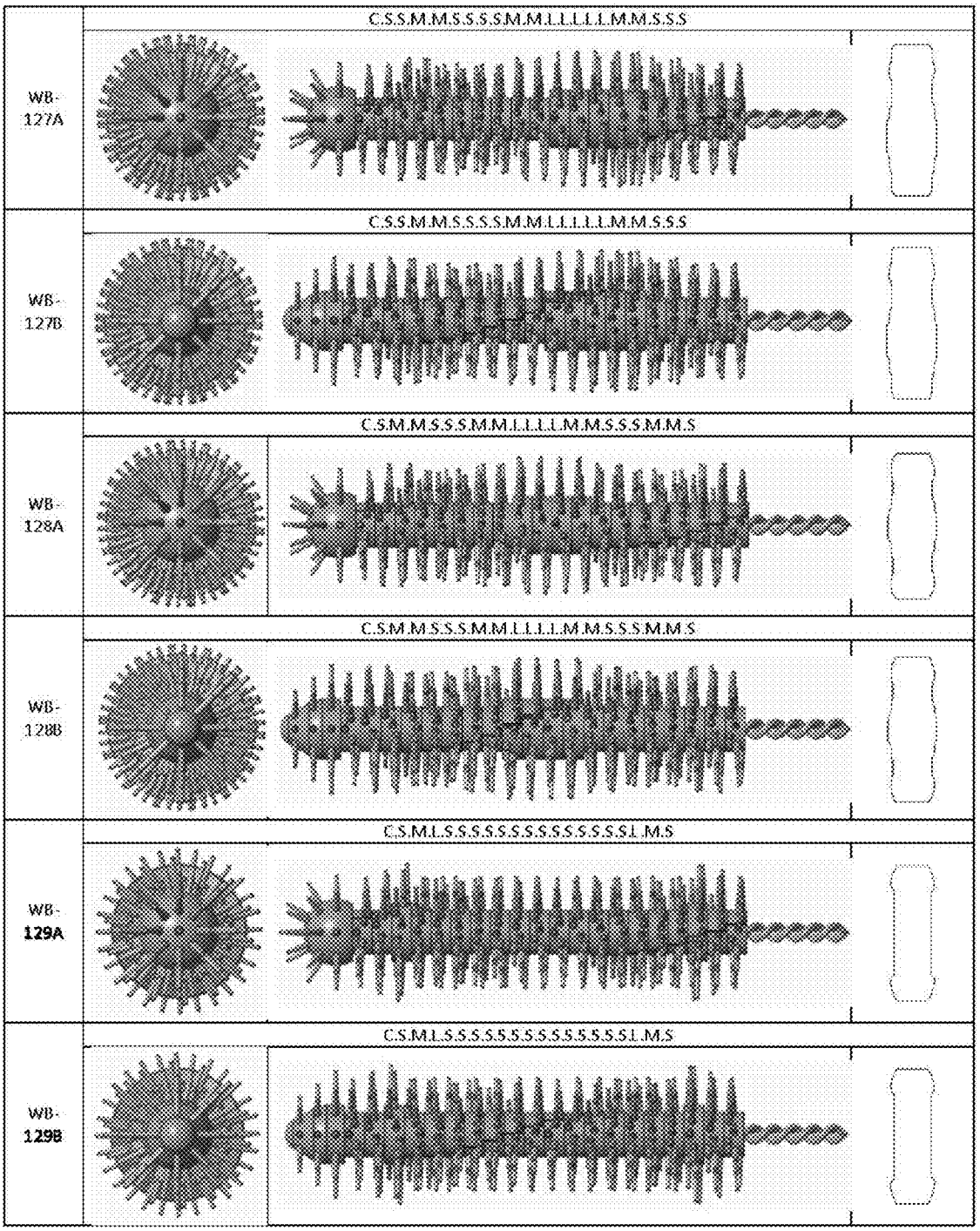
Figure 50:
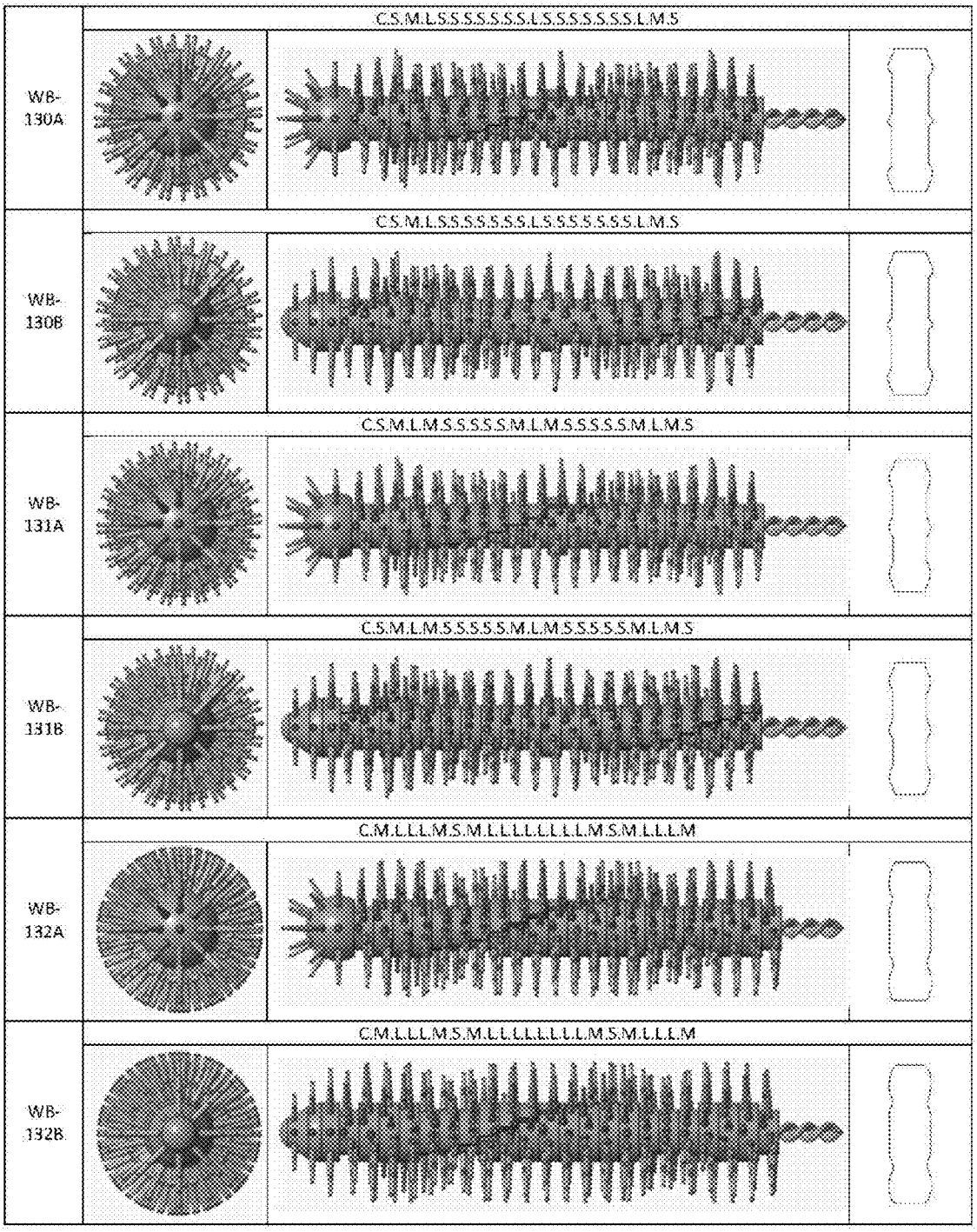
Figure 51:
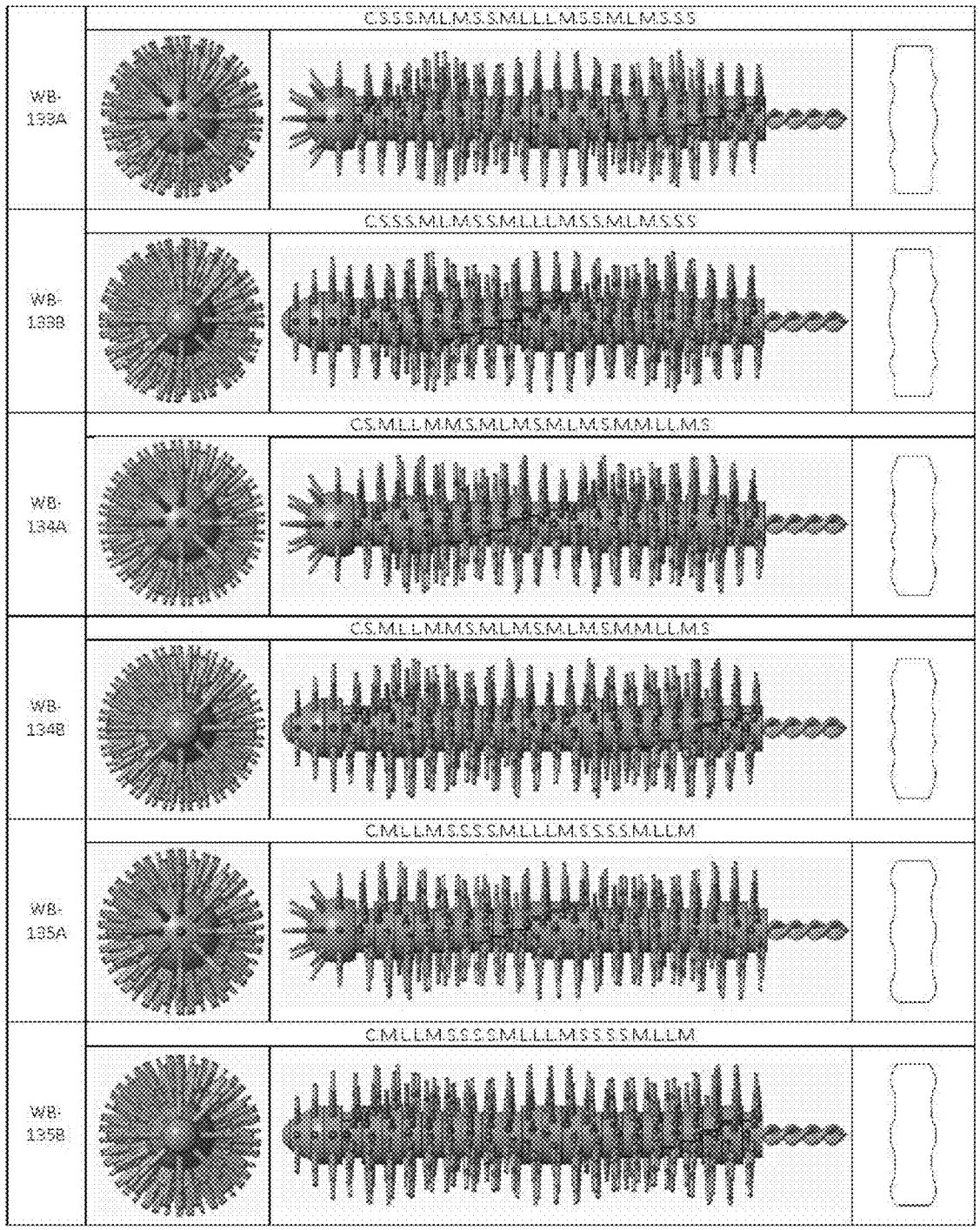
Figure 52:
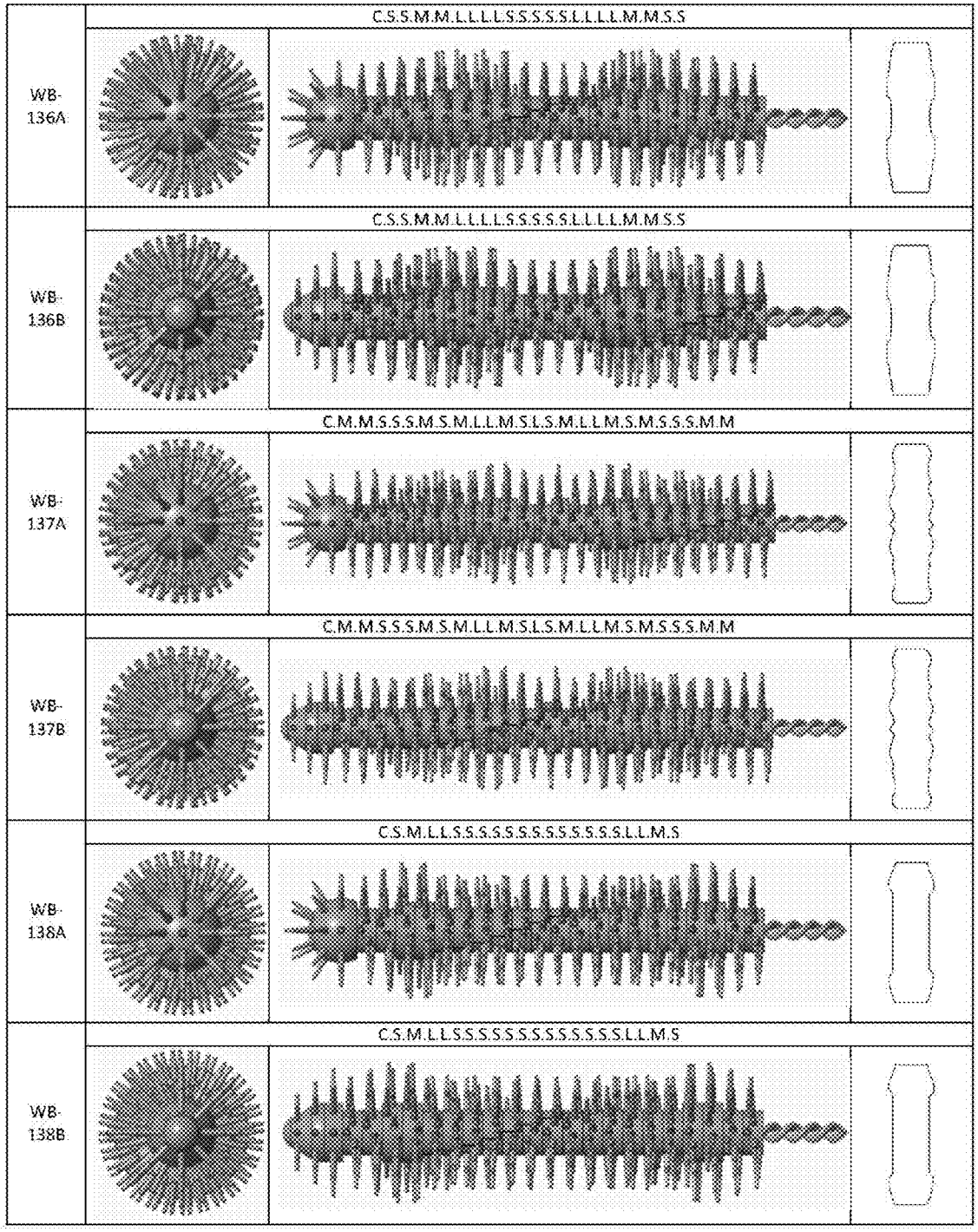
Figure 53:
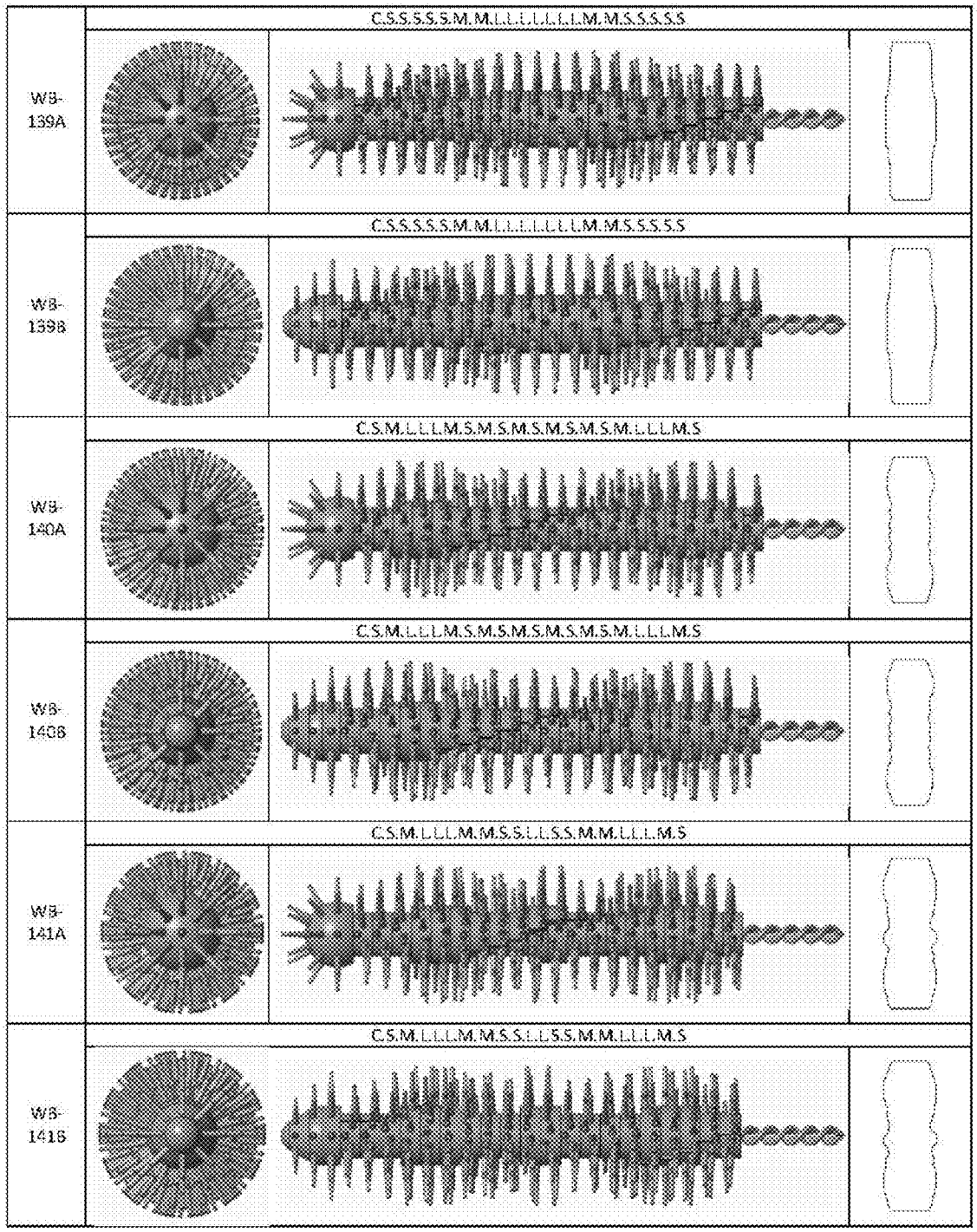
Figure 54:
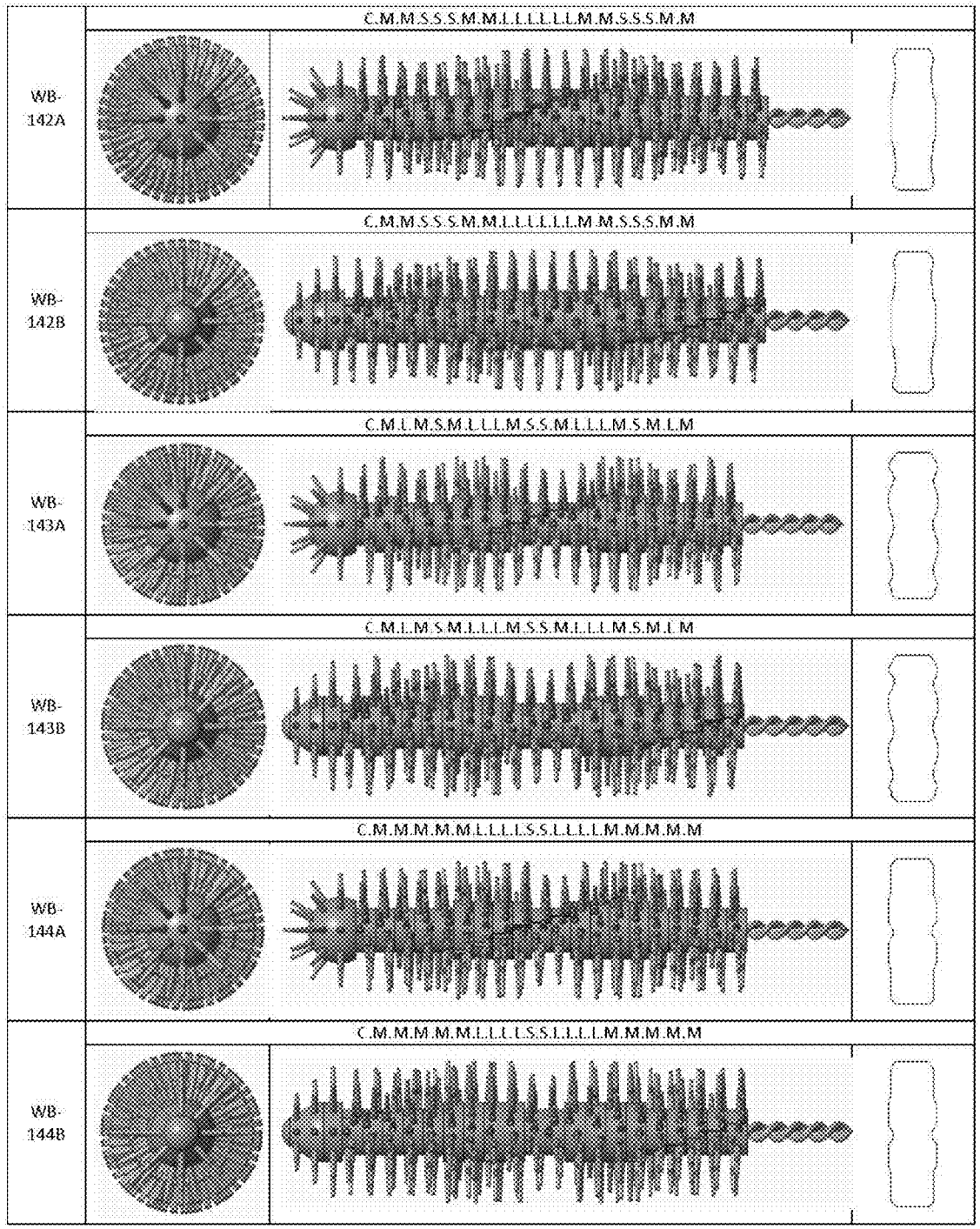
Figure 55:
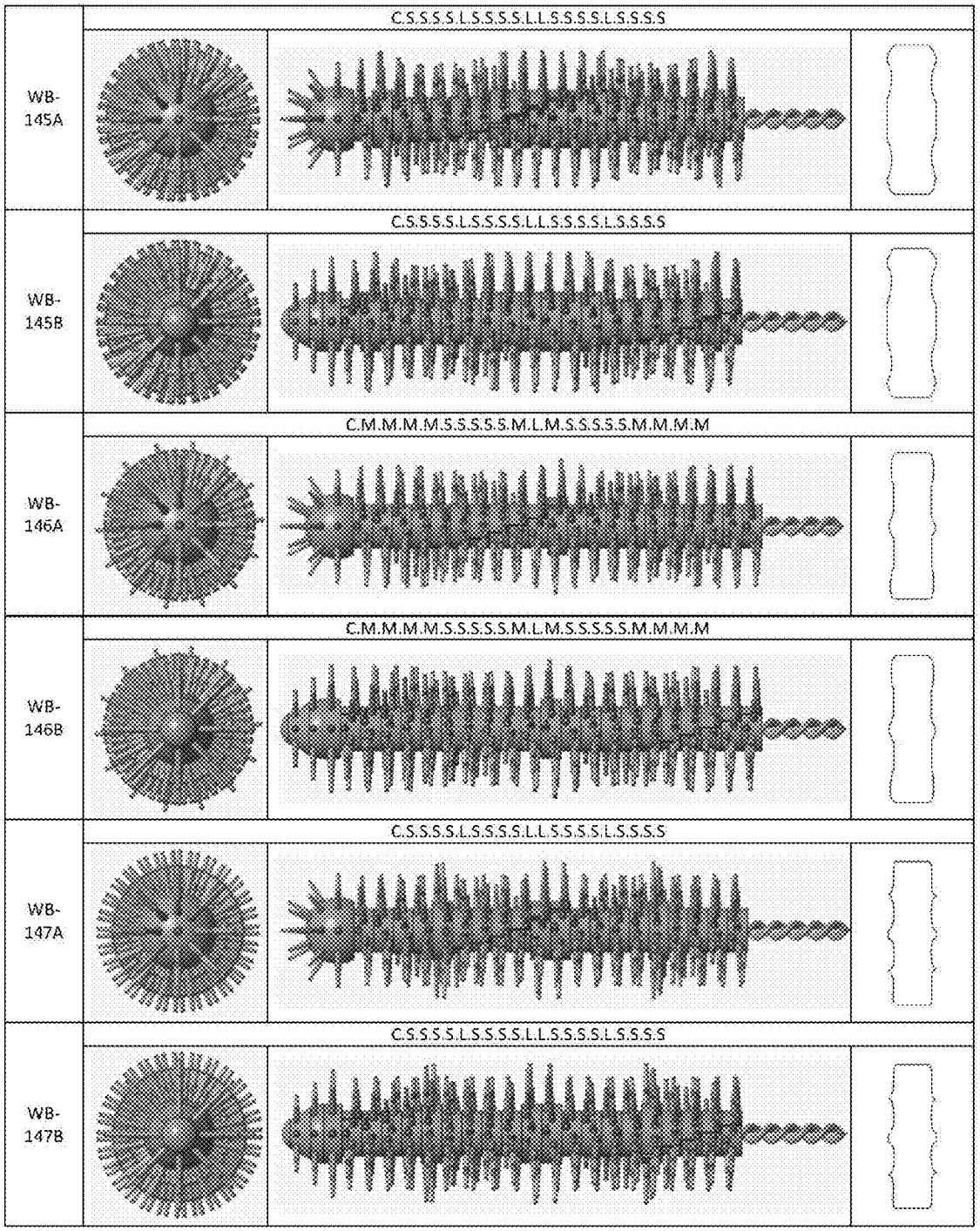
Figure 56:
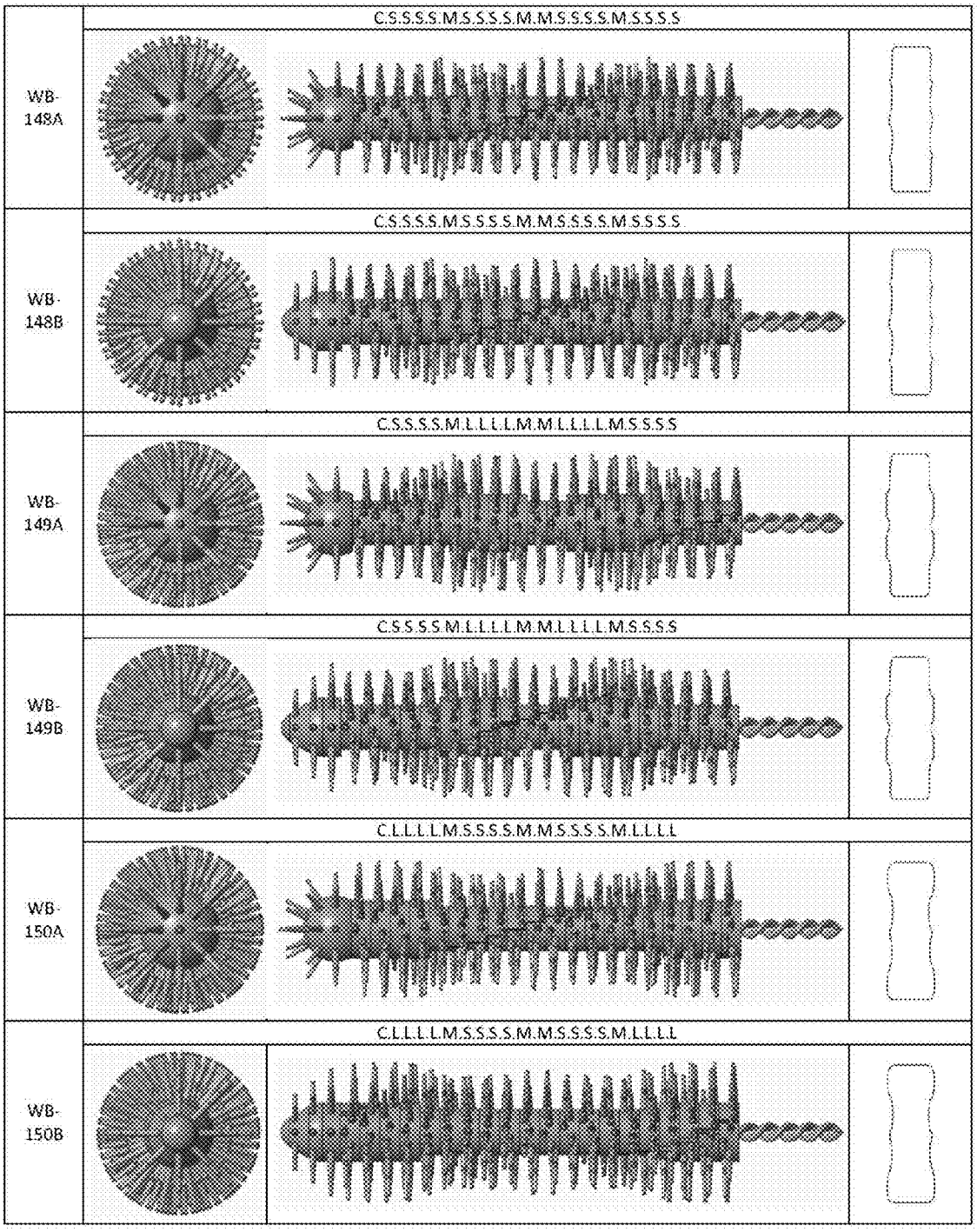
Figure 57:
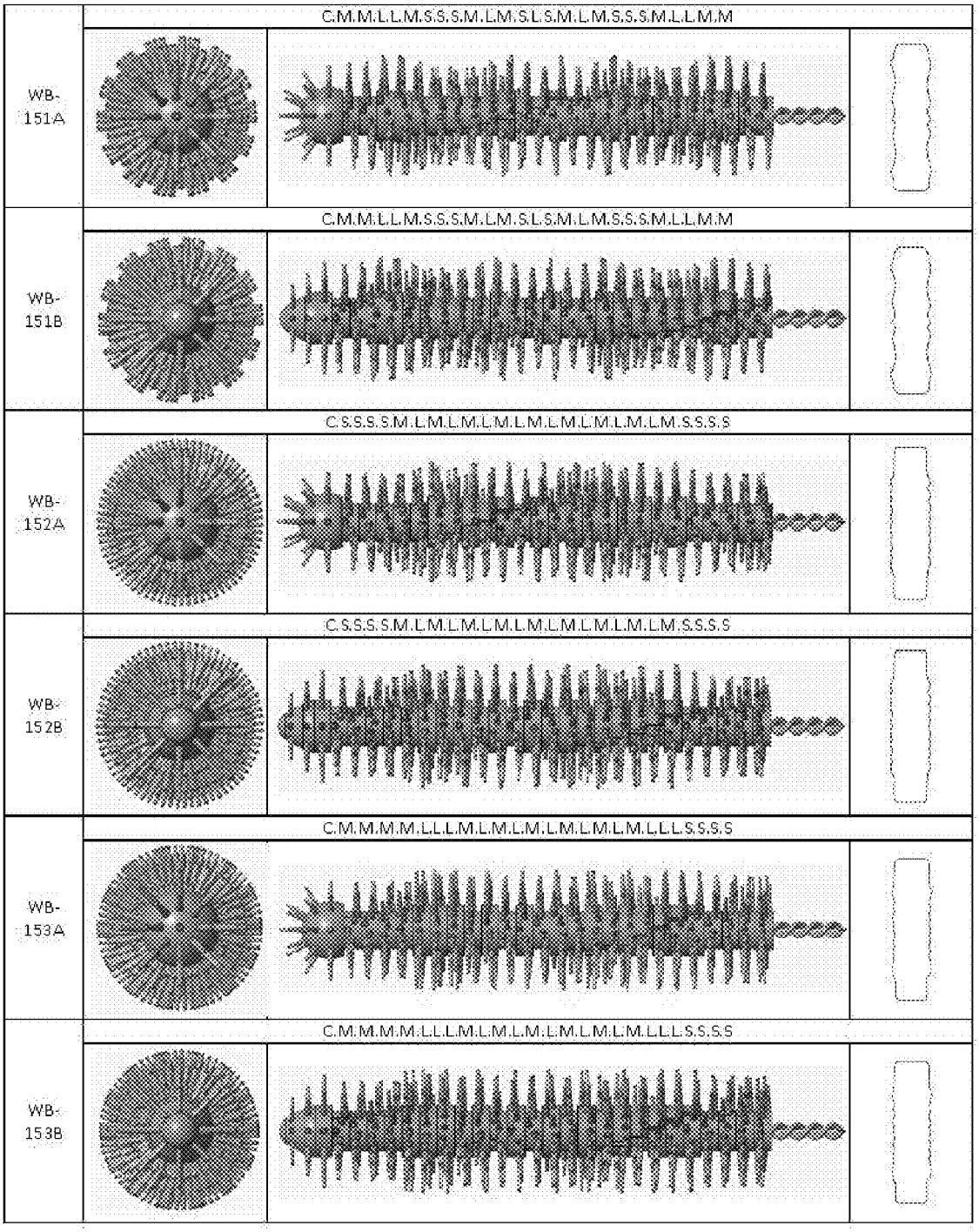
Figure 58:
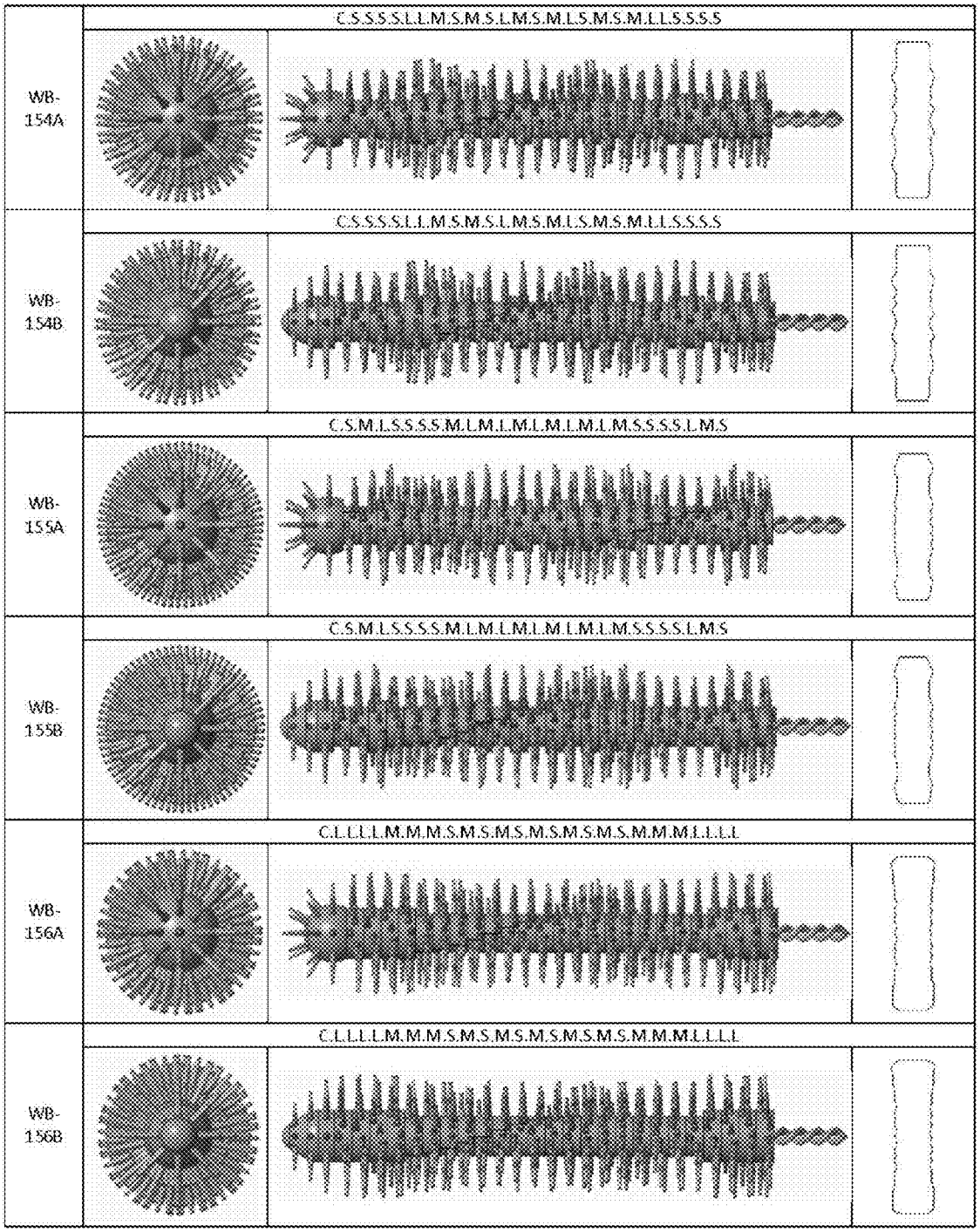
Figure 59:
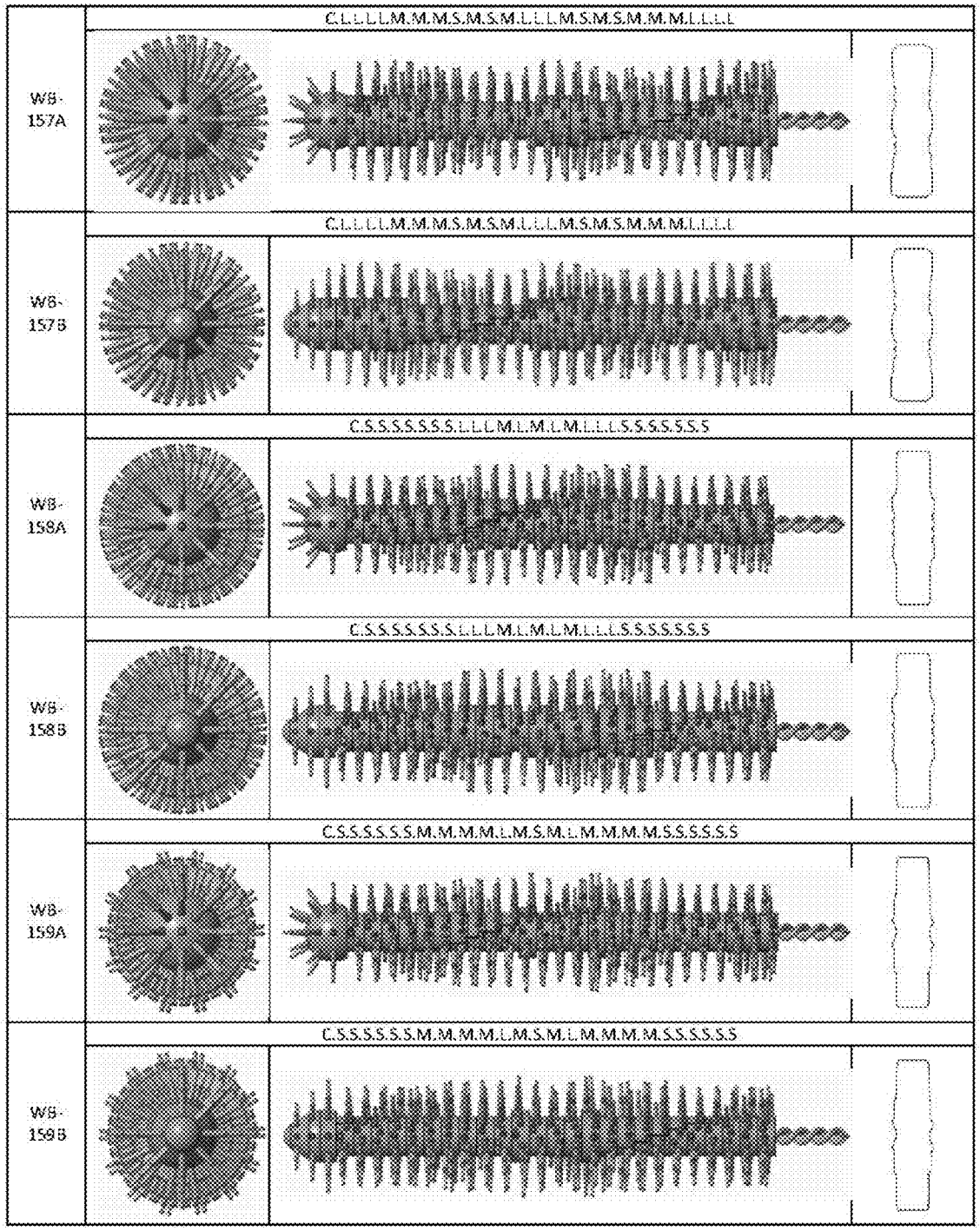
Figure 60:
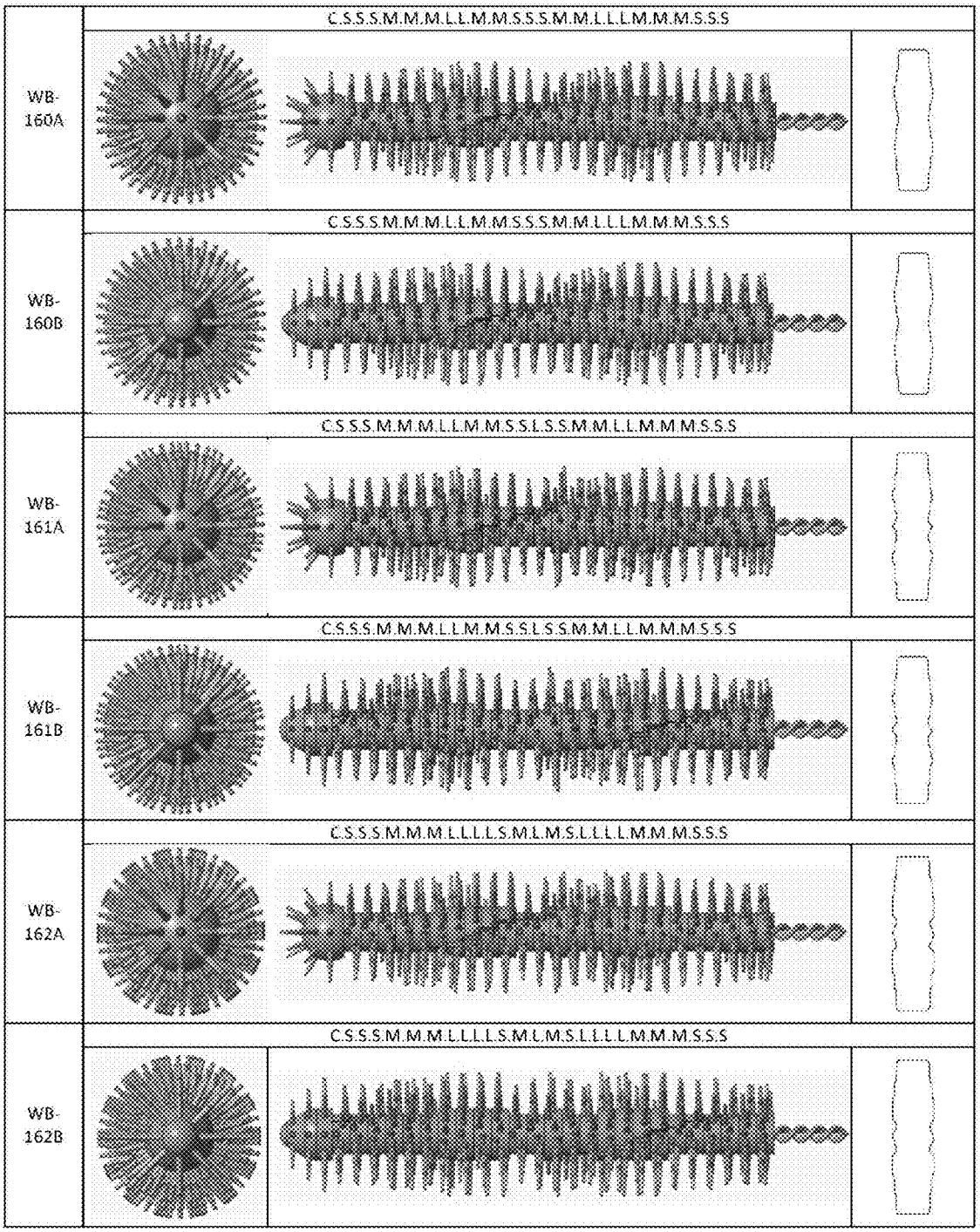
Figure 61:
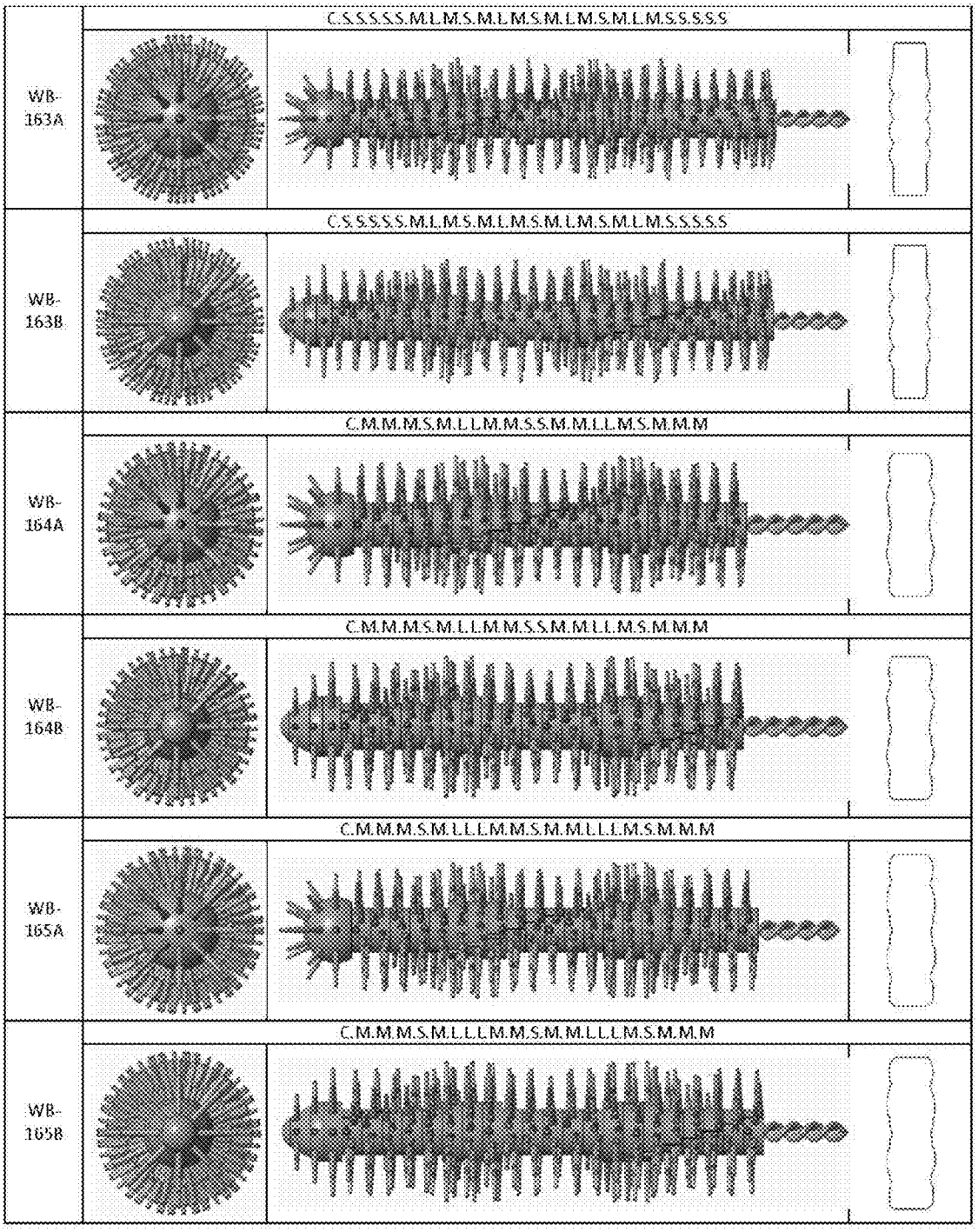
Figure 62:
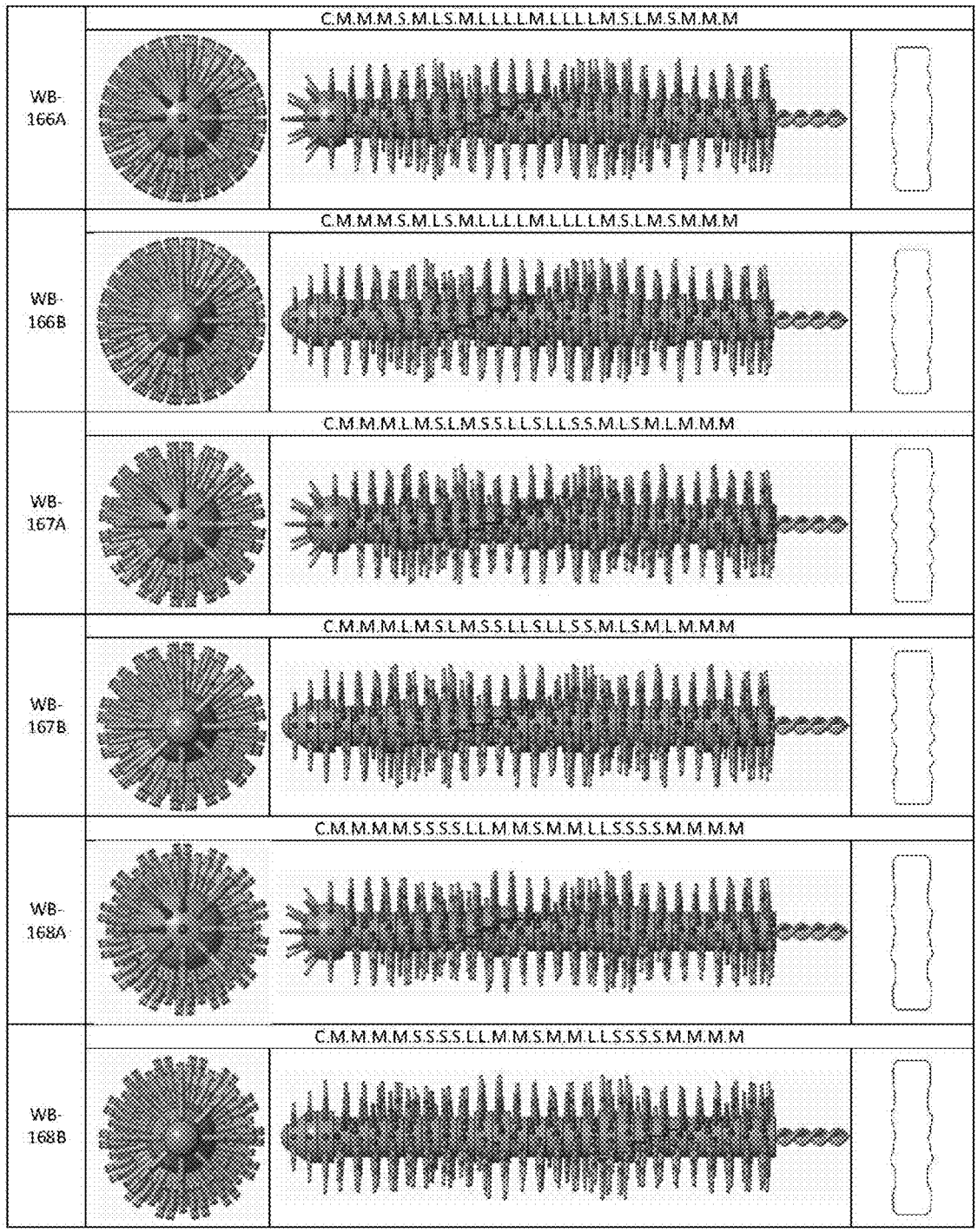
Figure 63:
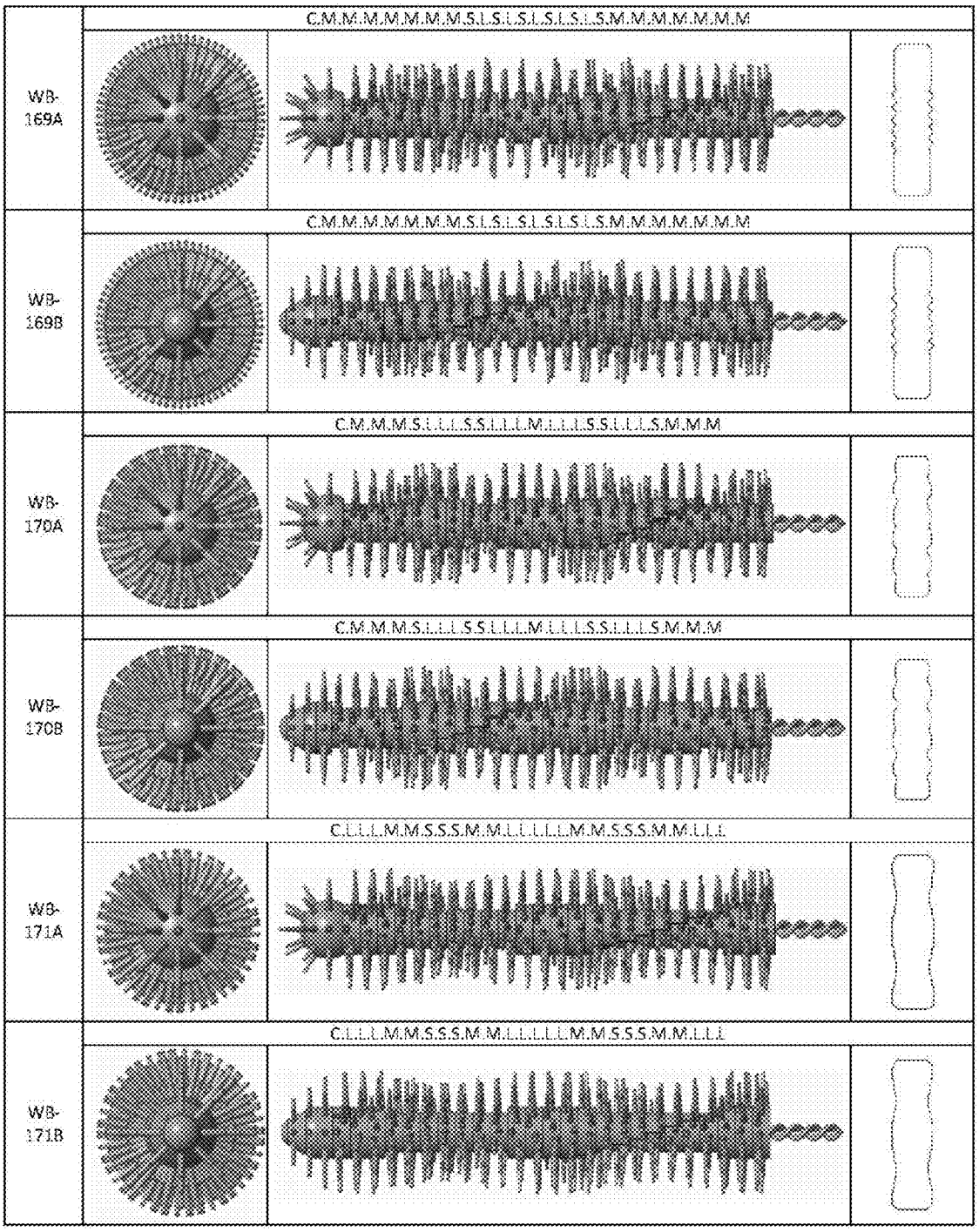
Figure 64:
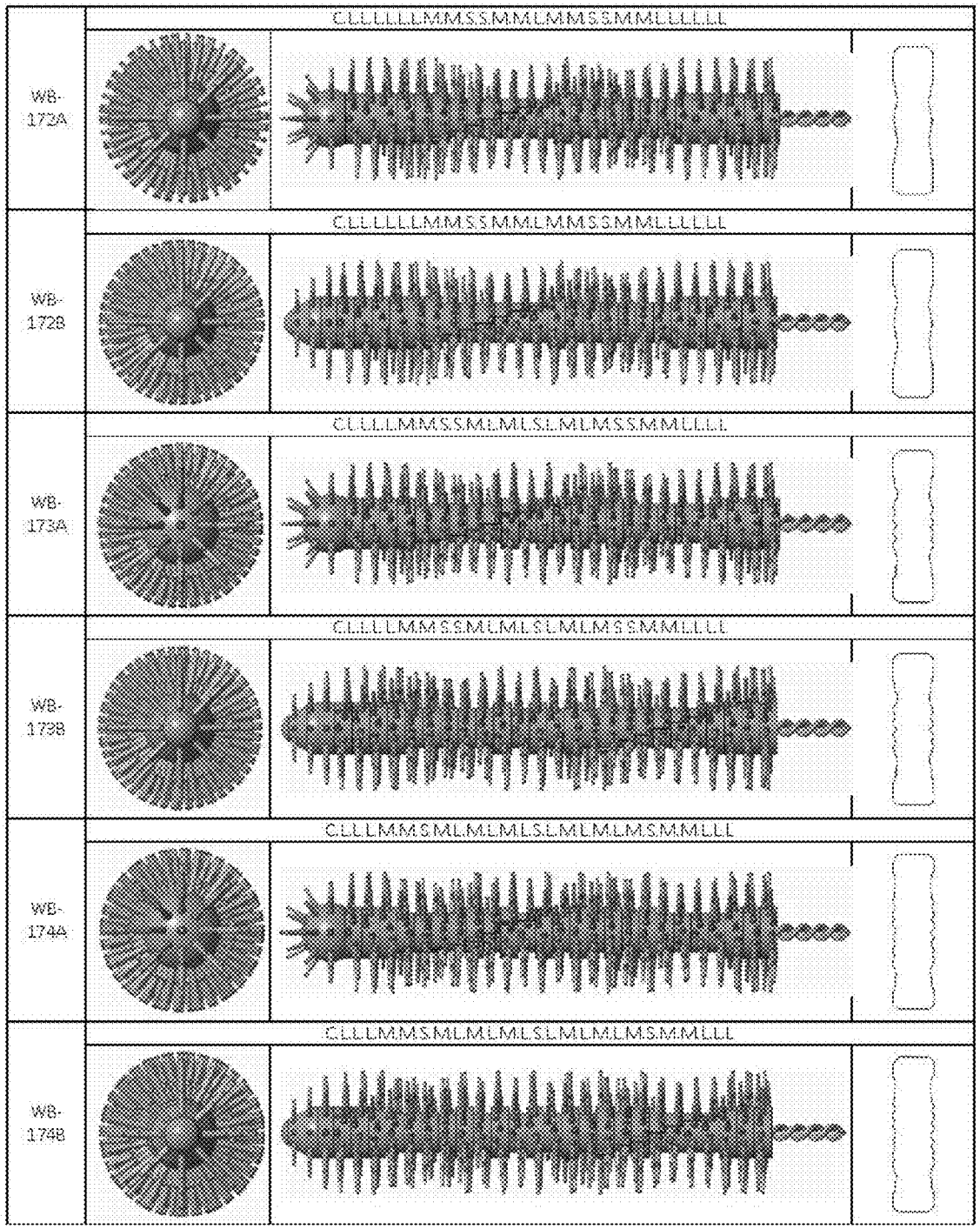
Figure 65:
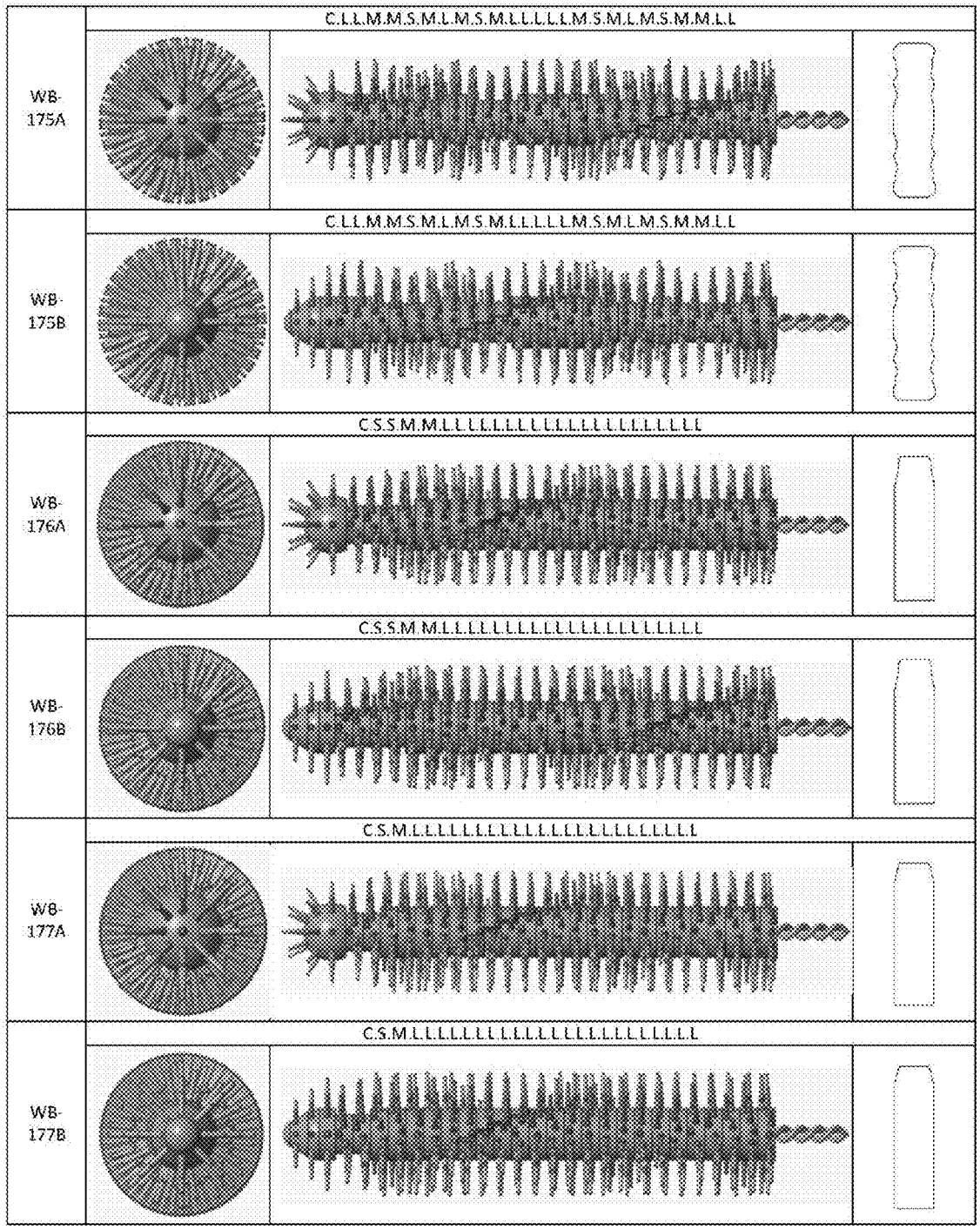
Figure 66:
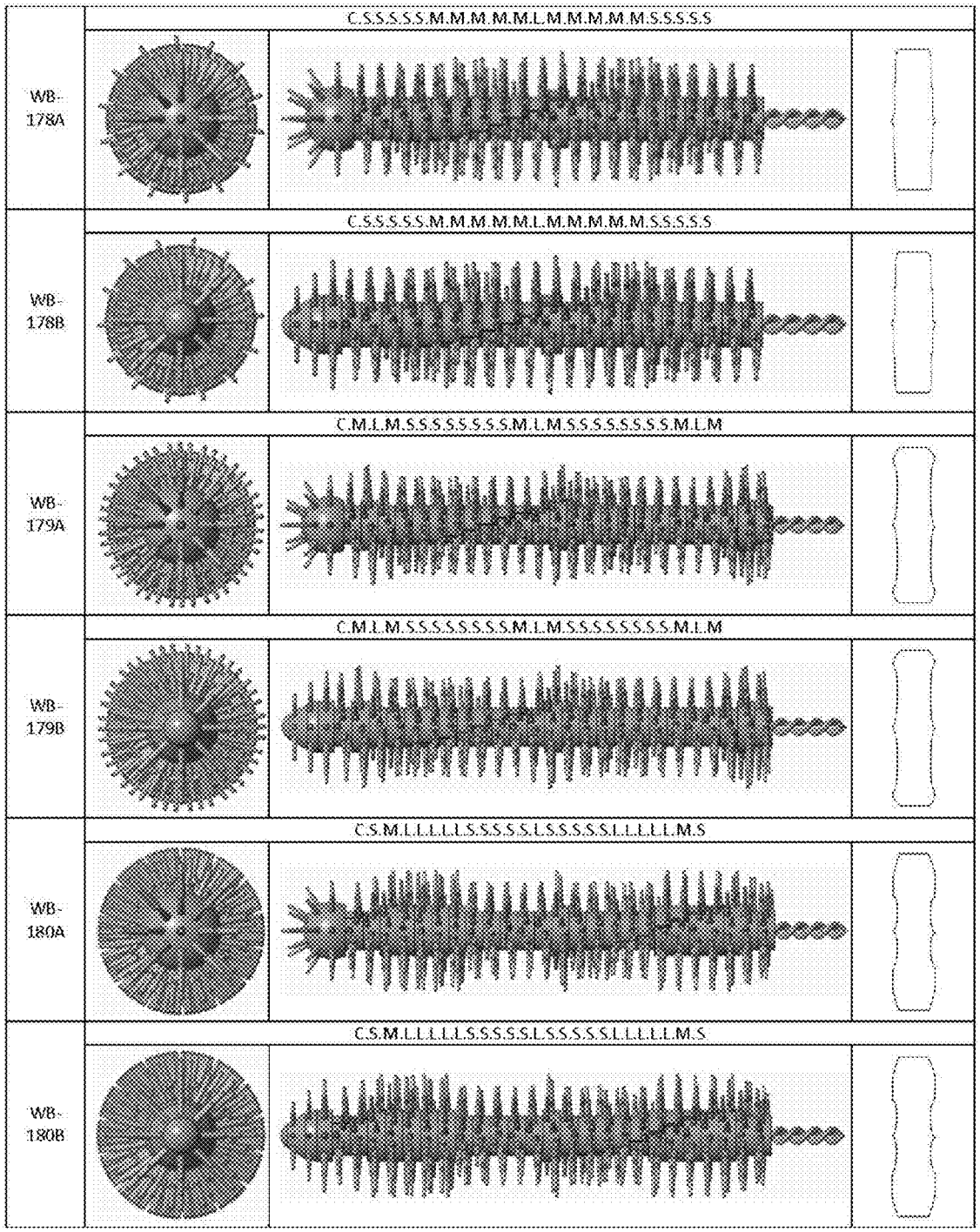
Figure 67:
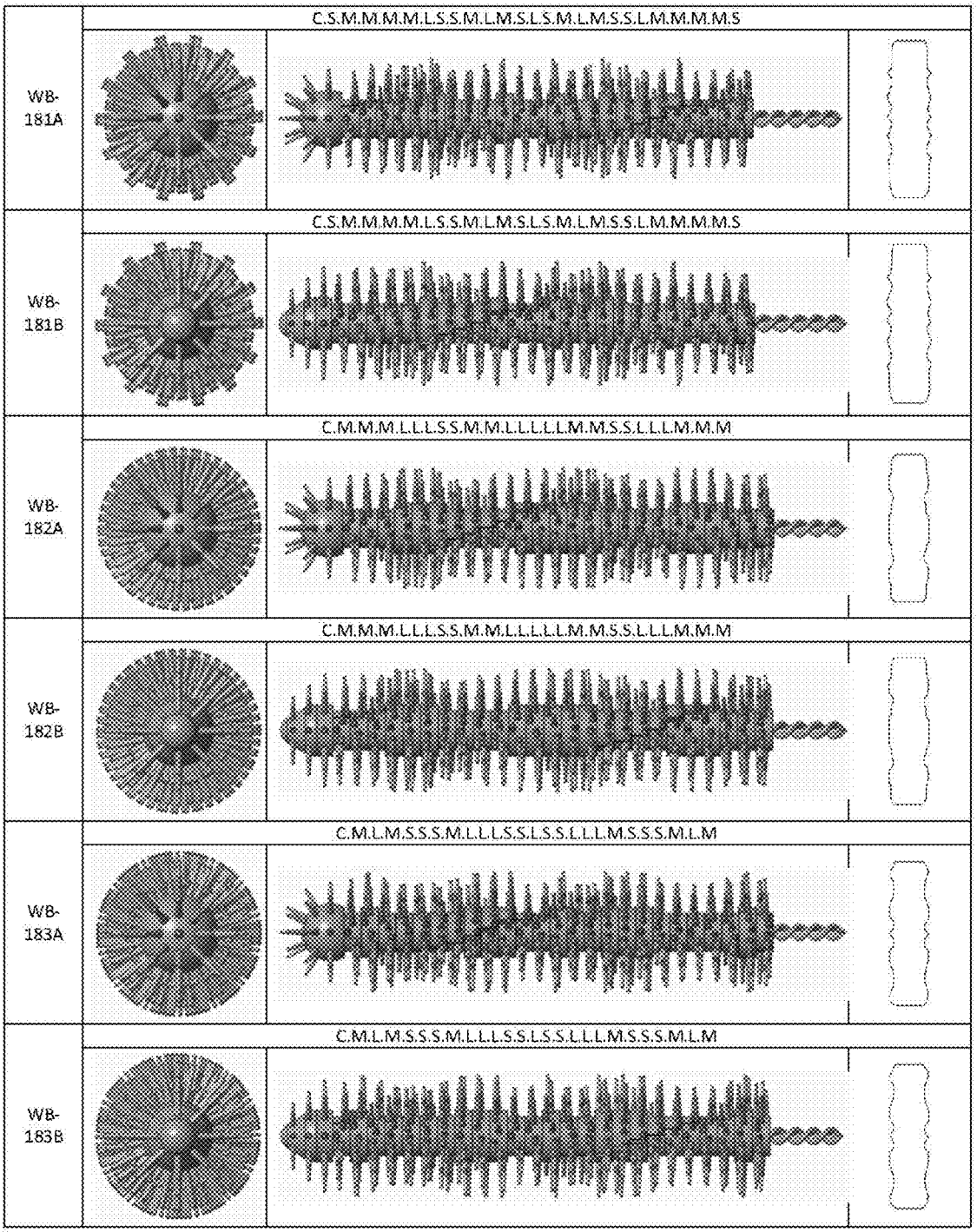
Figure 68:
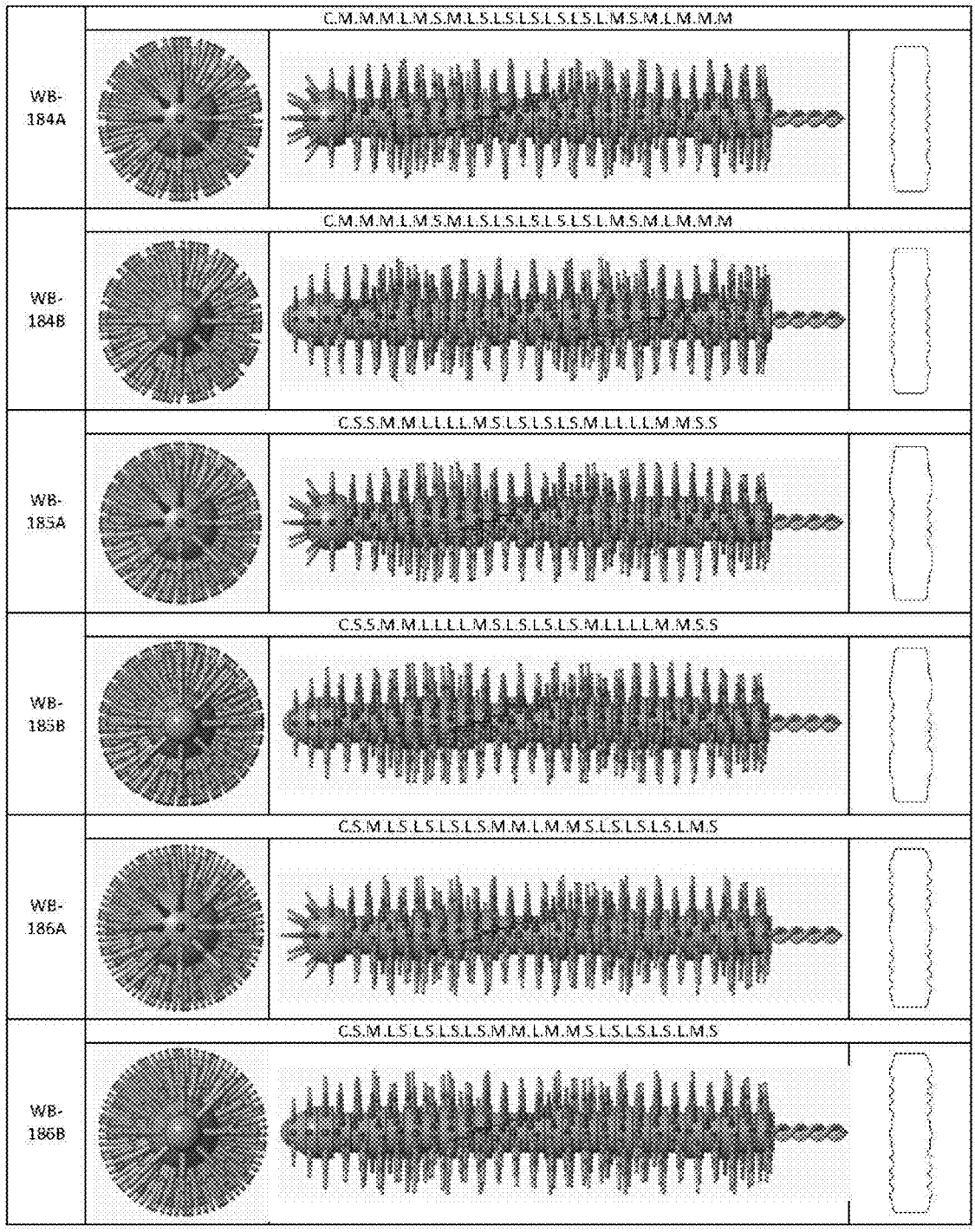
Figure 69:
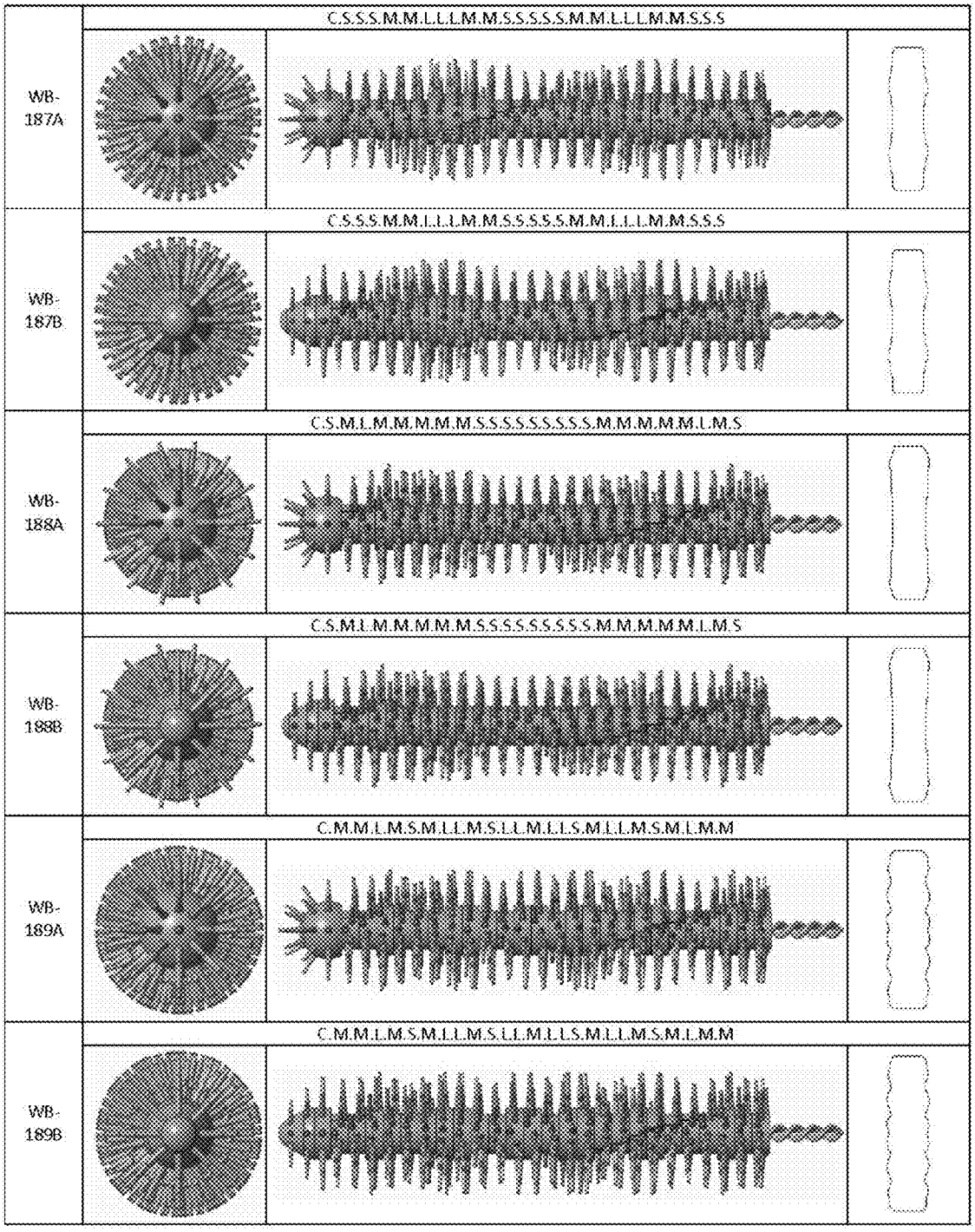
Figure 70:
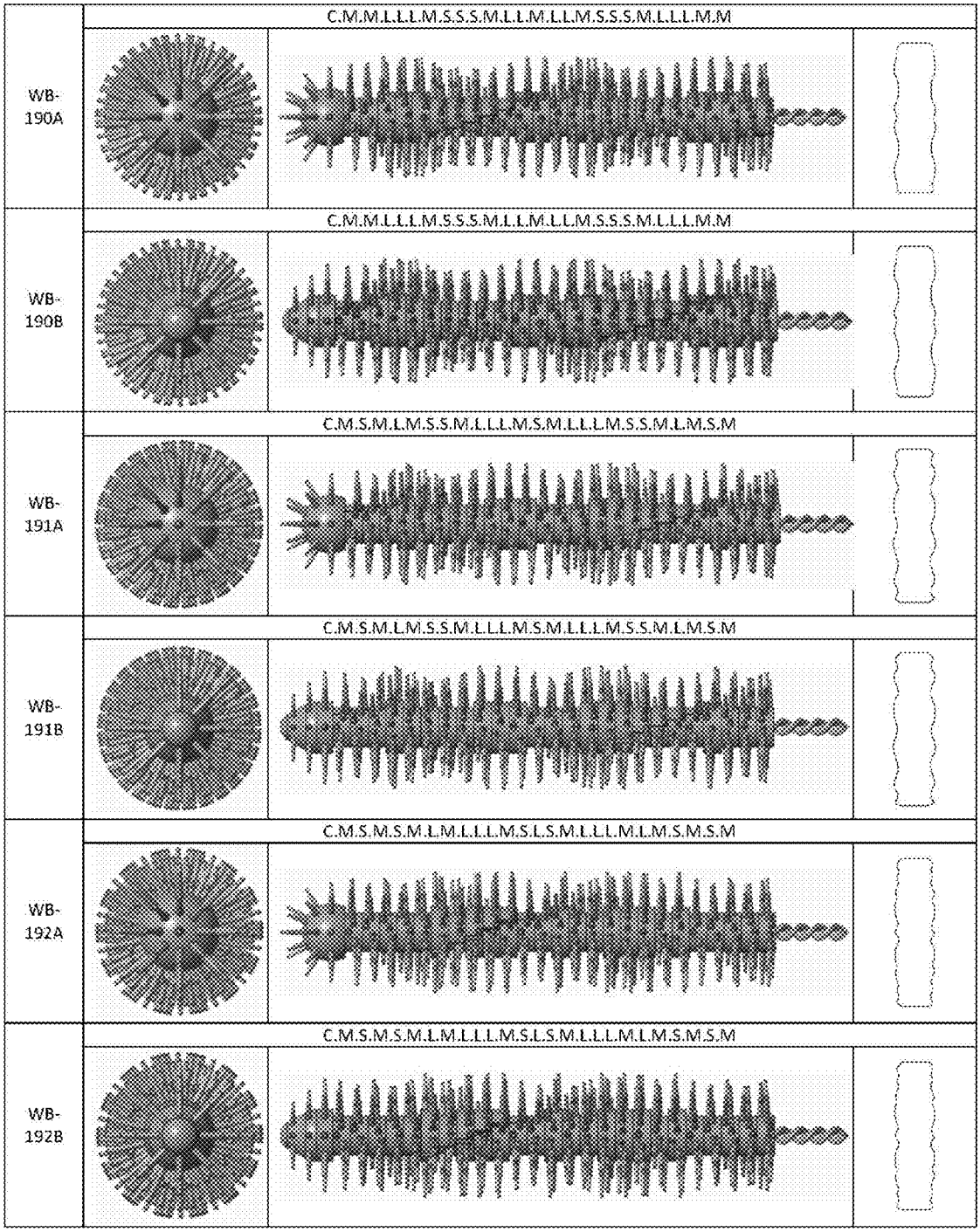
Figure 71:
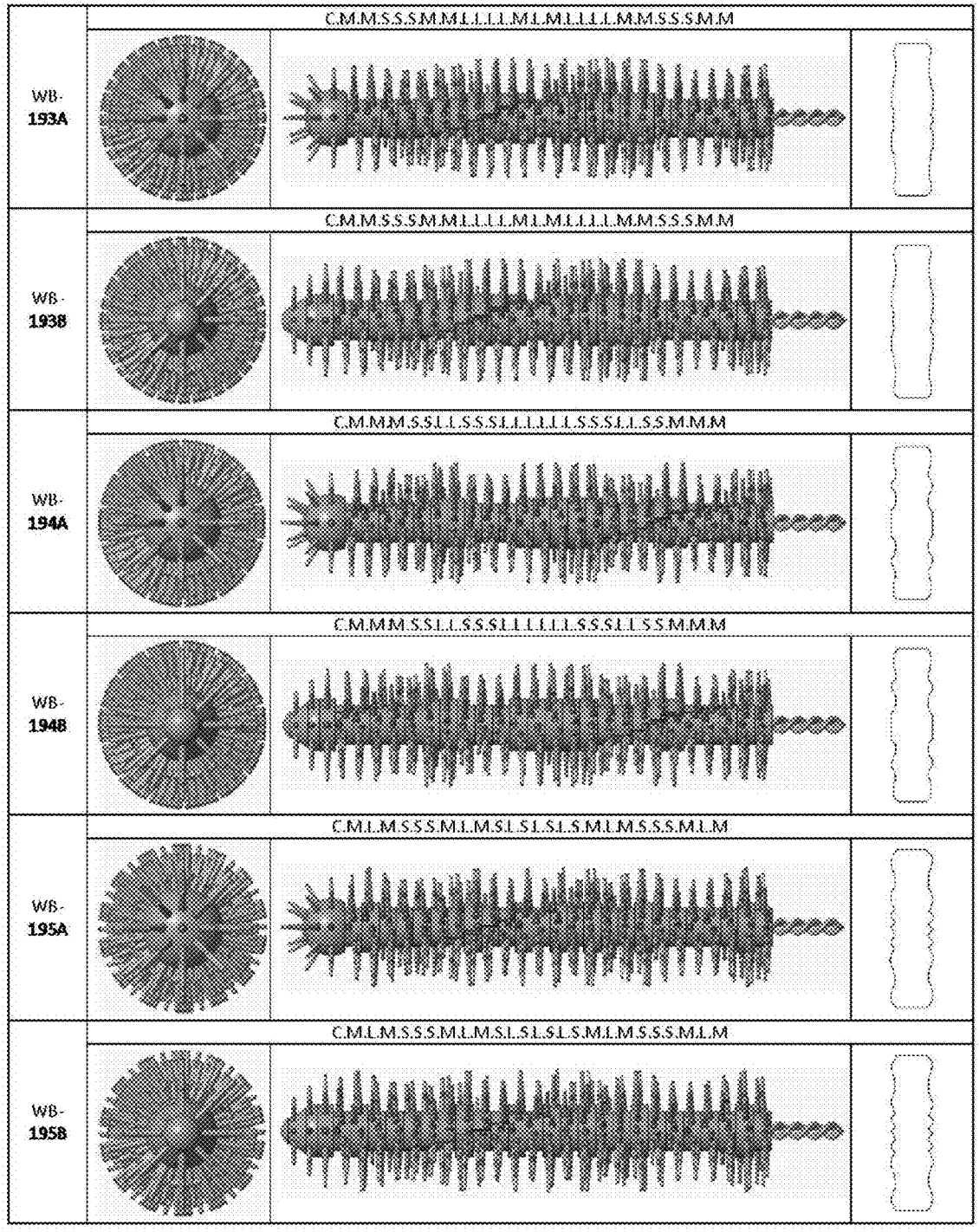
Figure 72:
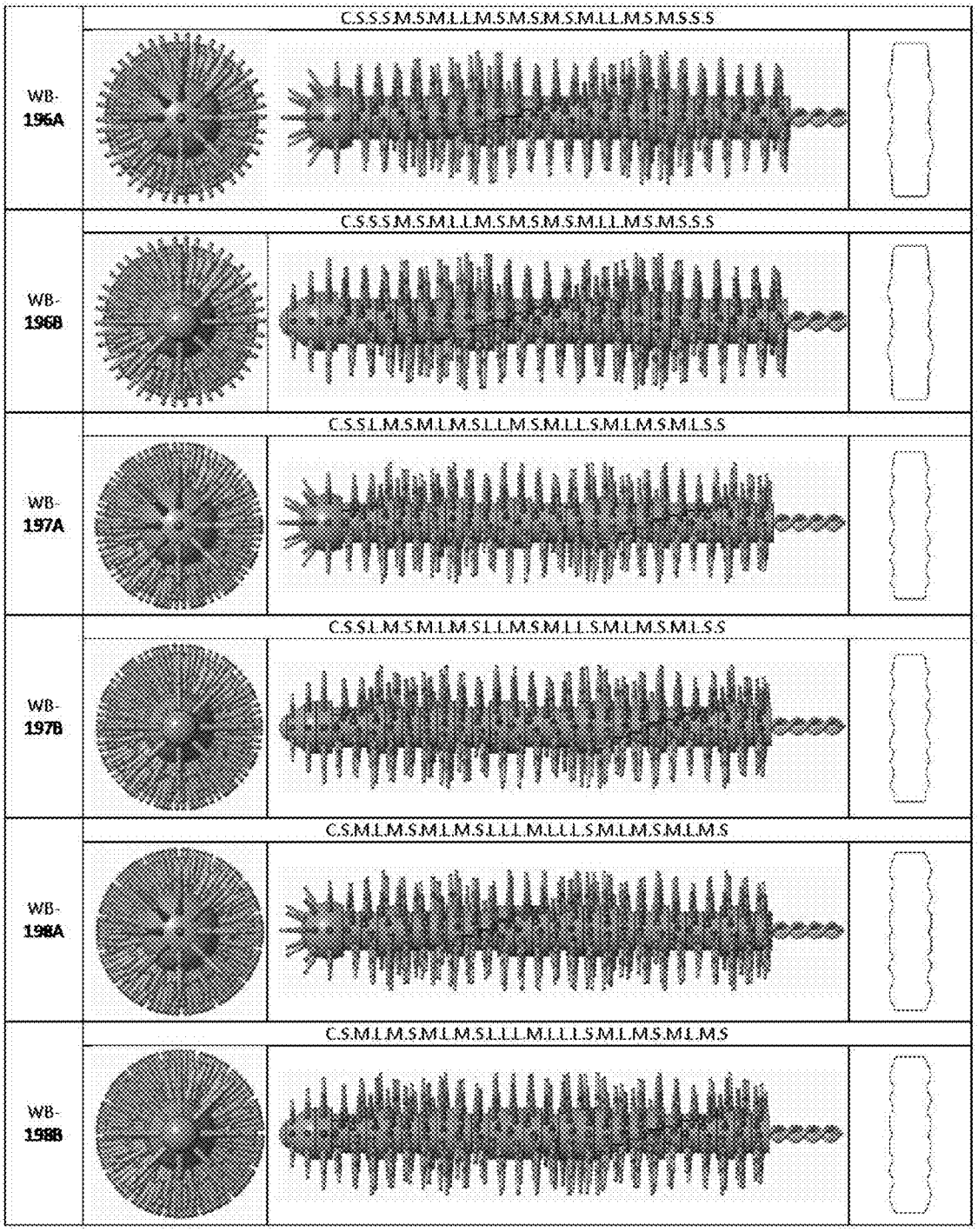

Referring to FIGS. 6 (*a*)-(*d*), a manufacturing method of a cosmetic applicator brush (1/2/3) in accordance with an embodiment of the invention will be described. (12/22/32) are (bi-) injection molded with a conical (11/21/31) before stacking or linking the plurality of discs (13/23/33). The wires (12/22/32), which are separate and parallel to each other, are used to link or stack the discs (13/23/33). After stacking or linking the plurality discs (13/23/33), the wires (12/22/32) are twisted so that the discs are securely linked or stacked.

First, the conical (11/21/31) of any shape/material is molded with the wires (12/22/32). Any molding methods can be used. Single wire can also be molded with the conical (11/21/31).

Second, the plurality of discs (13/23/33) are linked or stacked by passing the wires (12/22/32) through wire passages of each disc. The discs (13/23/33) are stacked or linked such that alignment of bristles for the stacked discs is uniform. The discs are linked or stacked without any angular offset or with a uniform angular offset.

Third, after the plurality of discs are linked or stacked, the wires (12/22/32) are twisted. The method of twisting of the wires (12/22/32) includes any twisting methods. It is preferred that a topmost portion (6) and a bottommost portion (7) of the wires are twisted. The topmost portion (6) is a top portion of the remaining wires, and the bottommost portion (7) is a bottom portion of the remaining wires after the competition of the second step (stacking or linking the plurality of wires).

It is also possible that after the plurality of discs are linked or stacked, the wires (12/22/32) may not be twisted. In addition, the remaining wires after the plurality of discs are linked or stacked could be reshaped as a "X" shape (predetermined shape). Alternatively, the remaining wires after the plurality of discs are linked or stacked could be designed such that there is no twisting as long as the plurality of discs are linked or stacked securely.

Finally, after completing the first three steps, a cosmetic applicator of the present invention is shown in FIG. 6 (*d*) (right side; finished product).

It is noted that while the shape of the disc in each example is circular, the invention is not limited to such and the disc body can have any shape desired. For example, the shape of the disc body can be triangular, quadrangular, pentagonal, hexagonal, rectangular, and etc. In addition, it is noted that the disc can be made of any materials including plastic by mono-injection molding and bi-injection molding, rubber, silicon and metal.

Figure 73:
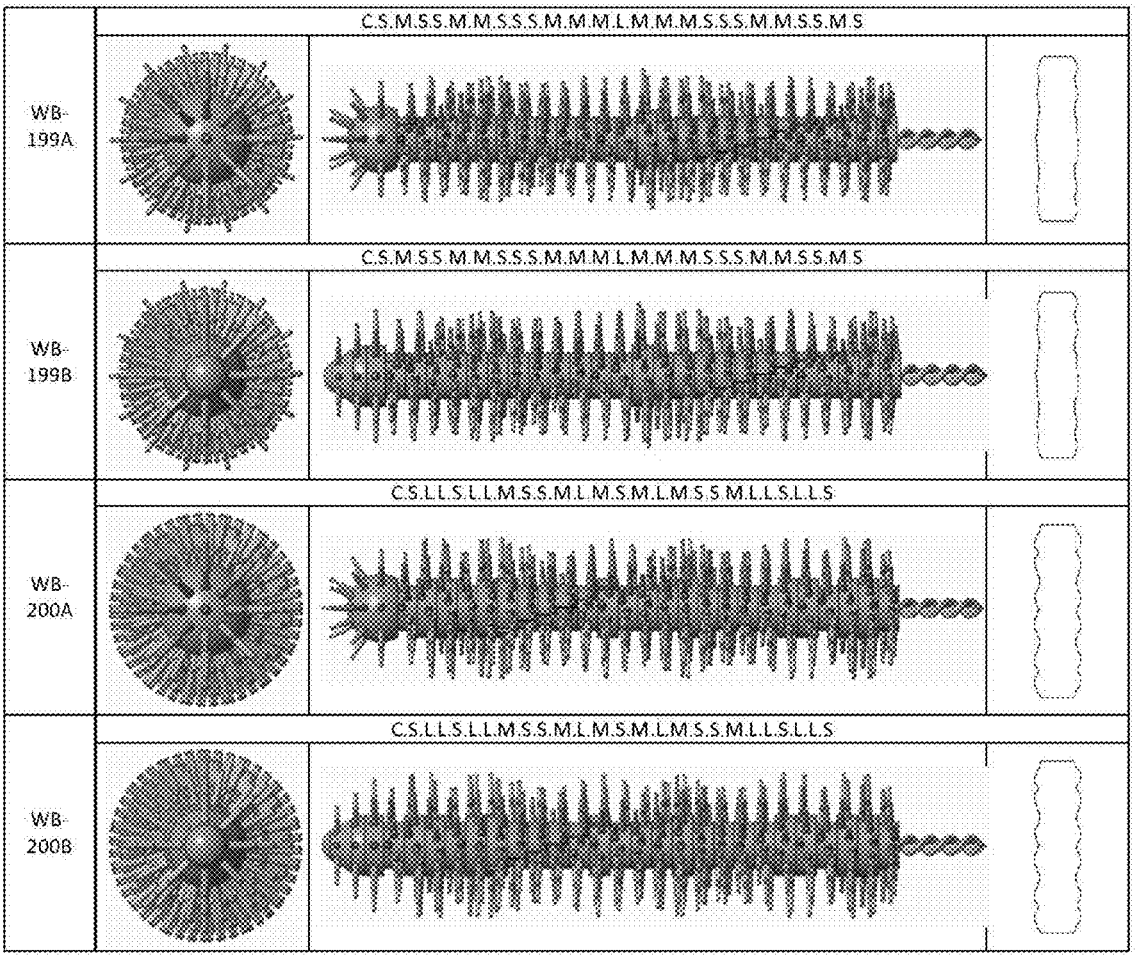

FIGS. 7-73 show various designs of a cosmetic applicator brush with various designs of a conical and a plurality of discs stacked or linked by wires. However, the designs of the cosmetic applicator brush are not limited to the designs shown in FIGS. 7-73.

These and other advantages of the present invention will be apparent to those skilled in the art from the foregoing specification. For example, the present invention provides a cosmetic applicator (called "Wonder Mascara Brush") that is capable of providing excellent mascara makeup effect such as volumizing, curling, separation, and lengthening. In addition, the present invention provides a cosmetic applicator, where each disc could have different colors, shapes and sizes, thereby creating a visually attractive cosmetic.

In particular, a conical is used to improve makeup performance, enabling the user to makeup areas that would be hard to apply cosmetics including corners of the eyes or other areas. In addition, the conical (molded with the wires) prevents the stacked discs from rotating or deviating from the wires and allows the stacked discs being securely positioned between the top portion ("conical portion") and the bottom portion ("twisted wires portion").

Furthermore, the present invention provides a cosmetic applicator, where alignment of bristles of the discs is uniform by not twisting the wires to link or stack the discs (only twisting after linking or stacking all discs at the bottom portion). Therefore, it is possible to mass-produce the cosmetic applicator with a very small defect rate, which would not have been possible when entire portion of the wires are twisted.

Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A cosmetic applicator brush comprising:

a plurality of discs assembled relative to one another with each disc having a body with a plurality of bristles or combs extending radially therefrom;

a conical portion; and a plurality of wires, wherein the plurality of wires pass through a wire passage of each of the plurality of discs, the plurality of discs are stacked or linked without any angular offset so that alignment of bristles for the stacked discs is uniform, after the plurality of discs are stacked or linked, the plurality of wires are twisted at a bottom portion of the cosmetic applicator brush so that the discs are securely linked or stacked, and the plurality of wires do not change the angular offset of the plurality of discs that are stacked or linked.

2. The cosmetic applicator brush according to claim 1, wherein the plurality of discs are stacked or linked without twisting the plurality of wires.

3. The cosmetic applicator brush according to claim 1, wherein the conical portion is injection molded with the plurality of wires, and a top portion of the cosmetic applicator brush has the conical portion.

4. The cosmetic applicator brush according to claim 3, wherein the conical portion is injection molded with the plurality of wires before stacking or linking the plurality of discs.

5. The cosmetic applicator brush according to claim 1, wherein after the plurality of discs are stacked or linked, the plurality of wires are not twisted at a bottom portion of the cosmetic applicator brush and reshaped to a predetermined shape so that the discs are securely linked or stacked.

6. The cosmetic applicator brush according to claim 1, wherein the plurality of wires are parallel and separate from each other.

7. The cosmetic applicator brush according to claim 1, wherein a topmost portion and a bottommost portion of the plurality of wires are twisted, topmost portion being a top portion of the remaining wires, and the bottommost portion being a bottom portion of the remaining wires after the plurality of discs are stacked or linked.

* * * * *